US012490802B2

(12) United States Patent
Matsuhisa et al.

(10) Patent No.: US 12,490,802 B2
(45) Date of Patent: Dec. 9, 2025

(54) FOOTWEAR

(71) Applicant: ASICS CORPORATION, Kobe (JP)

(72) Inventors: Yuka Matsuhisa, Kobe (JP); Seiji Yano, Kobe (JP); Kenji Hirata, Kobe (JP); Genki Hatano, Kobe (JP)

(73) Assignee: ASICS CORPORATION, Hyogo (JP)

( * ) Notice: Subject to any disclaimer, the term of this patent is extended or adjusted under 35 U.S.C. 154(b) by 9 days.

(21) Appl. No.: 18/379,472

(22) Filed: Oct. 12, 2023

(65) Prior Publication Data

US 2024/0122296 A1 Apr. 18, 2024

(30) Foreign Application Priority Data

Oct. 14, 2022 (JP) ..... 2022-165739

(51) Int. Cl.
*A43B 13/18* (2006.01)
*A43B 7/145* (2022.01)

(52) U.S. Cl.
CPC ..... *A43B 13/181* (2013.01); *A43B 7/145* (2013.01); *A43B 13/188* (2013.01)

(58) Field of Classification Search
CPC ..... A43B 13/181; A43B 13/18; A43B 13/186; A43B 13/188; A43B 7/145
USPC ..... 36/28
See application file for complete search history.

(56) References Cited

U.S. PATENT DOCUMENTS 4,561,195 A * 12/1985 Onoda ..... A43B 13/10 36/31
4,910,884 A * 3/1990 Lindh ..... A43B 13/18 36/27
5,577,334 A * 11/1996 Park ..... A43B 7/142 36/35 R
5,642,575 A * 7/1997 Norton ..... A43B 13/181 36/27
2006/0254087 A1* 11/2006 Fechter ..... A43B 13/183 36/27
2007/0193065 A1* 8/2007 Nishiwaki ..... A43B 21/265 36/35 B
2016/0235158 A1 8/2016 Desjardins et al.
(Continued)

FOREIGN PATENT DOCUMENTS

JP 2018187363 A 11/2018

OTHER PUBLICATIONS

European Search Report issued Feb. 16, 2024 in corresponding European Application No. 23202475.2.

*Primary Examiner* — Marie D Bays
(74) *Attorney, Agent, or Firm* — Global IP Counselors, LLP

(57) ABSTRACT

Footwear includes a sole portion that supports a foot sole of a foot of a wearer, the sole portion including a ground contact surface and a shock absorbing portion formed of an elastic body. The shock absorbing portion includes a three-dimensional mesh structure portion in which a plurality of unit structures are repeatedly arranged so as to be adjacent to each other and an irregularly shaped portion that has a different shape from each of the unit structures and is at least partially embedded in the three-dimensional mesh structure portion. The irregularly shaped portion includes a protruding plate portion in which a central portion protrudes relative to a peripheral edge portion in a direction orthogonal to the ground contact surface.

20 Claims, 41 Drawing Sheets

(56) References Cited

U.S. PATENT DOCUMENTS

| | | | | |
|---|---|---|---|---|
| 2016/0374428 | A1* | 12/2016 | Kormann | A43B 7/141 36/28 |
| 2018/0000194 | A1* | 1/2018 | Estrada Vigueras | B29D 35/122 |
| 2018/0271213 | A1 | 9/2018 | Perrault et al. | |
| 2021/0030113 | A1* | 2/2021 | Schuster | B33Y 80/00 |
| 2021/0037914 | A1* | 2/2021 | Adametz | A43B 13/182 |
| 2021/0195989 | A1* | 7/2021 | Iwasa | A43B 7/1415 |
| 2021/0298415 | A1* | 9/2021 | Kita | B33Y 80/00 |
| 2021/0321716 | A1 | 10/2021 | Kormann et al. | |
| 2022/0232929 | A1* | 7/2022 | Hann | A43B 13/186 |

* cited by examiner

FOOTWEAR

CROSS REFERENCE TO RELATED APPLICATIONS

This nonprovisional application is based on Japanese Patent Application No. 2022-165739 filed on Oct. 14, 2022 with the Japan Patent Office, the entire contents of which are hereby incorporated by reference.

BACKGROUND

Technical Field

The present disclosure relates to footwear represented by sandals, shoes, and the like.

Background Information

Japanese Patent Laying-Open No. 2018-187363 discloses a footwear sole manufactured by a three-dimensional additive manufacturing method, and U.S. Patent Application Publication No. 2016/0235158 discloses a footwear sockliner manufactured by a three-dimensional additive manufacturing method. Each of the sole and sockliner disclosed in the above-mentioned documents is formed of a three-dimensional mesh structure body in which a plurality of unit structures are repeatedly arranged so as to be adjacent to each other.

SUMMARY

It has been determined that in recovery shoes (recovery sandals) used for fatigue recovery by dispersion of foot pressure, for support of a foot arch, for support against heel collapse called pronation, and the like, and particularly used after a highly intensive physical exercise or activity (running, various types of ball games, mountain climbing, and the like), or used after a long-time flight (traveling by airplane), the sole portion needs to have high deformability and such deformability needs to be different in each part.

In order to achieve such deformability, a shock absorbing portion disposed in the sole portion needs to be designed in consideration not only of materials but also of structures, and thus, it is conceivable to form the shock absorbing portion from a three-dimensional mesh structure body as disclosed in the above-mentioned documents. However, in each of the sole and the sockliner disclosed in the above-mentioned documents, the difference of the deformability that can be given in each part is not necessarily sufficient in terms of its structure, and thus, there is still room for improvement in this respect.

Thus, the present disclosure has been made in view of the above-described circumstances and discloses footwear configured to have high deformability while still readily enabling the deformability to be significantly different in each part.

Footwear according to the present disclosure includes a sole portion that supports a foot sole of a foot of a wearer, the sole portion including a ground contact surface. The sole portion includes a shock absorbing portion formed of an elastic body. The shock absorbing portion includes a three-dimensional mesh structure portion in which a plurality of unit structures are repeatedly arranged so as to be adjacent to each other, and an irregularly shaped portion that is different in shape from each of the unit structures and is at least partially embedded in the three-dimensional mesh structure portion. The irregularly shaped portion includes a protruding plate portion in which a central portion protrudes relative to a peripheral edge portion in a direction orthogonal to the ground contact surface.

The foregoing and other objects, features, aspects, and advantages of the present disclosure will become apparent from the following detailed description of the present disclosure, which is understood in conjunction with the accompanying drawings.

DETAILED DESCRIPTION

Figure 1:
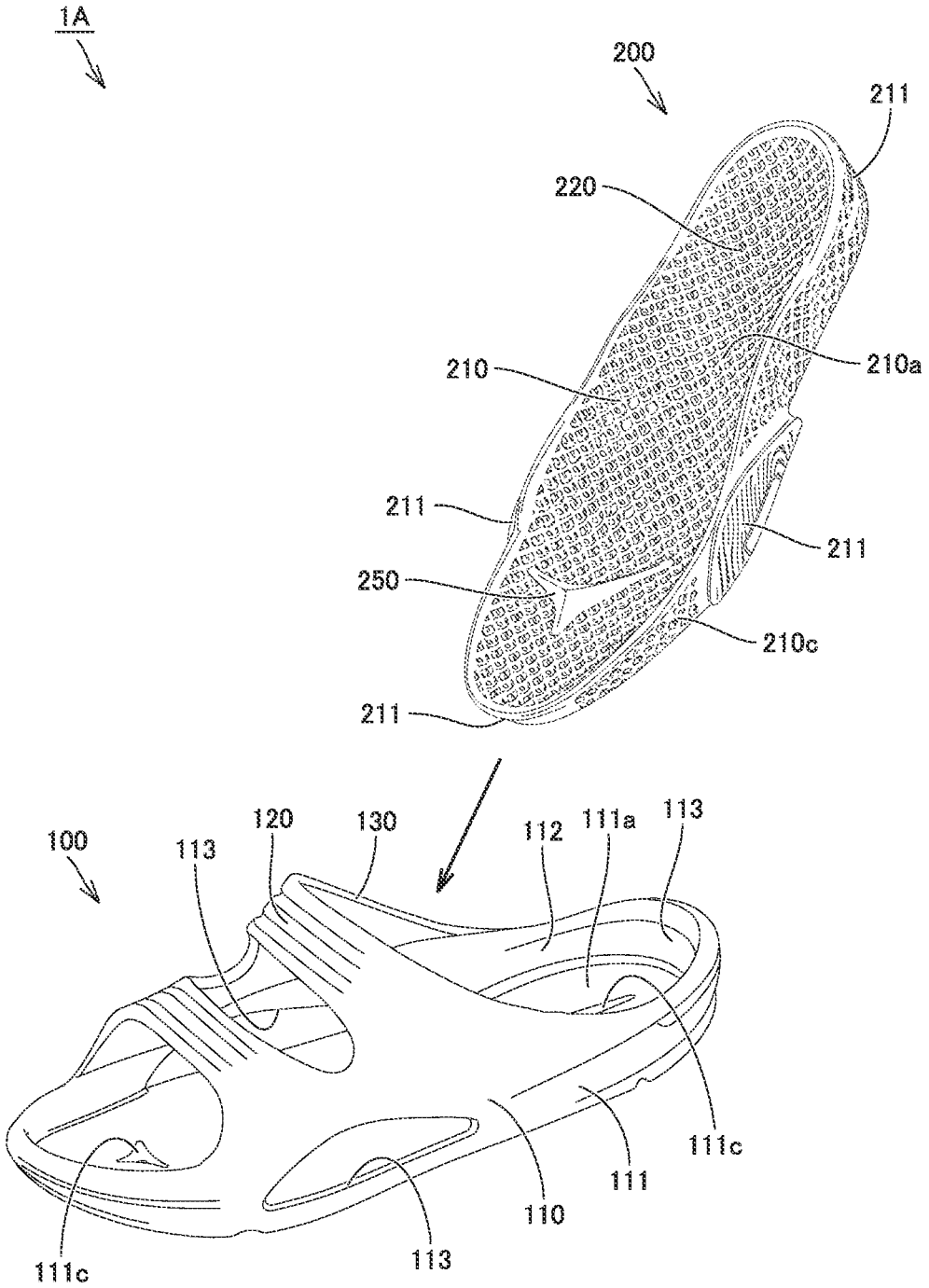
FIG. 1 is an exploded perspective view of footwear according to a first embodiment.

The following describes embodiments of the present disclosure in detail with reference to the accompanying drawings. In the embodiments described below, the same or common portions are denoted by the same reference characters, and the description thereof will not be repeated.

First Embodiment

Figure 2:
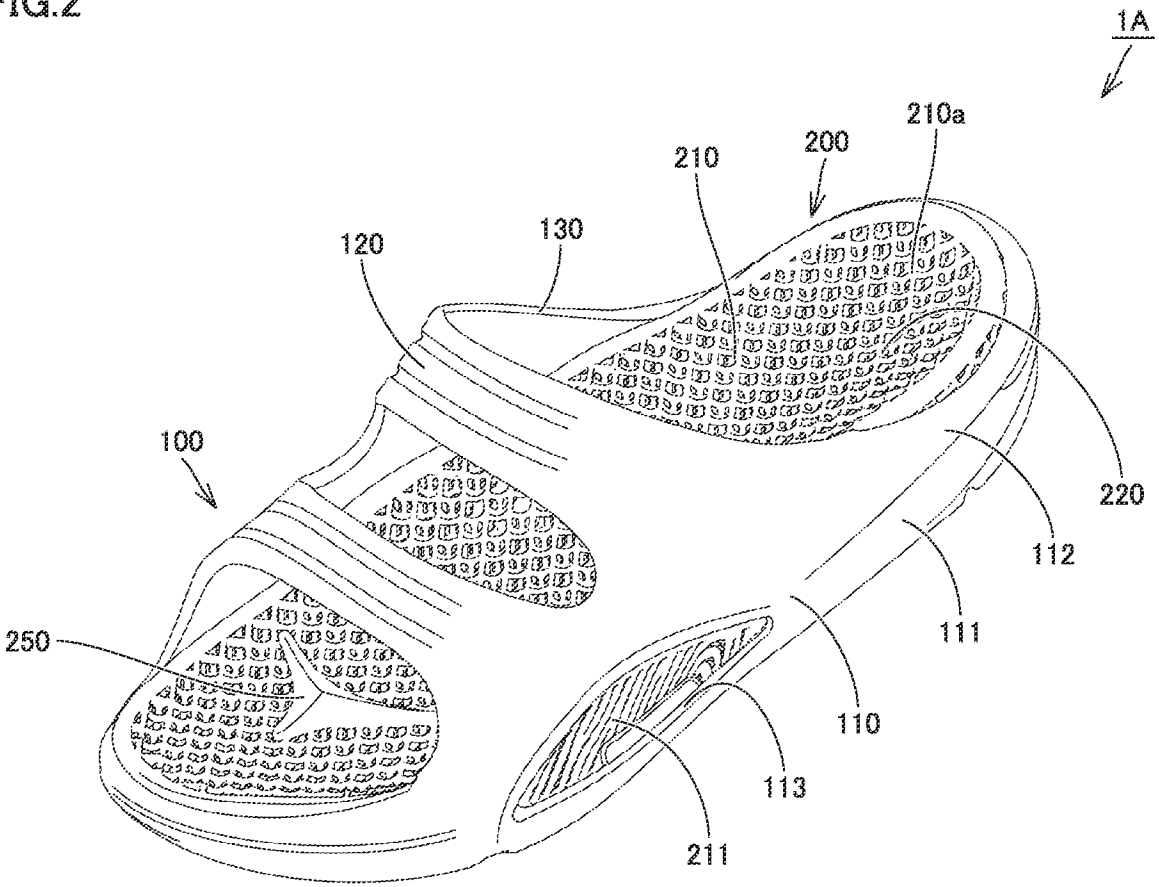
FIG. 2 is a perspective view of the footwear according to the first embodiment.
Figure 3:
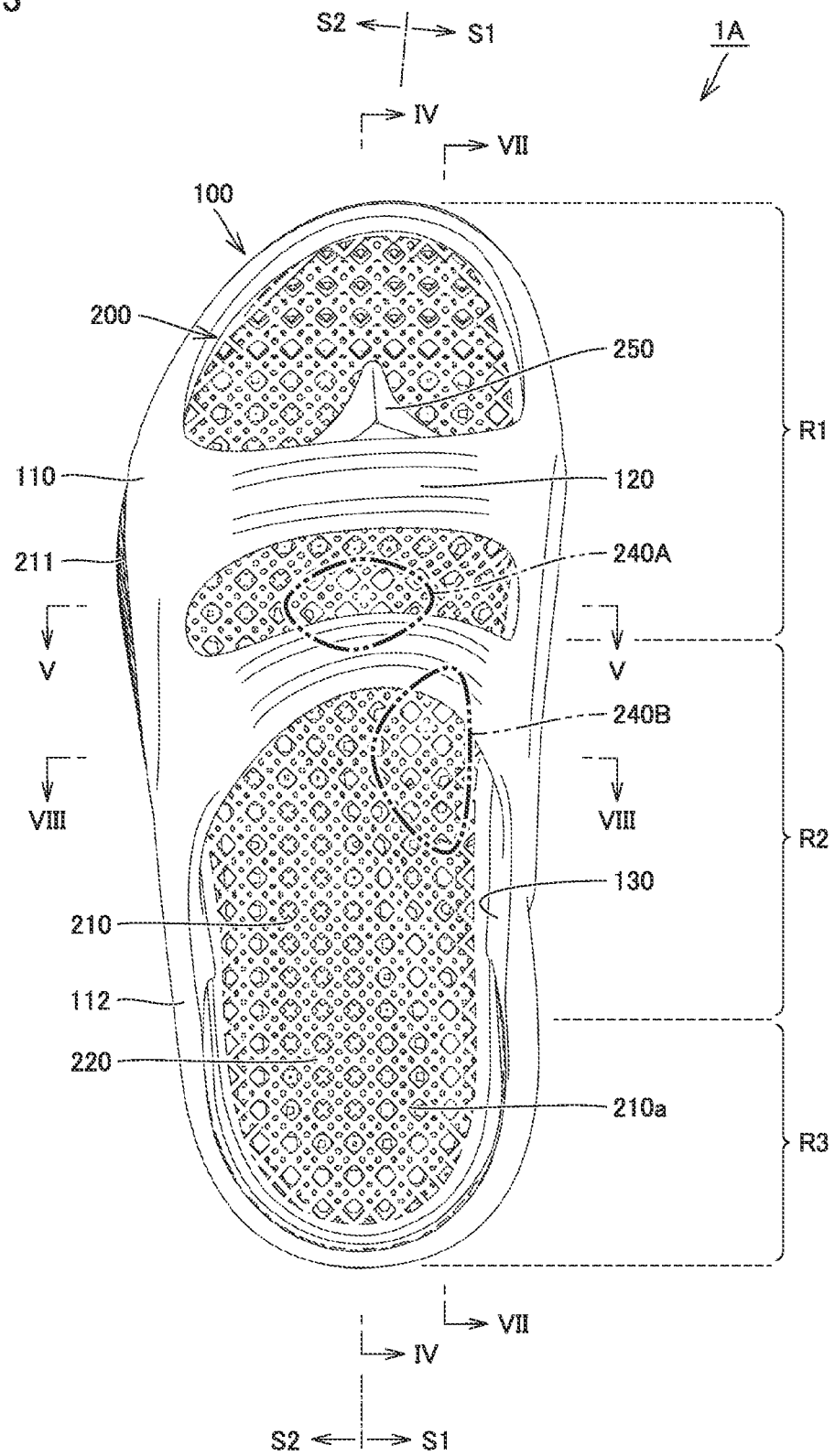
FIG. 3 is a plan view of the footwear according to the first embodiment.

FIG. 1 is an exploded perspective view of footwear according to the first embodiment, and FIGS. 2 and 3 are a perspective view and a plan view, respectively, of the footwear, which show an attached state after a sole body is attached to a shell. First, a schematic configuration of footwear 1A according to the present embodiment will be described with reference to FIGS. 1 to 3.

As shown in FIGS. 1 to 3, the footwear 1A includes a shell 100 and a sole body 200. The footwear 1A is used in an attached state in which the sole body 200 is attached to the shell 100, and thus, a sole portion supporting a foot sole of a wearer is formed of an outsole portion 110 (described later) of the shell 100 and a foot bed portion 210 (described later) of the sole body 200. In other words, when the wearer wears the footwear 1A, the wearer's foot sole is placed on the sole body 200.

In this case, in the footwear 1A according to the present embodiment, as described later, the sole body 200 is formed of a single additively manufactured product manufactured by a three-dimensional additive manufacturing method, and thereby, the foot bed portion 210 is almost entirely configured as a shock absorbing portion 220, so as to achieve high shock absorbing performance. Therefore, in the sole portion formed of the outsole portion 110 of the shell 100 and the foot bed portion 210 of the sole body 200, exclusively the foot bed portion 210 of the sole body 200 mainly exhibits the shock absorbing performance. The footwear 1A according to the present embodiment is a sandal.

As shown in FIG. 3, the footwear 1A is divided into a forefoot portion R1, a midfoot portion R2, and a rearfoot portion R3 in a front-rear direction (the up-down direction in FIG. 3) corresponding to a foot length direction of the wearer's foot when seen in a plan view. The forefoot portion R1 supports a toe portion and a ball portion of the wearer's foot, the midfoot portion R2 supports an arch portion of the wearer's foot, and the rearfoot portion R3 supports a heel portion of the wearers foot.

Further, when seen in a plan view, the footwear 1A is divided into a portion on the medial foot side (a portion on the S1 side shown in the figure) and a portion on the lateral foot side (a portion on the S2 side shown in FIG. 3) in a left-right direction corresponding to a foot width direction of the wearer's foot (in the left-right direction in FIG. 3). In this case, the portion on the medial foot side corresponds to the medial side of the foot in anatomical position (i.e., the side close to the midline) and the portion on the lateral foot side is opposite to the medial side of the foot in anatomical position (i.e., the side away from the midline).

In this case, with reference to the front end of the footwear 1A, a first boundary position is defined at a position located at 30% of the dimension of the footwear 1A from the front end in the front-rear direction, and a second boundary position is defined at a position located at 80% of the dimension of the footwear 1A from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the footwear 1A in the front-rear direction.

Note that the up-down direction (described later) of the footwear 1A is orthogonal both to the front-rear direction corresponding to the above-mentioned foot length direction of the wearer's foot and the left-right direction corresponding to the above-mentioned foot width direction of the wearer's foot.

As shown in FIGS. 1 to 3, the shell 100 includes the outsole portion 110 provided with a ground contact surface 111*b* (see FIG. 5 and the like), and a foot cover portion 120 that covers an instep of the wearer's foot.

The outsole portion 110 includes a base portion 111 having a flat shape and a peripheral wall portion 112 extending upward from a peripheral edge of the base portion 111. A lower surface of the base portion 111 defines the ground contact surface 111*b* that comes into contact with the ground, a floor surface, or the like. An inner side surface of the peripheral wall portion 112 covers a peripheral surface 210*c* of the foot bed portion 210 of the sole body 200 in the attached state (see FIGS. 2, 3 and the like).

The foot cover portion 120 serves to cover the instep of the wearer's foot and is located above the outsole portion 110. In the footwear 1A according to the present embodiment, the foot cover portion 120 is formed of two portions each having a strap shape (i.e., a strip shape), which can be variously modified.

The foot cover portion 120 extends in the left-right direction so as to have a substantially mountain-like shape when viewed in the front-rear direction. The foot cover portion 120 has one end connected to a portion located on the medial foot side of the peripheral wall portion 112, and the other end connected to a portion located on the lateral foot side of the peripheral wall portion 112.

Thereby, a topline 130 is formed by a part of the peripheral wall portion 112 that is located rearward of the foot cover portion 120 and the rear end of the foot cover portion 120, and a hollow portion is provided between the outsole portion 110 and the foot cover portion 120. Thus, by inserting the wearer's foot into the hollow portion through the topline 130 in the attached state in which the sole body 200 is attached to the shell 100, the footwear 1A can be worn.

The base portion 111 includes a plurality of air holes 111*c* that extend to a portion defining the ground contact surface 111*b* as a lower surface of the base portion 111, and a portion defining an upper bottom surface 111*a* as an upper surface of the base portion 111. The plurality of air holes 111*c* ensure air permeability during wearing of the footwear 1A. In the present embodiment, two air holes 111*c* are disposed in the base portion 111.

A plurality of engaged portions 113 are disposed in the peripheral wall portion 112 of the outsole portion 110. In the present embodiment, a protruding portion having a protruding shape is provided on each of the inner side surface in a portion of the peripheral wall portion 112 that corresponds to a front end of the forefoot portion R1, and the inner side surface in a portion of the peripheral wall portion 112 that corresponds to a rear end of the rearfoot portion R3. The protruding portion is provided to extend in the peripheral direction of the inner side surface. Further, a cutout portion that can be a hole is disposed in a portion of the peripheral wall portion 112 on each of the medial foot side and the lateral foot side in a region extending over the boundary between the forefoot portion R1 and the midfoot portion R2. The cutout portion penetrates through the peripheral wall portion 112 and extends in the peripheral direction of the peripheral wall portion 112. Two protruding portions and two cutout portions constitute a plurality of engaged portions 113 described above.

In the attached state, a plurality of engaging portions 211 provided in the sole body 200 (described later) engage with these plurality of engaged portions 113, so that the sole body 200 can be attached to the shell 100.

The shell 100 can be basically made of any material as long as it has flexibility, but the material preferably has appropriate strength. From this viewpoint, the shell 100 is preferably made of a resin material or a rubber material. More specifically, when the shell 100 is made of resin, it can be made, for example, of an ethylene-vinyl acetate copolymer (EVA), a polyolefin resin, a polyamide-based thermoplastic elastomer (TPA, TPAE), a thermoplastic polyurethane (TPU), and a polyester-based thermoplastic elastomer (TPEE). On the other hand, when the shell 100 is made of rubber, for example, butadiene rubber (BR) can be used.

The method of manufacturing the shell 100 is not particularly limited, and the shell 100 can be manufactured, for example, by injection molding, cast molding, or molding using a three-dimensional additive manufacturing apparatus.

The sole body 200 has the foot bed portion 210 having a flat shape, and an outer shape of the foot bed portion 210 in a plan view substantially coincides with an outer shape of the space defined by the base portion 111 and the peripheral wall portion 112 of the outsole portion 110 of the shell 100. The sole body 200 is formed of a single additively manufactured product manufactured by a three-dimensional additive manufacturing method as described above, and more specifically, is formed of a single additively manufactured product manufactured, for example, by a vat polymerization-type three-dimensional additive manufacturing method. In the sole body 200, the foot bed portion 210 is almost entirely formed of a three-dimensional mesh structure portion 230 (see FIG. 4 and the like) described later, and thereby, the foot bed portion 210 almost entirely functions as the shock absorbing portion 220 as described above.

The foot bed portion 210 has an upper surface having a supporting surface 210*a* that supports a foot sole of the wearer's foot in the attached state, and a lower surface having a supported surface 210*b* (see FIG. 4 and the like) supported by the upper bottom surface 111*a* of the base portion 111 of the shell 100 in the attached state.

Further, a plurality of engaging portions 211 are disposed in the peripheral surface 210*c* of the foot bed portion 210. In the present embodiment, a cutout portion having a recessed shape extending in the peripheral direction of the peripheral surface 210*c* is disposed in each of a portion of the peripheral surface 210*c* that corresponds to the front end of the forefoot portion R1, and a portion of the peripheral surface 210*c* that corresponds to the rear end of the forefoot portion R3. Further, a protruding portion having a protruding shape extending in the peripheral direction of the peripheral surface 210*c* is disposed in a portion of the peripheral surface 210*c* on each of the medial foot side and the lateral foot side in a region extending over the boundary between the forefoot portion R1 and the midfoot portion R2. Two cutout portions and two protruding portions constitute the above-mentioned plurality of engaging portions 211.

In this case, as described above, in the attached state, the plurality of engaging portions 211 engage with the plurality of engaged portions 113 provided in the shell 100, so that the sole body 200 can be attached to the shell 100. Thus, by employing the above-described configuration, the sole body 200 can be detachably attached to the shell 100. Also, if the shell 100 is equipped in advance with various types of the sole body 200 according to an intended use, the wearer can freely replace the sole body 200 according to the intended use, which makes it possible to implement excellently convenient footwear.

In this case, in the footwear 1A according to the present embodiment, the shock absorbing portion 220 provided in the foot bed portion 210 of the sole body 200 includes, in addition to the above-mentioned three-dimensional mesh structure portion 230, protruding plate portions 240A and 240B (FIG. 3 schematically shows only their positions of arrangement) each provided as an irregularly shaped portion, and a protrusion 250 provided on the supporting surface 210*a* of the foot bed portion 210, each of which will be described later in detail.

The material of the sole body 200 is not particularly limited but is preferably a resin material or a rubber material so as to enable additive manufacturing by a vat polymerization-type three-dimensional additive manufacturing method and so as to enable the additively manufactured sole body 200 to have appropriate flexibility, elongation, durability, elasticity, stability, and the like. More specifically, when the sole body 200 is made of resin, examples of resin can be a polyolefin resin, ethylene-vinyl acetate copolymer (EVA), polyamide-based thermoplastic elastomer (TPA, TPAE), thermoplastic polyurethane (TPU), or polyester-based thermoplastic elastomer (TPEE). On the other hand, when the sole body 200 is made of rubber, for example, butadiene rubber (BR) can be used.

The sole body 200 can also be formed of a polymer composition. Examples of polymer to be contained in the polymer composition include olefinic polymers such as olefinic elastomers and olefinic resins. Examples of the olefinic polymers include polyolefins such as polyethylene (e.g., linear low density polyethylene (LLDPE), high density polyethylene (HDPE), and the like), polypropylene, ethylene-propylene copolymer, propylene-1-hexene copolymer, propylene-4-methyl-1-pentene copolymer, propylene-1-butene copolymer, ethylene-1-hexene copolymer, ethylene-4-methyl-pentene copolymer, ethylene-1-butene copolymer, 1-butene-1-hexene copolymer, 1-butene-4-methyl-pentene, ethylene-methacrylic acid copolymer, ethylene-methyl methacrylate copolymer, ethylene-ethyl methacrylate copolymer, ethylene-butyl methacrylate copolymer, ethylene-methyl acrylate copolymer, ethylene-ethyl acrylate copolymer, ethylene-butyl acrylate copolymer, propylene-methacrylic acid copolymer, propylene-methyl methacrylate copolymer, propylene-ethyl methacrylate copolymer, propylene-butyl methacrylate copolymer, propylene-methyl acrylate copolymer, propylene-ethyl acrylate copolymer, propylene-butyl acrylate copolymer, ethylene-vinyl acetate copolymer, propylene-vinyl acetate copolymer, and the like.

Examples of the polymer can be an amide-based polymer such as an amide-based elastomer and an amide-based resin. Examples of the amide-based polymer include polyamide 6, polyamide 11, polyamide 12, polyamide 66, polyamide 610, and the like.

Examples of the polymer can be an ester-based polymer such as an ester-based elastomer and an ester-based resin. Examples of the ester-based polymer include polyethylene terephthalate, poly butylene terephthalate, and the like.

Examples of the polymer can be a urethane-based polymer such as a urethane-based elastomer and a urethane-based resin. Examples of the urethane-based polymer include polyester-based polyurethane, polyether-based polyurethane, and the like.

Examples of the polymer can be a styrene-based polymer such as a styrene-based elastomer and a styrene-based resin. Examples of the styrene-based elastomer include styrene-ethylene-butylene copolymer (SEB), styrene-butadiene-styrene copolymer (SBS), a hydrogenated product of SBS (styrene-ethylene-butylene-styrene copolymer (SEBS)), styrene-isoprene-styrene copolymer (SIS), a hydrogenated product of SIS (styrene-ethylene-propylene-styrene copolymer (SEPS)), styrene-isobutylene-styrene copolymer (SIBS), styrene-butadiene-styrene-butadiene (SBSB), styrene-butadiene-styrene-butadiene-styrene (SBSBS), and the like. Examples of the styrene-based resin include polystyrene, acrylonitrile styrene resin (AS), acrylonitrile butadiene styrene resin (ABS), and the like.

Examples of the polymer include acrylic polymers such as polymethylmethacrylate, urethane-based acrylic polymers, polyester-based acrylic polymers, polyether-based acrylic polymers, polycarbonate-based acrylic polymers, epoxy-based acrylic polymers, conjugated diene polymer-based acrylic polymers and hydrogenated products thereof, urethane-based methacrylic polymers, polyester-based methacrylic polymers, polyether-based methacrylic polymers, polycarbonate-based methacrylic polymers, polyester-based urethane acrylate, polycarbonate-based urethane acrylate, polyether-based urethane acrylate, epoxy-based methacrylic polymers, conjugated diene polymer-based methacrylic polymers and hydrogenated products thereof, polyvinyl chloride-based resins, silicone-based elastomers, butadiene rubber, isoprene rubber (IR), chloroprene rubber (CR), natural rubber (NR), styrene-butadiene rubber (SBR), acrylonitrile-butadiene rubber (NBR), butyl rubber (IIR), and the like.

The sole body 200 is preferably made of a material that enables wearing comfort with flexibility, and thus, the sole body 200 is preferably made particularly of urethane acrylate among the above-mentioned types of materials. The sole body 200 made of urethane acrylate not only has excellent durability and elongation but also has sufficient elasticity. As described above, since the sole body 200 is produced, for example, by the vat polymerization-type three-dimensional additive manufacturing method, the sole body 200 can contain a curing agent as a sub-component.

In this case, according to the vat polymerization-type three-dimensional additive manufacturing method, a photocurable liquid resin or liquid rubber that is hardened by light of a specific wavelength is used as a main raw material, to which this light of a specific wavelength is applied to thereby sequentially stack hardened portions, and thus, an additively manufactured product having a desired shape is produced. Examples of the light of a specific wavelength used herein can be ultraviolet light, in which case an ultraviolet curing resin or rubber is used as a main raw material. Note that the above-mentioned liquid resin or liquid rubber as a main raw material is not limited to one-component type but can be two-component type or the like.

Further, the additively manufactured product manufactured by the three-dimensional additive manufacturing method is not sufficiently hardened but still relatively soft immediately after the additive manufacturing process. Thus, the additively manufactured product after the additive manufacturing process is separately washed and heated to be substantially hardened, and further washed and dried.

Figure 4:
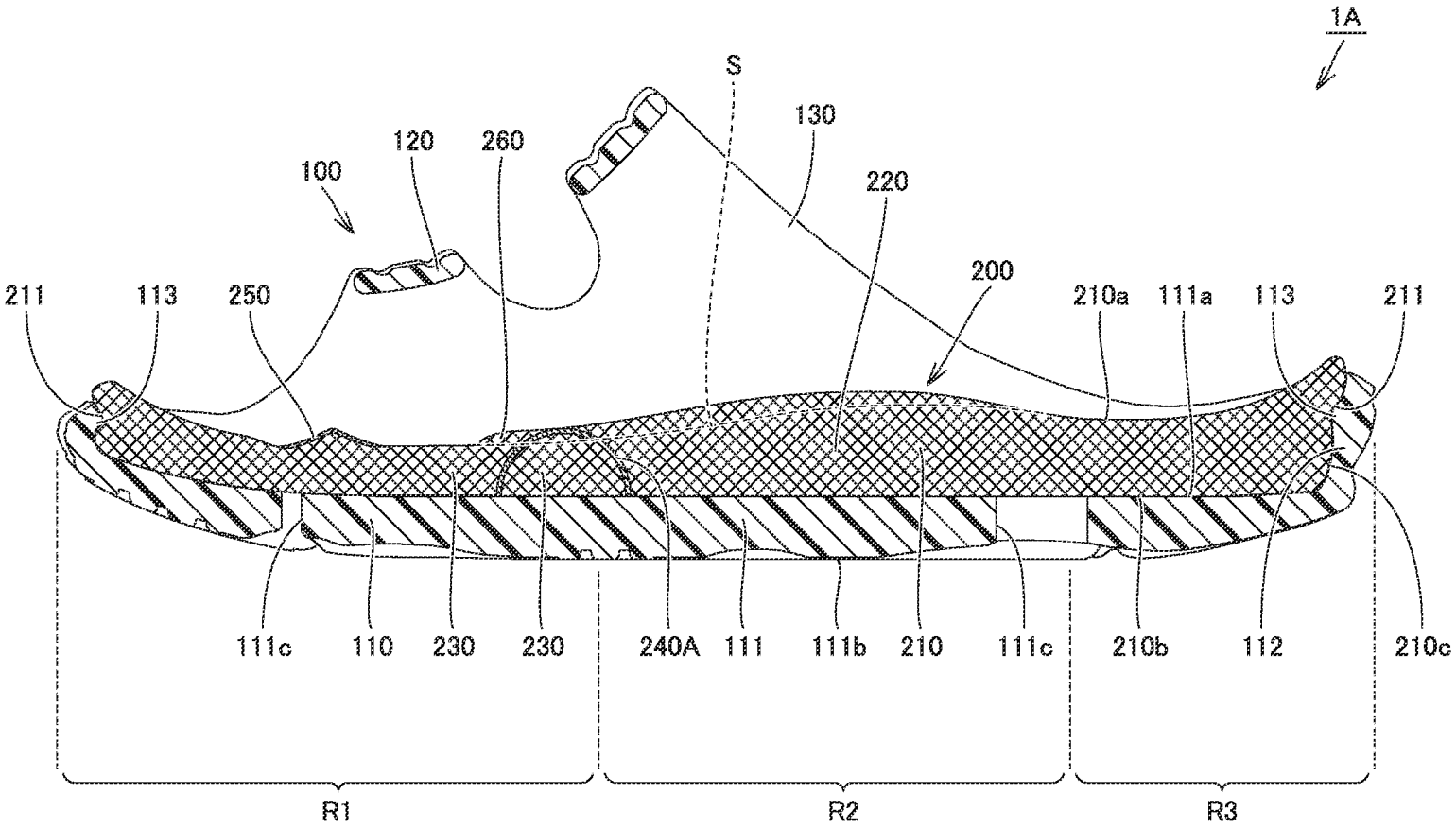
FIG. 4 is a schematic cross-sectional view taken along a line IV-IV shown in FIG. 3.
Figure 5:
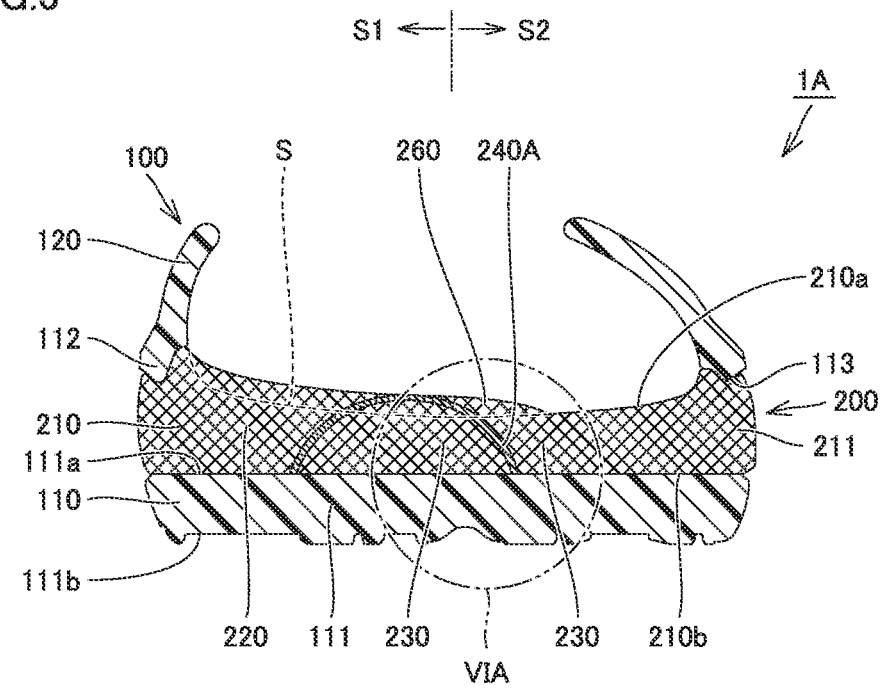
FIG. 5 is a schematic cross-sectional view taken along a line V-V shown in FIG. 3.
Figure 6A:
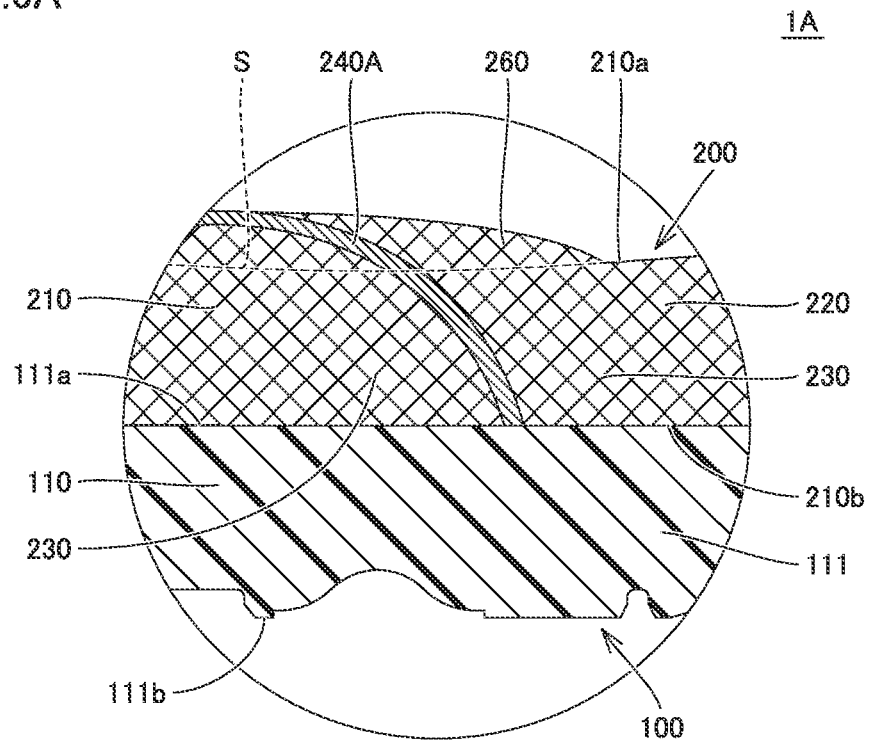
FIG. 6A is an enlarged view of a region VIA shown in FIG. 5.
Figure 6B:
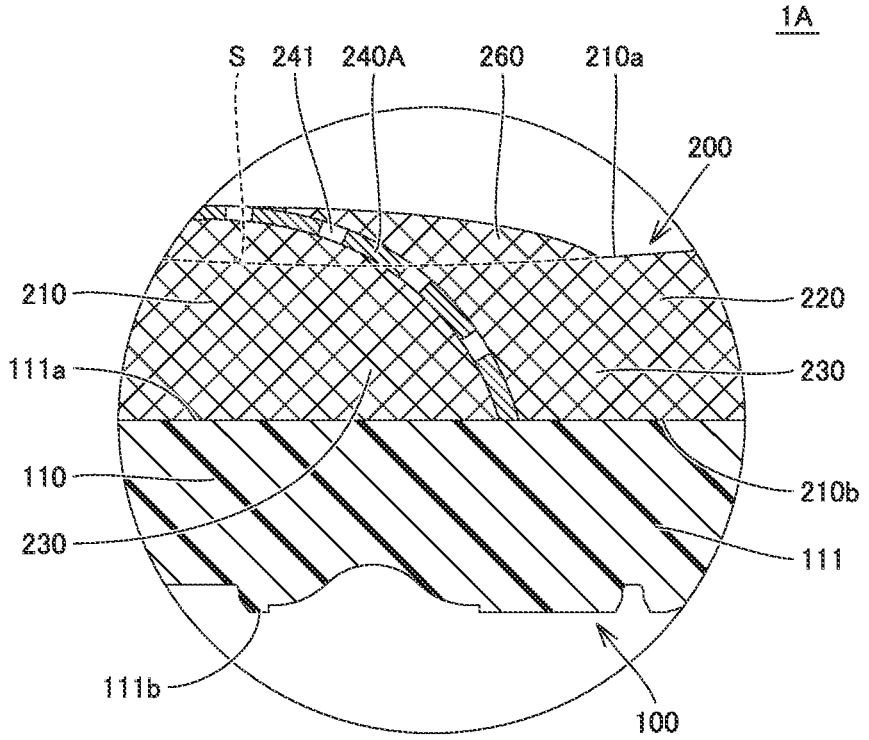
FIG. 6B is a schematic view illustrating a protruding plate portion having a configuration similar to the configuration shown in FIG. 6A.
Figure 7:
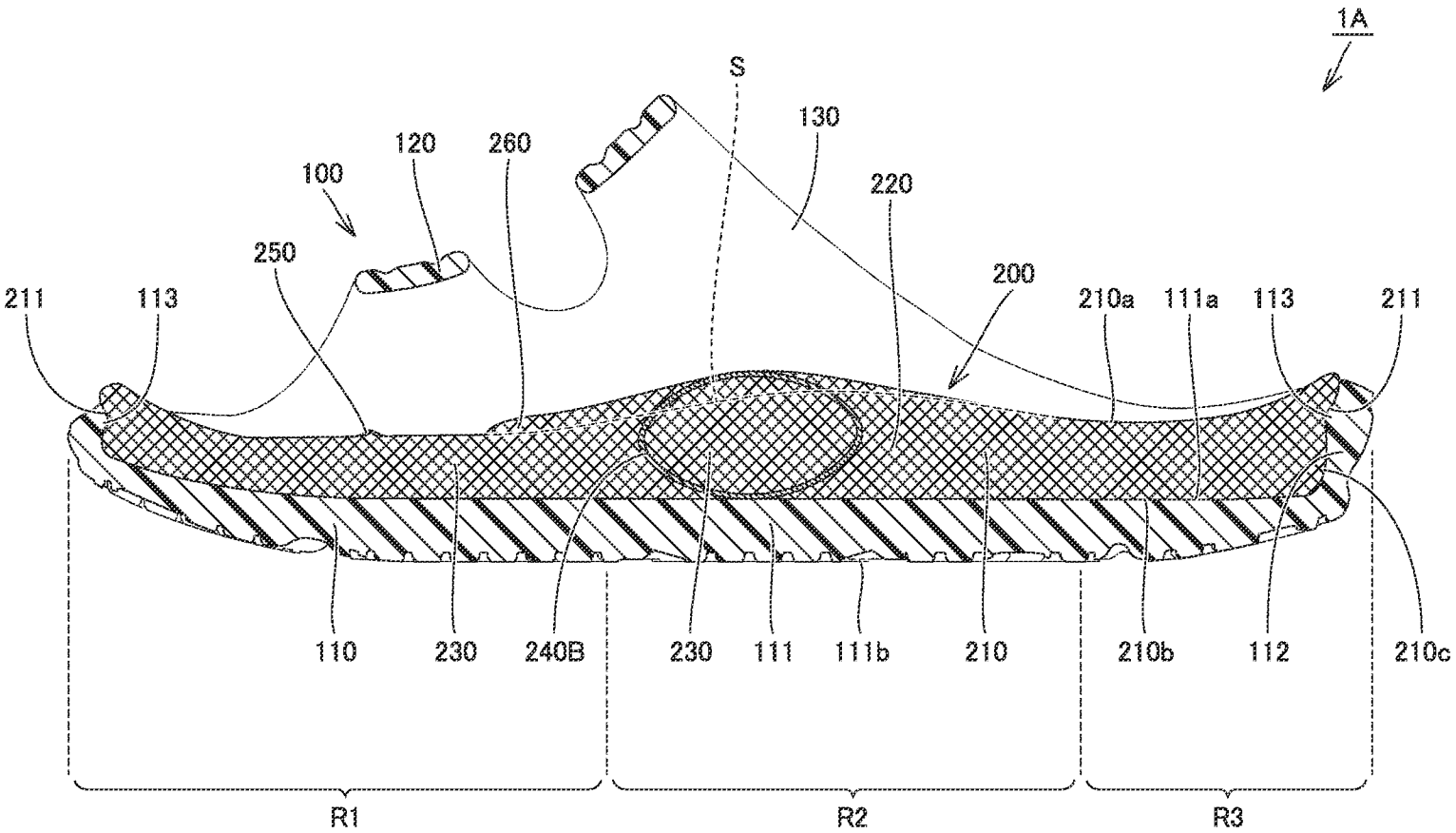
FIG. 7 is a schematic cross-sectional view taken along a line VII-VII shown in FIG. 3.
Figure 8:
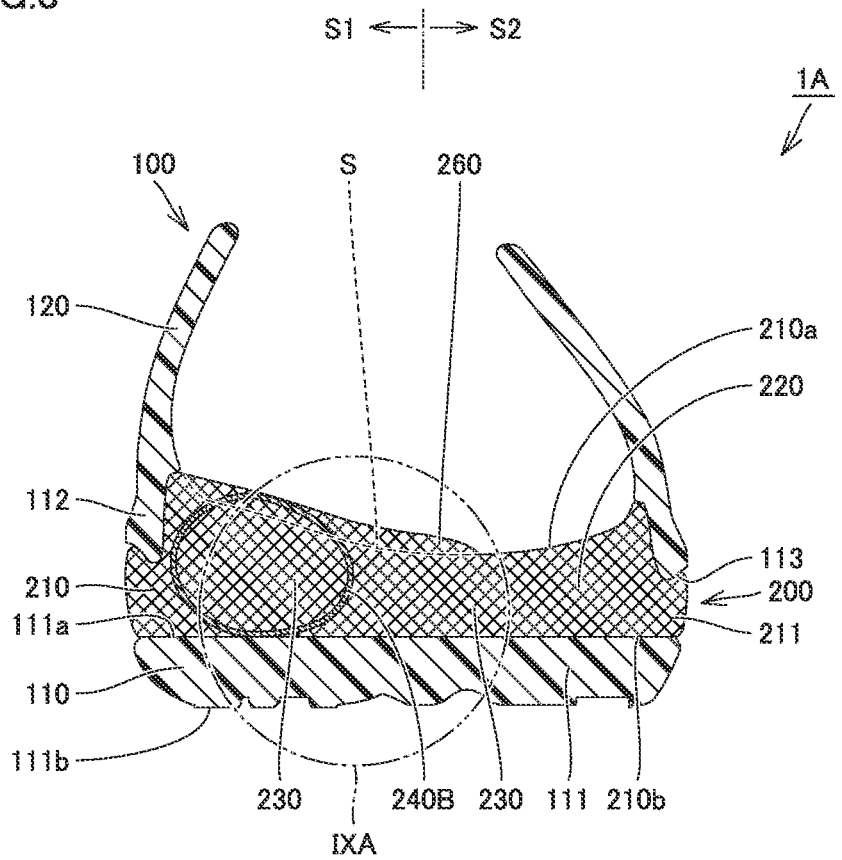
FIG. 8 is a schematic cross-sectional view taken along a line VIII-VIII shown in FIG. 3.
Figure 9A:
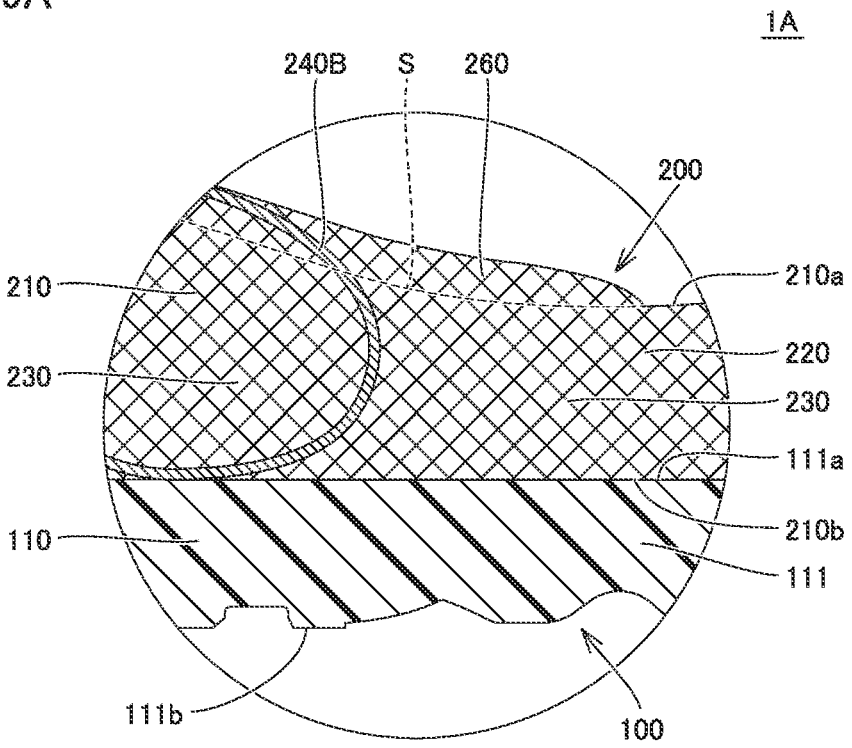
FIG. 9A is an enlarged view of a region IXA shown in FIG. 8.
Figure 9B:
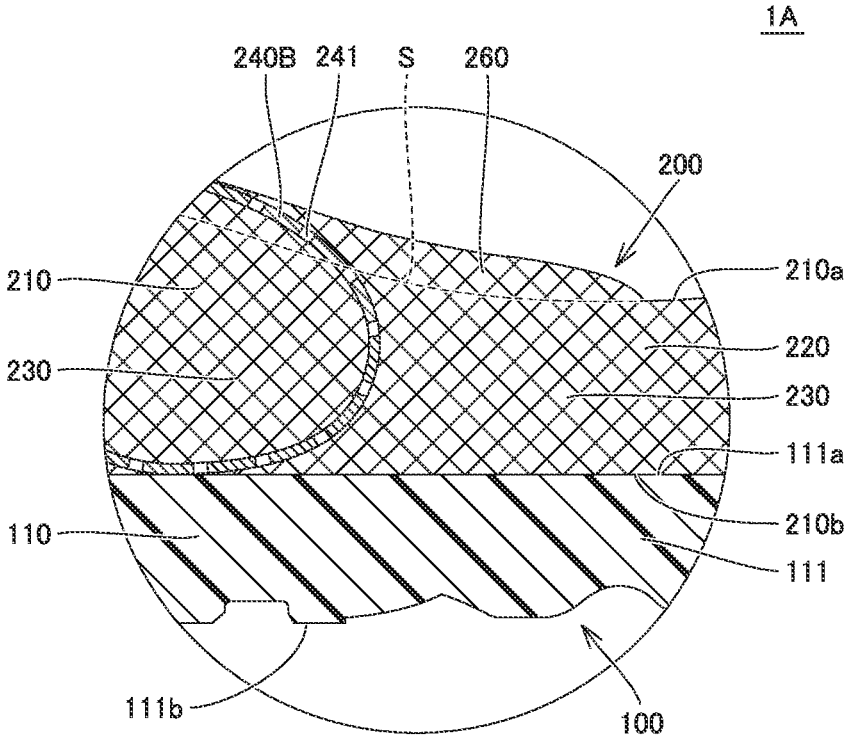
FIG. 9B is a schematic view illustrating a protruding plate portion having a configuration similar to the configuration shown in FIG. 9A.
Figure 10A:
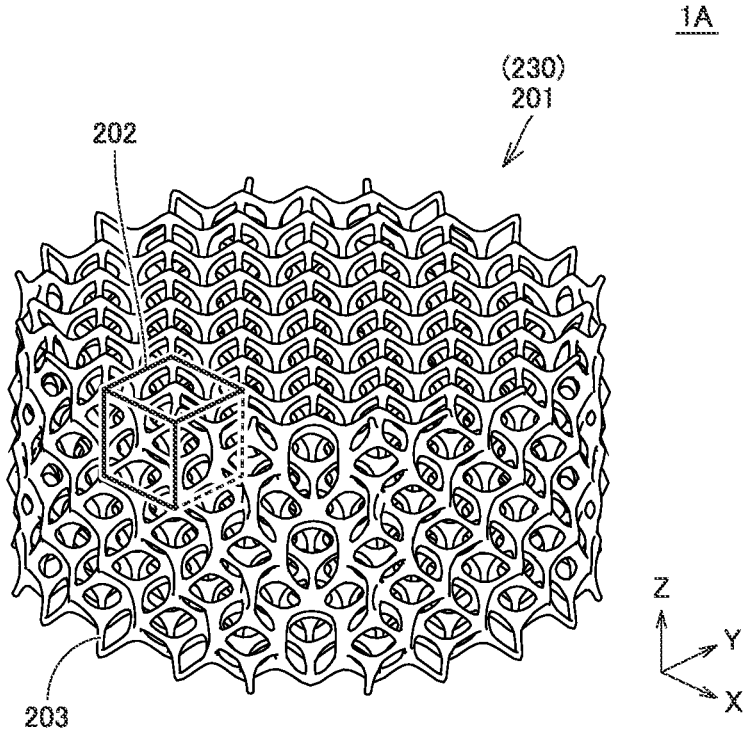
FIG. 10A is a schematic view illustrating a three-dimensional mesh structure portion included in a shock absorbing portion of a sole body of the footwear according to the first embodiment.
Figure 10B:
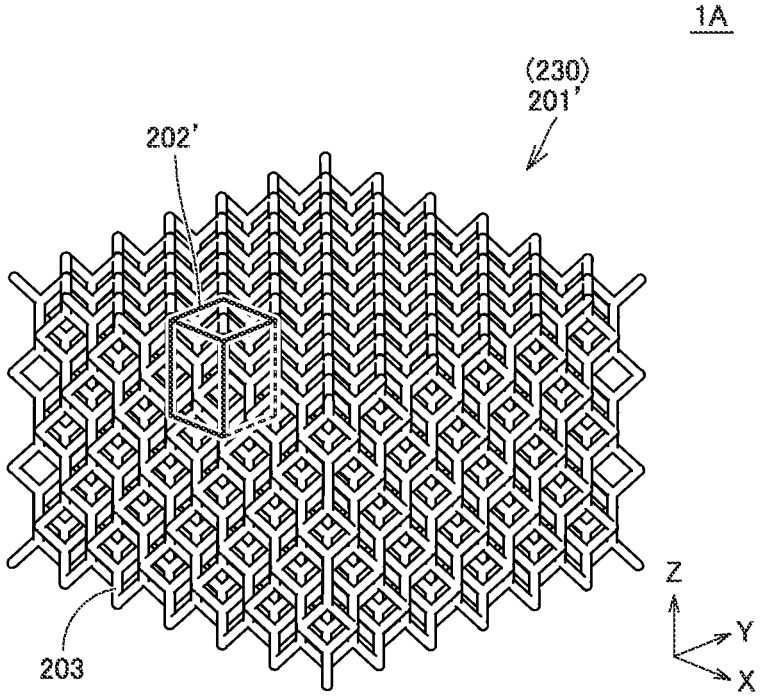
FIG. 10B is a schematic view illustrating a three-dimensional mesh structure portion having a configuration similar to the configuration shown in FIG. 10A.

FIGS. 4 and 5 are schematic cross-sectional views showing the footwear according to the present embodiment and taken along lines IV-IV and V-V, respectively, shown in FIG. 3. FIG. 6A is an enlarged view of a region VIA shown in FIG. 5, and FIG. 6B is a schematic view illustrating a protruding plate portion having a configuration similar to the configuration shown in FIG. 6A. FIGS. 7 and 8 are schematic cross-sectional views showing the footwear according to the present embodiment and taken along lines VII-VII and VIII-VIII, respectively, shown in FIG. 3. FIG. 9A is an enlarged view of a region IXA shown in FIG. 8, and FIG. 9B is a schematic view illustrating a protruding plate portion having a configuration similar to the configuration shown in FIG. 9A. In addition, FIG. 10A is a schematic view illustrating a three-dimensional mesh structure portion included in the shock absorbing portion of the sole body of the footwear according to the present embodiment, and FIG. 10B is a schematic view illustrating a three-dimensional mesh structure portion having a configuration similar to the configuration shown in FIG. 10A. Referring to FIGS. 4 to 10B and also FIG. 3 mentioned above, the following describes a detailed configuration of the shock absorbing portion 220 of the sole body 200 included in the footwear 1A according to the present embodiment.

As shown in FIGS. 3 to 9B, the shock absorbing portion 220 of the sole body 200 included in the footwear 1A according to the present embodiment includes the three-dimensional mesh structure portion 230 and the protruding plate portions 240A and 240B as irregularly shaped portions, as described above.

As shown in FIG. 10A, the three-dimensional mesh structure portion 230 is formed of a three-dimensional mesh structure body 201 in which a plurality of unit structures 202 each having a three-dimensional lattice structure are repeatedly arranged. More specifically, the plurality of unit structures 202 are repeatedly arranged regularly and continuously in each of a width direction (an X direction shown in the figure), a depth direction (a Y direction shown in the figure), and a height direction (a Z direction shown in the figure). In FIG. 10A, only some unit structures 202 adjacent to each other in the width direction, the depth direction, and the height direction are selectively shown.

The unit structure 202 having a three-dimensional lattice structure has a three-dimensional shape in which a plurality of columnar portions 203 extending in prescribed directions are connected to each other. The plurality of columnar portions 203 are configured such that each columnar portion 203 extends to intersect a columnar portion 203 adjacent thereto, to thereby form a three-dimensional lattice structure. The unit structure 202 shown in the figure is called a fluorite type lattice. The unit space occupied by the unit structure 202, which generally has a polyhedron shape, has a hexahedron shape in the figure.

In the three-dimensional mesh structure body 201 shown in FIG. 10A, each of the plurality of columnar portions 203 is configured to have a substantially circular cylindrical outer shape. Thus, each of the plurality of columnar portions 203 has a substantially circular cross section taken along a plane orthogonal to its extending direction. Further, in the three-dimensional mesh structure body 201 shown in the figure, each of the plurality of columnar portions 203 is configured to continuously change in thickness in an extending direction. Specifically, each columnar portion 203 is configured to be relatively thick in a connection portion at which it is connected to the columnar portion 203 adjacent thereto and also to be decreased in thickness away from this connection portion. The configuration as described above makes it possible to increase the durability while maintaining flexibility.

On the other hand, a three-dimensional mesh structure body 201' shown in FIG. 10B has a three-dimensional lattice structure having a configuration similar to the configuration shown in FIG. 10A. In this case, a unit structure 202' has a fluorite type lattice, and the unit space occupied by the unit structure 202' has a hexahedron shape. However, in the three-dimensional mesh structure body 201', each of the plurality of columnar portions 203 is configured to have a uniform thickness in its extending direction, unlike the structure shown in FIG. 10A. The three-dimensional mesh structure body 201' having the above-described configuration can be applied, in place of the three-dimensional mesh structure body 201 shown in FIG. 10A, to the three-dimensional mesh structure portion 230 of the shock absorbing portion 220 included in the footwear 1A according to the present embodiment.

Applicable examples of the unit structure 202 can be various structures other than the above, such as a rectangular parallelepiped lattice, a diamond lattice, an octahedral lattice, a double pyramid lattice, or a lattice having various supports added thereto.

Further, the unit structure 202 is not limited to the three-dimensional lattice structure as described above, and applicable examples of the unit structure 202 can be a three-dimensional wall structure having a three-dimensional shape in which a plurality of wall portions extending in prescribed directions are connected to each other, a structure having a three-dimensional shape in which hollow portions are regularly arranged therein, or the like.

Among them, applicable examples of the three-dimensional wall structure can be a structure having a three-dimensional shape formed by a wall having an outer shape defined by a pair of parallel curved surfaces. Specific examples applicable in this case can be, for example, a structure obtained by adding a thickness to a triply periodic minimal surface, such as a gyroid structure, a Schwartz P structure, or a Schwartz D structure as a base structure. In addition to the above structures, applicable examples of the three-dimensional wall structure can be a structure having a three-dimensional shape formed by a wall having an outer shape defined by a pair of parallel flat surfaces. Specific examples applicable in this case can be a structure obtained by adding a thickness to an octet structure, a cubic structure, or the like.

The above-described three-dimensional mesh structure portion 230 is disposed substantially evenly in the front-rear direction, the left-right direction, and the up-down direction of the foot bed portion 210. By the configuration as described above, the foot bed portion 210 almost entirely functions as the shock absorbing portion 220 as described above, which allows the sole body 200 to have high deformability. This makes it possible to implement footwear including a sole portion excellent in wearing comfort with excellent shock absorbing performance. Further, the configuration as described above makes it possible to implement lightweight footwear considering its size, and further, footwear excellent in air permeability in cooperation with the air holes 111*c* disposed in the outsole portion 110 of the shell 100.

In this case, the sole body 200 is preferably formed of an elastic body whose elastic modulus is 0.1 MPa or more and 100 MPa or less. In this way, when a load is applied to the foot bed portion 210 of the sole body 200 (i.e., when a foot lands or steps on the ground), the shock absorbing portion 220 exhibits high shock absorbing performance, and thereby, the foot pressure can be effectively dispersed.

On the other hand, as shown in FIGS. 3 to 9B, the protruding plate portions 240A and 240B provided as irregularly shaped portions are located inside the shock absorbing portion 220 in the state in which they are substantially completely embedded in the three-dimensional mesh structure portion 230 as described above.

As shown in FIGS. 3 to 6B, the protruding plate portion 240A is disposed in a region of the sole body 200 that supports a part of the foot sole that corresponds to a transverse arch of the wearer's foot. More specifically, the protruding plate portion 240A is located substantially in a central portion in the left-right direction in a region including the rear end of the forefoot portion R1 and the front end of the midfoot portion R2 so as to extend over the boundary between the forefoot portion R1 and the midfoot portion R2, and also is embedded in the three-dimensional mesh structure portion 230 as described above. Note that the region of the sole body 200 that supports a part of the foot sole that corresponds to the transverse arch of the wearer's foot is derived based on a standard wearer having a foot size corresponding to the size of the footwear 1A.

The protruding plate portion 240A has a shape different from that of the unit structure included in the three-dimensional mesh structure portion 230, and specifically, has a curved plate shape in which its central portion protrudes relative to its peripheral edge portion in the direction orthogonal to the ground contact surface 111*b*. In particular, in the footwear 1A according to the present embodiment, the protruding plate portion 240A has a substantially hemispherical shape having a space provided therein.

The protruding plate portion 240A is provided such that its peripheral portion is located closer to the ground contact surface 111*b* than its central portion. Thus, the protruding plate portion 240A has an upward protruding shape and is configured such that its upper end (the vertex of the central portion) extends to the supporting surface 210*a* of the foot bed portion 210 and its lower end (the end portion of the peripheral edge portion) extends to the supported surface 210*b* of the foot bed portion 210.

In this case, the three-dimensional mesh structure portion 230 is located not only in the space outside the portion provided with the protruding plate portion 240A, but also in the space provided inside the protruding plate portion 240A by providing the protruding plate portion 240A. In other words, in the present embodiment, the protruding plate portion 240A is substantially completely embedded in the three-dimensional mesh structure portion 230 as described above, and thus, the surface of the protruding plate portion 240A excluding its upper end (the vertex of the central portion) and its lower end (the end portion of the peripheral edge portion) is connected to the three-dimensional mesh structure portion 230, and thereby, covered by the three-dimensional mesh structure portion 230.

Thus, by providing the protruding plate portion 240A having an upward protruding shape in the region of the sole body 200 that supports a part of the foot sole that corresponds to the transverse arch of the wearer's foot, the compression rigidity of the shock absorbing portion 220 in the portion including the protruding plate portion 240A is significantly higher than the compression rigidity of the portion formed only of the three-dimensional mesh structure portion 230 where the protruding plate portion 240A is not provided. Therefore, by the configuration as described above, in the state in which an increase in weight is minimized, the compression rigidity of the region of the sole body 200 that supports the part of the foot sole that corresponds to the transverse arch of the wearer's foot can be locally increased while maintaining the deformability around this region, with the result that the function of supporting the transverse arch of the wearer's foot can be achieved.

The protruding plate portion 240A shown in FIG. 6A does not include a hole portion, but the protruding plate portion 240A can include a hole portion 241 penetrating therethrough in its thickness direction as shown in FIG. 6B. In the case where the protruding plate portion 240A includes the hole portion 241 in this way, the unhardened liquid resin or the like is easily discharged to the outside through the hole portion 241 in the washing step during additive manufacturing of the sole body 200 by the vat polymerization-type three-dimensional additive manufacturing method. This makes it possible to reduce the possibility that the unhardened liquid resin can remain inside the sole body 200 during the subsequent heat treatment, which consequently contributes to improvement in accuracy of additive manufacturing. Note that a plurality of the hole portions 241 can be provided as shown in the figure, or only one hole portion 241 can be provided.

As shown in FIGS. 3 and 7 to 9B, the protruding plate portion 240B is disposed in a region of the sole body 200 that supports a part of the foot sole that corresponds to a medial longitudinal arch of the wearer's foot. More specifically, the protruding plate portion 240B is located in a region included in the midfoot portion R2 on the medial foot side in the left-right direction and embedded in the three-dimensional mesh structure portion 230 as described above. Note that a region of the sole body 200 that supports a part of the foot sole that corresponds to the medial longitudinal arch of the wearer's foot is derived based on a standard wearer having a foot size corresponding to the size of the footwear 1A.

The protruding plate portion 240B has a shape different from that of the unit structure of the three-dimensional mesh structure portion 230, and specifically, has a curved plate shape in which its central portion protrudes relative to its peripheral edge portion in the direction orthogonal to the ground contact surface 111*b*. In particular, in the footwear 1A according to the present embodiment, the protruding plate portion 240B has a substantially spherical shape having a space provided therein.

The protruding plate portion 240B is provided such that, in the top side portion, the peripheral portion is located closer to the ground contact surface 111*b* than the central portion and, in the bottom side portion, the central portion is located closer to the ground contact surface 111*b* than the peripheral portion. Thus, the protruding plate portion 240B has a shape protruding upward and downward, and is configured such that its upper end (the vertex of the central portion in the top side portion) extends to the supporting surface 210*a* of the foot bed portion 210 and its lower end (the vertex of the central portion in the bottom side portion) extends to the supported surface 210*b* of the foot bed portion 210.

In this case, the three-dimensional mesh structure portion 230 is located not only in the space outside the portion including the protruding plate portion 240B, but also in the space disposed inside the protruding plate portion 240B by providing the protruding plate portion 240B. In other words, in the present embodiment, the protruding plate portion 240B is substantially completely embedded in the three-dimensional mesh structure portion 230 as described above, and thus, the surface of the protruding plate portion 240B excluding its upper end (the vertex of the central portion in the top side portion) and its lower end (the vertex of the central portion in the bottom side portion) is connected to the three-dimensional mesh structure portion 230, and thereby, covered by the three-dimensional mesh structure portion 230.

In this way, by providing the protruding plate portion 240B having a shape protruding upward and downward in the region of the sole body 200 that supports the part of the foot sole that corresponds to the medial longitudinal arch of the wearer's foot, the compression rigidity of the shock absorbing portion 220 in the portion including the protruding plate portion 240B is significantly higher than the compression rigidity of the portion formed only of the three-dimensional mesh structure portion 230 where the protruding plate portion 240B is not provided. Therefore, by the configuration as described above, in the state in which an increase in weight is minimized, the compression rigidity of the region of the sole body 200 that supports the part of the foot sole that corresponds to the medial longitudinal arch of the wearer's foot can be locally increased while maintaining the deformability around this region, with the result that the function of supporting the medial longitudinal arch of the wearer's foot can be achieved.

The protruding plate portion 240B shown in FIG. 9A does not include a hole portion, but the protruding plate portion 240B can include a hole portion 241 penetrating therethrough in its thickness direction as shown in FIG. 9B. In the case where the protruding plate portion 240B includes the hole portion 241 in this way, the unhardened liquid resin or the like is easily discharged to the outside through the hole portion 241 in the washing step during additive manufacturing of the sole body 200 by the vat polymerization-type three-dimensional additive manufacturing method. This makes it possible to reduce the possibility that the unhardened liquid resin can remain inside the sole body 200 during the subsequent heat treatment, which consequently contributes to improvement in accuracy of additive manufacturing. Note that a plurality of the hole portions 241 can be disposed as shown in the figure, or only one hole portion 241 can be provided.

As described above, the footwear 1A according to the present embodiment has a configuration in which the protruding plate portions 240A and 240B are provided in the regions of the sole body 200 that support the parts of the foot sole that correspond to the transverse arch and the medial longitudinal arch, respectively, of the wearer's foot. This enables high deformability to be provided in the sole portion formed of the outsole portion 110 of the shell 100 and the foot bed portion 210 of the sole body 200, and also readily enables the deformability to be significantly different in each part. Therefore, the footwear 1A having the above-described configuration makes it possible to implement footwear that is excellent in achieving functions of dispersing foot pressure for fatigue recovery, supporting a foot arch, and the like.

In this case, in the footwear 1A according to the present embodiment, as shown in FIGS. 4 to 9B, assuming that the supporting surface 210*a* of the foot bed portion 210 that is the upper surface of the shock absorbing portion 220 in the portion including each of the protruding plate portions 240A and 240B and the portion adjacent thereto is defined as a first region and the supporting surface 210*a* in a region around the first region is defined as a second region, the first region protrudes upward relative to the second region, so that the protruding portion 260 is provided in the foot bed portion 210. In other words, a broken line in each of the figures indicates a reference surface S of the supporting surface 210*a* of the foot bed portion 210 that is derived based on a standard wearer having a foot size corresponding to the size of the footwear 1A. In this case, the supporting surface 210*a* of the foot bed portion 210 in the region including the portion including each of the protruding plate portions 240A and 240B and the portion adjacent thereto (i.e., the supporting surface 210*a* in the portion provided with the protruding portion 260) protrudes upward relative to the reference surface S.

By the configuration as described above, the thickness of the portion including each of the protruding plate portions 240A and 240B can be increased relative to the thickness of the sole body 200, and thereby, the protruding plate portions 240A and 240B can be larger in the up-down direction, so that the above-described function of supporting the foot arch can be significantly enhanced.

Further, the part of the three-dimensional mesh structure portion 230 that is connected to each of the protruding plate portions 240A and 240B (i.e., the above-mentioned columnar portion 203 in the present embodiment (see FIGS. 10A and 10B)) can be thicker than each of other parts of the three-dimensional mesh structure portion 230.

In the configuration as described above, the part of the three-dimensional mesh structure portion 230 that is connected to each of the protruding plate portions 240A and 240B is reinforced compared to other parts of the three-dimensional mesh structure portion 230, which makes it possible to implement the footwear 1A having excellent durability.

In addition, in the footwear 1A according to the present embodiment, as shown in FIGS. 1 to 4 and FIG. 7, the 250 is disposed in a region supporting a part of the foot sole that corresponds to the portion between a toe portion and a ball portion of the wearer's foot on the supporting surface 210*a* of the foot bed portion 210 that is the upper surface of the shock absorbing portion 220. More specifically, the protrusion 250 is an irregularly shaped portion different from the unit structure of the three-dimensional mesh structure portion 230, extends in the left-right direction, and also is partially branched and extends in the front-rear direction.

In the case where the protrusion 250 having the shape as described above is provided on the supporting surface 210*a* of the foot bed portion 210, the protrusion 250 is to be inserted between the toe portion and the ball portion of the foot of the wearer wearing the footwear, and this protrusion 250 is fitted and caught in the protrusions and recesses of the wearer's foot during walking or the like, which makes it possible for the wearer to smoothly walk.

The above-described protrusion 250 can be integral with the foot bed portion 210 when the sole body 200 is additively manufactured by the three-dimensional additive manufacturing method, or can be attached as a separate member to the sole body 200 by adhesion, welding, or the like after the sole body 200 is additively manufactured.

The shape of the protrusion 250 is not limited to the shape as described above but can be variously modified. For example, the 250 can have only a portion extending in the left-right direction, or, according to the number of gap spaces between the wearer's toes, can have four portions branched from the portion that extends in the left-right direction and then extends in the front-rear direction.

In addition, the protrusion 250 does not necessarily have to be formed as an irregularly shaped portion different from the unit structure of the three-dimensional mesh structure portion 230, but a portion protruded by extending a part of the three-dimensional mesh structure portion 230 can be disposed in the supporting surface 210*a* of the foot bed portion 210 so as to be the protrusion 250.

In the illustrative description about the footwear 1A according to the present embodiment, the protruding plate portion 240A has a substantially hemispherical shape having a space provided therein and the protruding plate portion 240B has a substantially spherical shape having a space provided therein. However, the protruding plate portion 240A can have a substantially spherical shape having a space provided therein, and the protruding plate portion 240B can have a substantially hemispherical shape having a space provided therein, or the protruding plate portions 240A and 240B each can have a substantially hemispherical shape having a space provided therein, or the protruding plate portions 240A and 240B each can have a substantially spherical shape having a space provided therein.

First Modification

Figure 11:
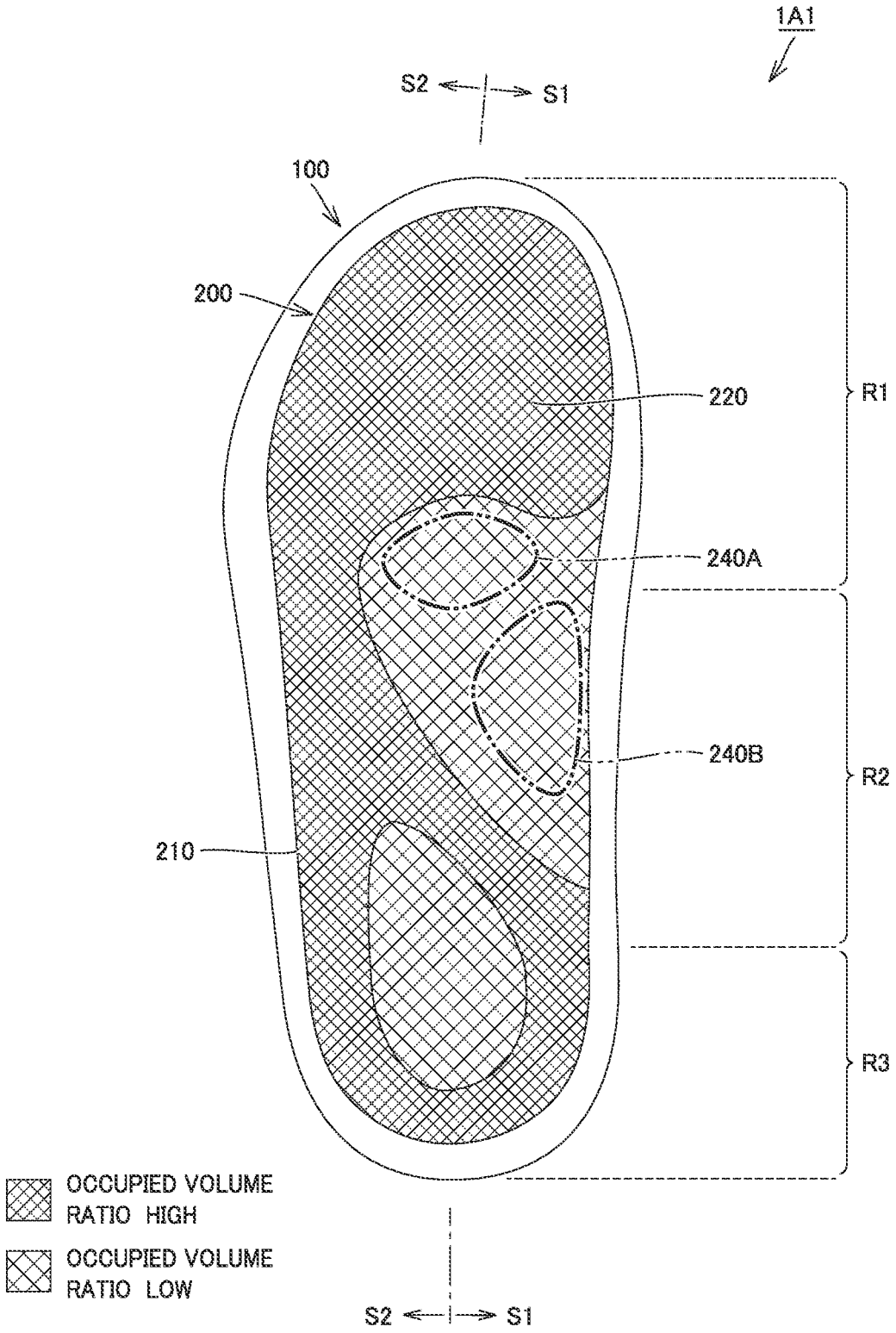
FIG. 11 is a schematic view showing an occupied volume ratio in each part of a shock absorbing portion included in a sole body of footwear according to a first modification.

FIG. 11 is a schematic view showing an occupied volume ratio in each part of a shock absorbing portion included in a sole body of footwear according to the first modification. Referring to FIG. 11, footwear 1A1 according to the first modification based on the above-described first embodiment will be described below.

As shown in FIG. 11, in the footwear 1A1 according to the first modification, similarly to the footwear 1A according to the above-described first embodiment, the shock absorbing portion 220 is provided almost entirely in the foot bed portion 210 provided in the sole body 200, and the shock absorbing portion 220 includes the three-dimensional mesh structure portion 230 (see FIG. 4 and the like) and the protruding plate portions 240A and 240B. In this case, the occupied volume ratio in each part of the three-dimensional mesh structure portion 230 is given in a prescribed distribution (in the footwear 1A according to the above-described first embodiment, the occupied volume ratio of the three-dimensional mesh structure portion 230 is substantially uniform throughout the shock absorbing portion 220). In this case, the occupied volume ratio indicates the ratio of the volume of a solid portion (i.e., a portion that is not hollow) of the three-dimensional mesh structure portion 230 per unit volume, and the unit volume is calculated, for example, based on 1 $cm^3$.

Specifically, in the footwear 1A1, the occupied volume ratio of the three-dimensional mesh structure portion 230 in the portion including each of the protruding plate portions 240A and 240B and the portion adjacent thereto is set to be lower than that around these portions. More strictly, in the region of the three-dimensional mesh structure portion 230 that is located outside the protruding plate portions 240A and 240B in the direction parallel to the ground contact surface 111*b*, the occupied volume ratio of the three-dimensional mesh structure portion 230 in the portion adjacent to each of the protruding plate portions 240A and 240B is set to be locally low.

In the configuration as described above, the deformability is further enhanced in the region around the portion including each of the protruding plate portions 240A and 240B (i.e., a region of the sole body 200 that supports the part of the foot sole that corresponds to each of the transverse arch and the medial longitudinal arch of the wearer's foot). This enables a more obvious difference between the compression rigidity of the portions including the protruding plate portions 240A and 240B and the compression rigidity of the region around these portions (i.e., the hardness of the portions including the protruding plate portions 240A and 240B can be significantly increased compared to that in the surrounding area), with the result that the above-described function of supporting the foot arch can be significantly enhanced.

More preferably, in a region of the three-dimensional mesh structure portion 230 that is located outside the protruding plate portions 240A and 240B in the direction parallel to the ground contact surface 111*b*, the three-dimensional mesh structure portion 230 is configured such that its occupied volume ratio gradually increases away from each of the protruding plate portions 240A and 240B. In the configuration as described above, the deformability does not extremely change in the region around the portion including each of the protruding plate portions 240A and 240B, which makes it possible to implement footwear that is excellent in wearing comfort and less uncomfortable during wearing of the footwear.

As a method of forming the shock absorbing portion 220 so as to have different occupied volume ratios in each part, for example, it is conceivable to change the size of the unit structure in each part of the shock absorbing portion 220, to change the thickness of the above-described columnar portion 203 (see FIGS. 10A and 10B) included in the unit structure in each part of the shock absorbing portion 220, or to change the structure of the unit structure in each part of the shock absorbing portion 220.

Second Modification

Figure 12A:
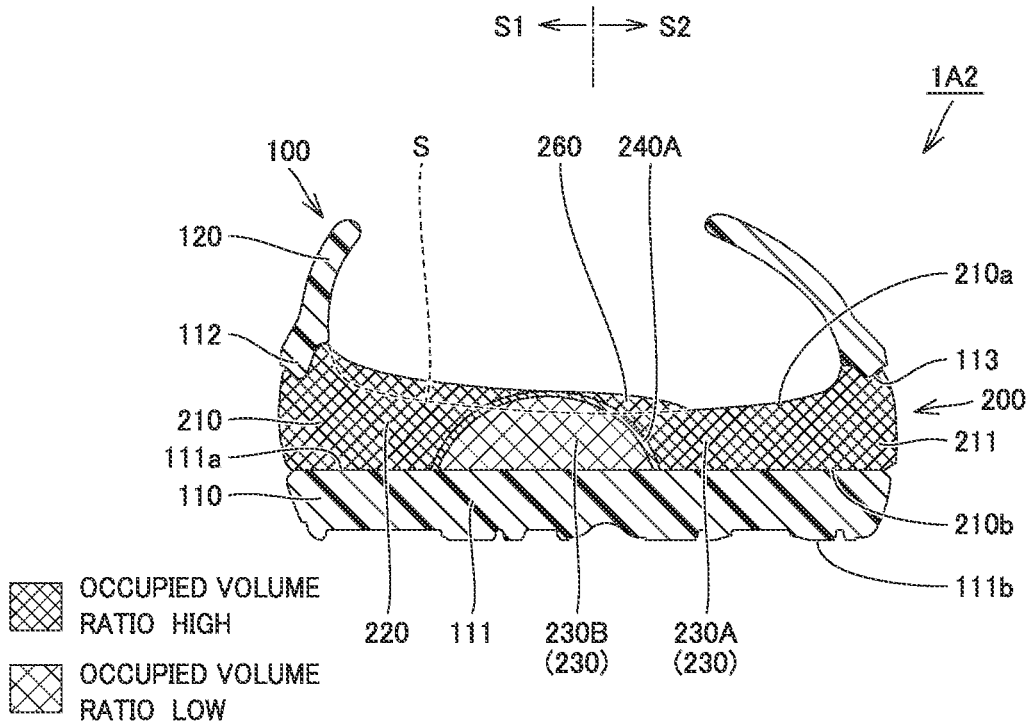
FIGS. 12A and 12B each are a schematic cross-sectional view of footwear according to a second modification.
Figure 12B:
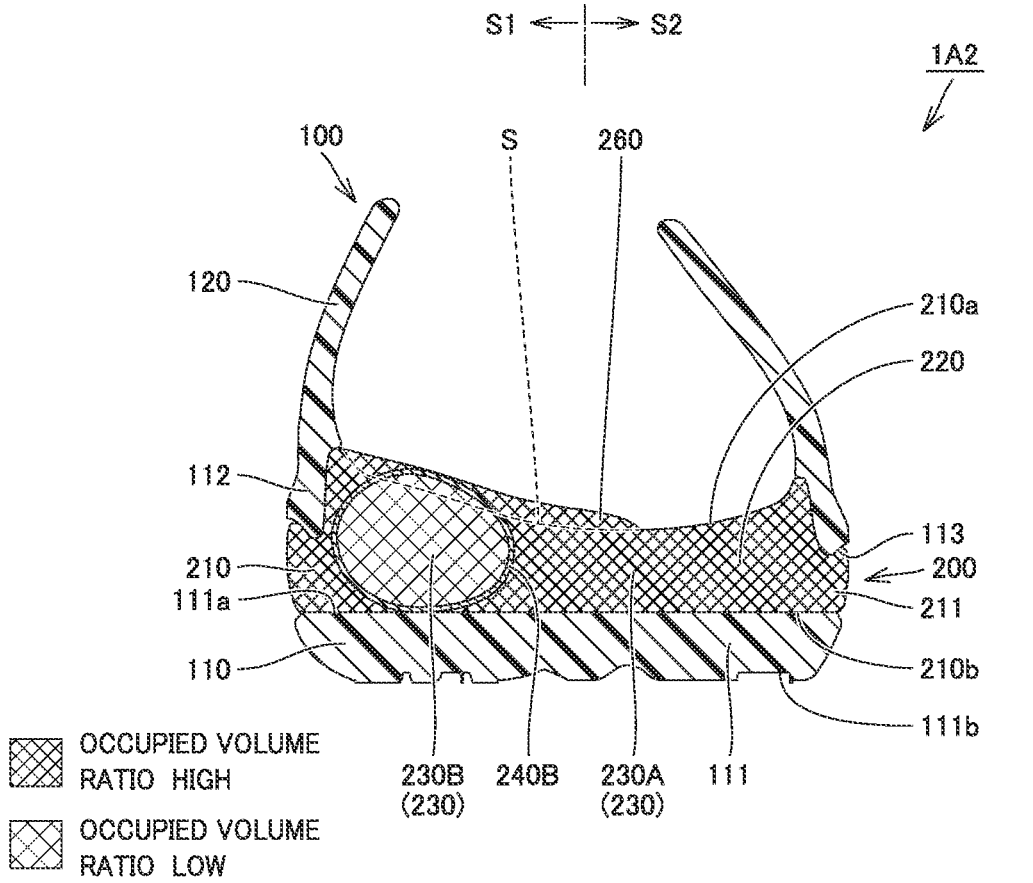

FIG. 12A is a cross-sectional view of footwear according to the second modification including the shock absorbing portion 220 in a portion provided with the above-described protruding plate portion 240A. FIG. 12B is a cross-sectional view of the footwear according to the second modification including the shock absorbing portion 220 in a portion including the above-described protruding plate portion 240B. Referring to FIGS. 12A and 12B, footwear 1A2 according to the second modification based on the above-described first embodiment will be described below.

As shown in FIGS. 12A and 12B, in the footwear 1A2 according to the second modification, similarly to the footwear 1A according to the above-described first embodiment, the shock absorbing portion 220 is provided almost entirely in the foot bed portion 210 in the sole body 200, and the shock absorbing portion 220 includes the three-dimensional mesh structure portion 230 and the protruding plate portions 240A and 240B, but the occupied volume ratio of the three-dimensional mesh structure portion 230 is different in each part.

More specifically, in the footwear 1A2, the occupied volume ratio of the three-dimensional mesh structure portion 230 is different between a portion located outside the protruding plate portions 240A and 240B in the direction parallel to the ground contact surface 111*b* and a portion located inside the protruding plate portions 240A and 240B in the direction parallel to the ground contact surface 111*b*.

In the footwear 1A2 according to the present embodiment, specifically, the occupied volume ratio of the three-dimensional mesh structure portion 230 disposed in the space outside the portion including each of the protruding plate portions 240A and 240B is relatively high while the occupied volume ratio of the three-dimensional mesh structure portion 230 disposed in the space inside the portion provided with each of the protruding plate portions 240A and 240B is relatively low. In other words, the occupied volume ratio of the three-dimensional mesh structure portion 230 is different between the inside and the outside of each of the protruding plate portions 240A and 240B, and the deformability of the three-dimensional mesh structure portion 230 disposed in the space inside each of the protruding plate portions 240A and 240B is further enhanced.

In the configuration as described above, when a load is applied to the foot bed portion 210, an excessive increase in compression rigidity caused by the protruding plate portions 240A and 240B can be suppressed, and the above-described upward protruding shapes of the protruding plate portions 240A and 240B can be maintained, which makes it possible to maintain the function of supporting the foot arch while still preventing the wearer from feeling significantly uncomfortable.

In contrast, if necessary, the occupied volume ratio of the three-dimensional mesh structure portion 230 disposed in the space outside the portion including each of the protruding plate portions 240A and 240B can be relatively low, and the occupied volume ratio of the three-dimensional mesh structure portion 230 disposed in the space inside the portion including each of the protruding plate portions 240A and 240B can be relatively high.

Further, apart from the configuration in which the occupied volume ratio of the three-dimensional mesh structure portion 230 is different between the inside and the outside of each of the protruding plate portions 240A and 240B, the unit structure of the three-dimensional mesh structure portion 230 can be different between the inside and the outside of each of the protruding plate portions 240A and 240B, if necessary. More specifically, the unit structure of the three-dimensional mesh structure portion 230 can be different between the portion located outside each of the protruding plate portions 240A and 240B in the direction parallel to the ground contact surface 111*b* and the portion located inside each of the protruding plate portions 240A and 240B in the direction parallel to the ground contact surface 111*b*.

In the configuration as described above, the shock absorbing performance, the resilience performance, and the like can be different between the portion including each of the protruding plate portions 240A and 240B in the shock absorbing portion 220 and other portions in the shock absorbing portion 220, so that the degree of freedom of design is significantly increased.

Third Modification

Figure 13A:
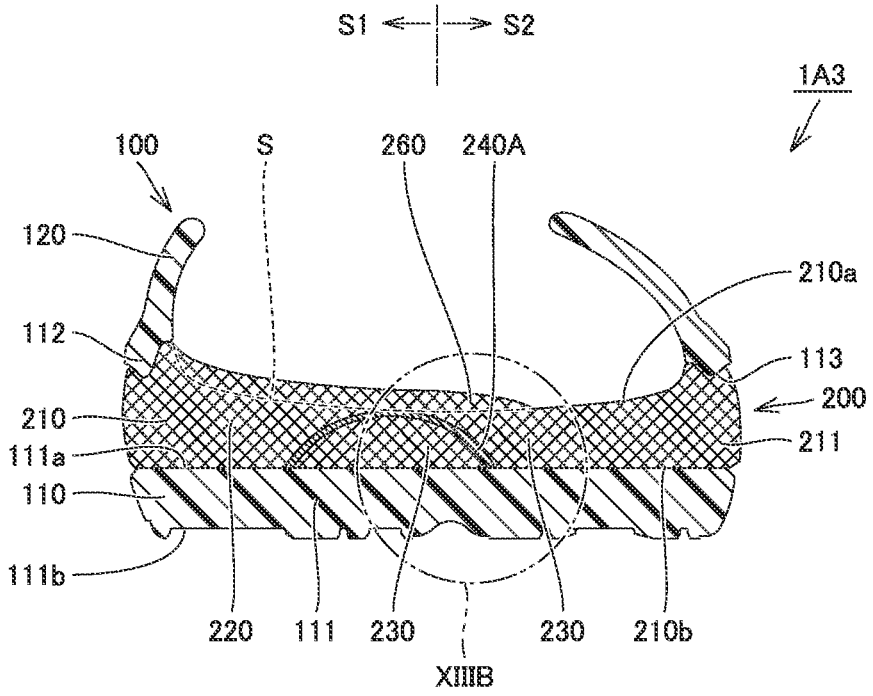
FIG. 13A is a schematic cross-sectional view of footwear according to a third modification.
Figure 13B:
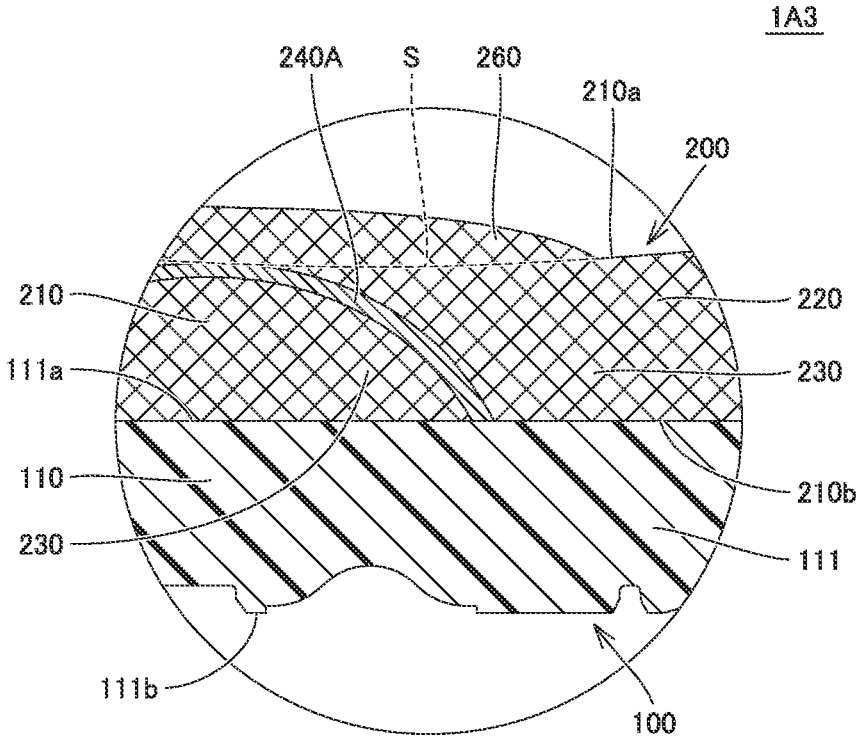
FIG. 13B is an enlarged view of a region XIIIB shown in FIG. 13A.

FIG. 13A is a schematic cross-sectional view of footwear according to the third modification, and FIG. 13B is an enlarged view of a region XIIIB shown in FIG. 13A. Referring to FIGS. 13A and 13B, footwear 1A3 according to the third modification based on the above-described first embodiment will be described below.

As shown in FIGS. 13A and 13B, similarly to the footwear 1A according to the above-described first embodiment, in the footwear 1A3 according to the third modification, the shock absorbing portion 220 is provided almost entirely in the foot bed portion 210 in the sole body 200, and the shock absorbing portion 220 includes the three-dimensional mesh structure portion 230 and the protruding plate portions 240A and 240B. In this case, the protruding plate portion 240A is more substantially completely embedded in the three-dimensional mesh structure portion 230.

Specifically, in the footwear 1A3, the lower end (the end portion of the peripheral edge portion) of the protruding plate portion 240A extends to the supported surface 210*b* of the foot bed portion 210 while the upper end (the vertex of the central portion) of the protruding plate portion 240A does not extend to the supporting surface 210*a* of the foot bed portion 210, and the upper surface of the protruding plate portion 240A is completely covered by the three-dimensional mesh structure portion 230.

In the configuration described above, the three-dimensional mesh structure portion 230 having a prescribed thickness and excellent deformability is located above the protruding plate portion 240A having relatively high compression rigidity. Thus, at the early stage of the foot landing action, the portion of the three-dimensional mesh structure portion 230 that is located above the protruding plate portion 240A is easily deformed to thereby enable an improved feel of contact for the wearer's foot. Also, at the end stage of the foot landing action, the function of supporting a foot arch is reliably exerted. This makes it possible to implement footwear by which both the wearing comfort and the function of supporting the foot arch can be achieved.

In the above illustrative description about the present modification, only the protruding plate portion 240A is more substantially completely embedded in the three-dimensional mesh structure portion 230, but only the protruding plate portion 240B can be more substantially completely embedded in the three-dimensional mesh structure portion 230, or both the protruding plate portions 240A and 240B can be more substantially completely embedded in the three-dimensional mesh structure portion 230.

Fourth Modification

Figure 14A:
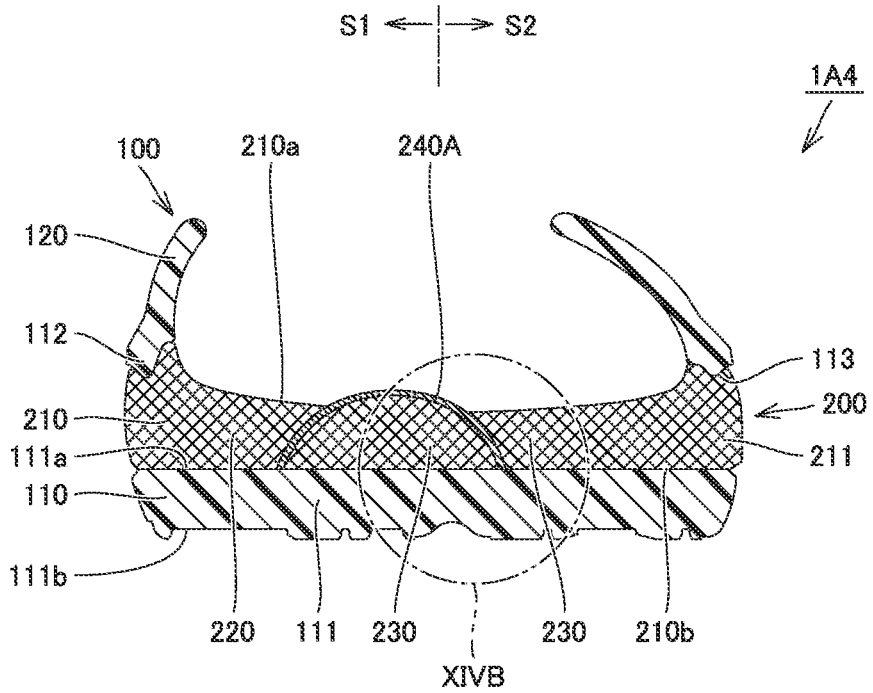
FIG. 14A is a schematic cross-sectional view of footwear according to a fourth modification.
Figure 14B:
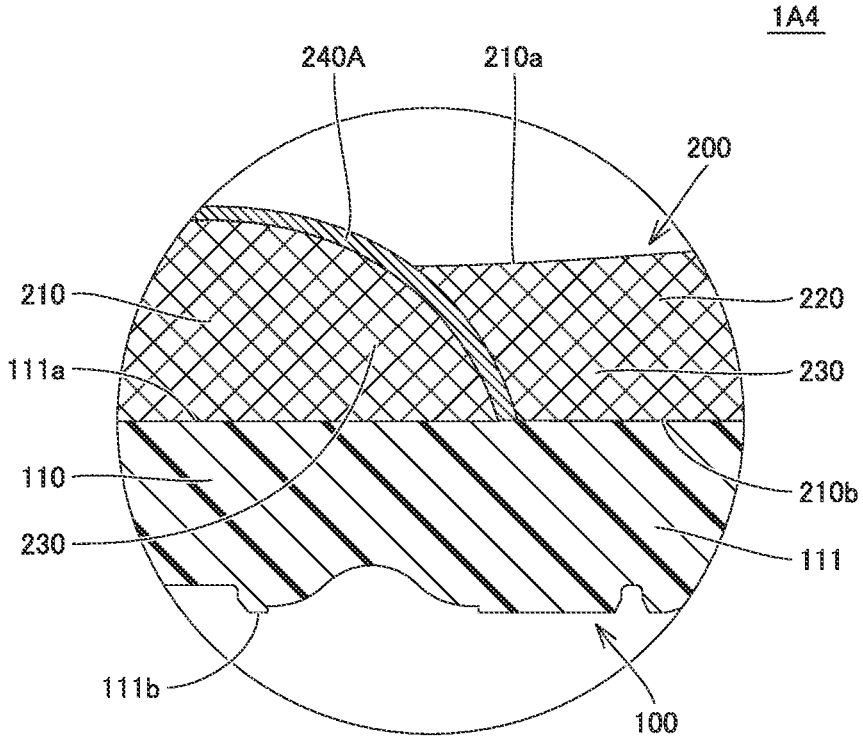
FIG. 14B is an enlarged view of a region XIVB shown in FIG. 14A.

FIG. 14A is a schematic cross-sectional view of footwear according to the fourth modification, and FIG. 14B is an enlarged view of a region XIVB shown in FIG. 14A. Referring to FIGS. 14A and 14B, footwear 1A4 according to the fourth modification based on the above-described first embodiment will be described below.

As shown in FIGS. 14A and 14B, in the footwear 1A4 according to the fourth modification, similarly to the footwear 1A according to the above-described first embodiment, the shock absorbing portion 220 is provided almost entirely in the foot bed portion 210 in the sole body 200, and the shock absorbing portion 220 includes the three-dimensional mesh structure portion 230 and the protruding plate portions 240A and 240B. In this case, a part of the protruding plate portion 240A protrudes upward from the supporting surface 210*a* of the foot bed portion 210.

Specifically, in the footwear 1A4, the lower end side portion (i.e., the peripheral edge portion) of the protruding plate portion 240A is embedded in the three-dimensional mesh structure portion 230, whereas the upper end side portion (i.e., the central portion) of the protruding plate portion 240A protrudes upward from the three-dimensional mesh structure portion 230. Thereby, the lower surface of the protruding plate portion 240A and the lower end side portion of the upper surface of the protruding plate portion 240A are completely covered by the three-dimensional mesh structure portion 230, whereas the upper end side portion of the upper surface of the protruding plate portion 240A is exposed to the outside.

In the configuration as described above, the protruding plate portion 240A having relatively high compression rigidity protrudes upward from the supporting surface 210*a* of the foot bed portion 210, and thereby, the function of supporting the foot arch can be further dramatically enhanced by this protruding portion of the protruding plate portion 240A.

In the above illustrative description about the present modification, only the protruding plate portion 240A protrudes upward from the supporting surface 210*a* of the foot bed portion 210, but only the protruding plate portion 240B can protrude upward from the supporting surface 210*a* of the foot bed portion 210, or both the protruding plate portions 240A and 240B can protrude upward from the supporting surface 210*a* of the foot bed portion 210.

Fifth Modification

Figure 15A:
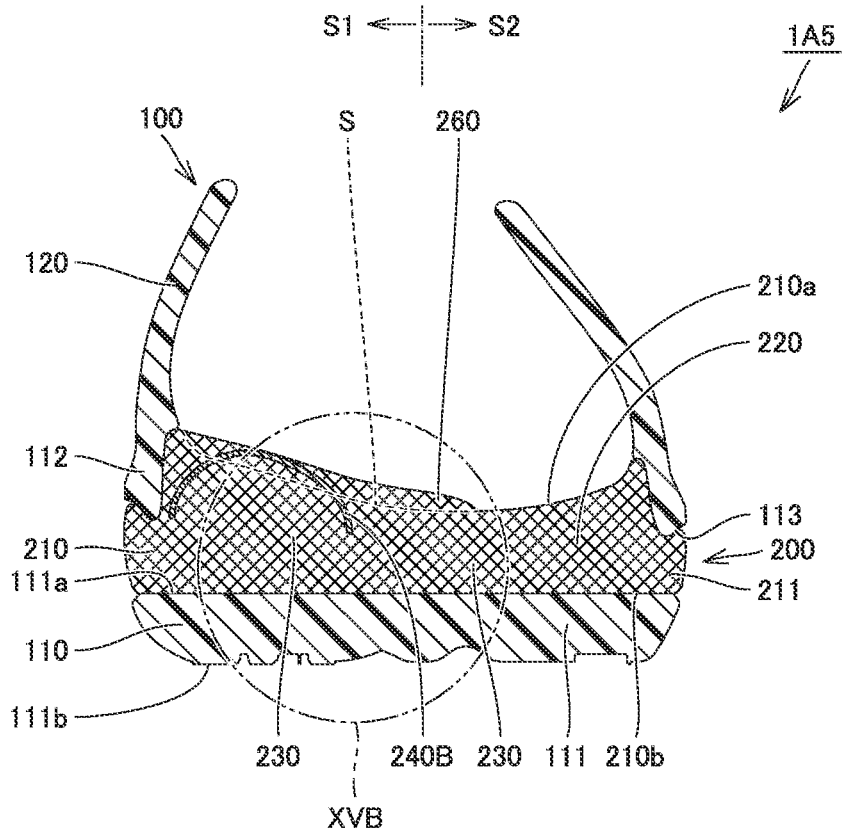
FIG. 15A is a schematic cross-sectional view of footwear according to a fifth modification.
Figure 15B:
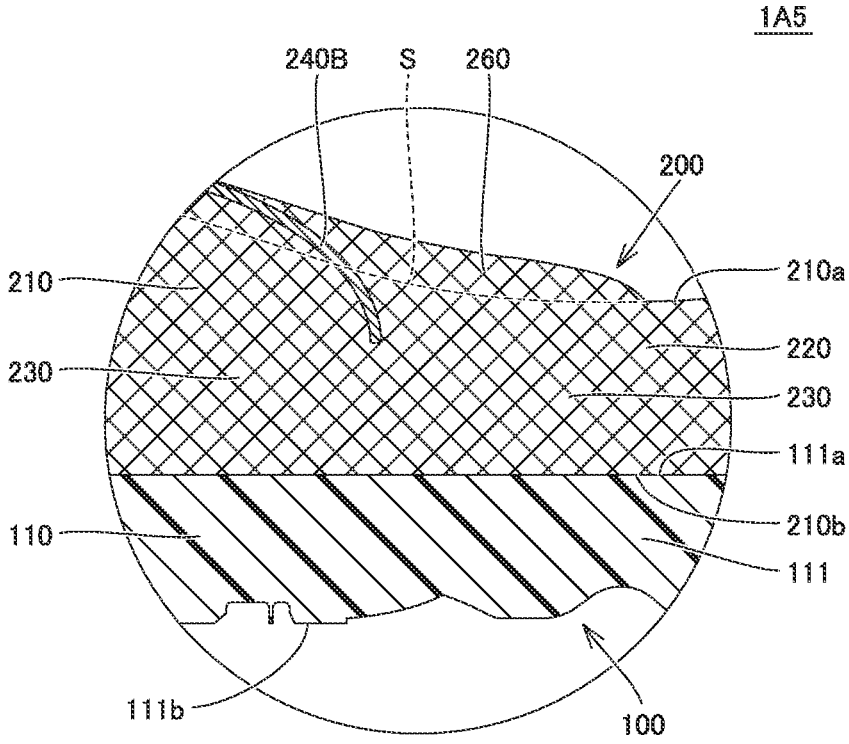
FIG. 15B is an enlarged view of a region XVB shown in FIG. 15A.

FIG. 15A is a schematic cross-sectional view of footwear according to the fifth modification, and FIG. 15B is an enlarged view of a region XVB shown in FIG. 15A. Referring to FIGS. 15A and 15B, footwear 1A5 according to the fifth modification based on the above-described first embodiment will be described below.

As shown in FIGS. 15A and 15B, in the footwear 1A5 according to the fifth modification, similarly to the footwear 1A according to the above-described first embodiment, the shock absorbing portion 220 is provided almost entirely in the foot bed portion 210 in the sole body 200, and the shock absorbing portion 220 includes the three-dimensional mesh structure portion 230 and the protruding plate portions 240A and 240B. In this case, the protruding plate portion 240B has a substantially hemispherical shape having a space provided therein.

Specifically, in the footwear 1A5, the protruding plate portion 240B is provided such that its peripheral portion is located closer to the ground contact surface 111*b* than its central portion, and thereby, the protruding plate portion 240B has an upward protruding shape. Further, the upper end (the vertex of the central portion) of the protruding plate portion 240B extends to the supporting surface 210*a* of the foot bed portion 210, whereas the lower end (the end portion of the peripheral edge portion) of the protruding plate portion 240B does not extend to the supported surface 210*b* of the foot bed portion 210.

In the configuration described above, the three-dimensional mesh structure portion 230 having a prescribed thickness and excellent deformability is located below the protruding plate portion 240B having relatively high compression rigidity. Accordingly, at the early stage of the foot landing action, the portion of the three-dimensional mesh structure portion 230 that is located below the protruding plate portion 240B is pressed into the protruding plate portion 240B and thus easily deforms to thereby enable an improved feel of contact for the wearer's foot. Also, at the end stage of the foot landing action, the function of supporting the foot arch is reliably exerted. This makes it possible to implement footwear by which both the wearing comfort and the function of supporting the foot arch can be achieved.

Further, by the configuration as described above, as compared with the case where the protruding plate portion 240B has a substantially spherical shape having a space provided therein, the additive manufacturing accuracy during additive manufacturing is improved by the inside space not filled with the protruding plate portion 240B.

In the above illustrative description about the present modification, only the protruding plate portion 240B is configured such that its lower end (the end portion of the peripheral edge portion) does not extend to the supported surface 210*b* of the foot bed portion 210, but only the protruding plate portion 240A can be configured such that its lower end (the end portion of the peripheral edge portion) does not extend to the supported surface 210*b* of the foot bed portion 210, or both the protruding plate portions 240A and 240B can be configured such that their lower ends (the end portions of the peripheral edge portions) do not extend to the supported surface 210*b* of the foot bed portion 210.

Sixth Modification

Figure 16:
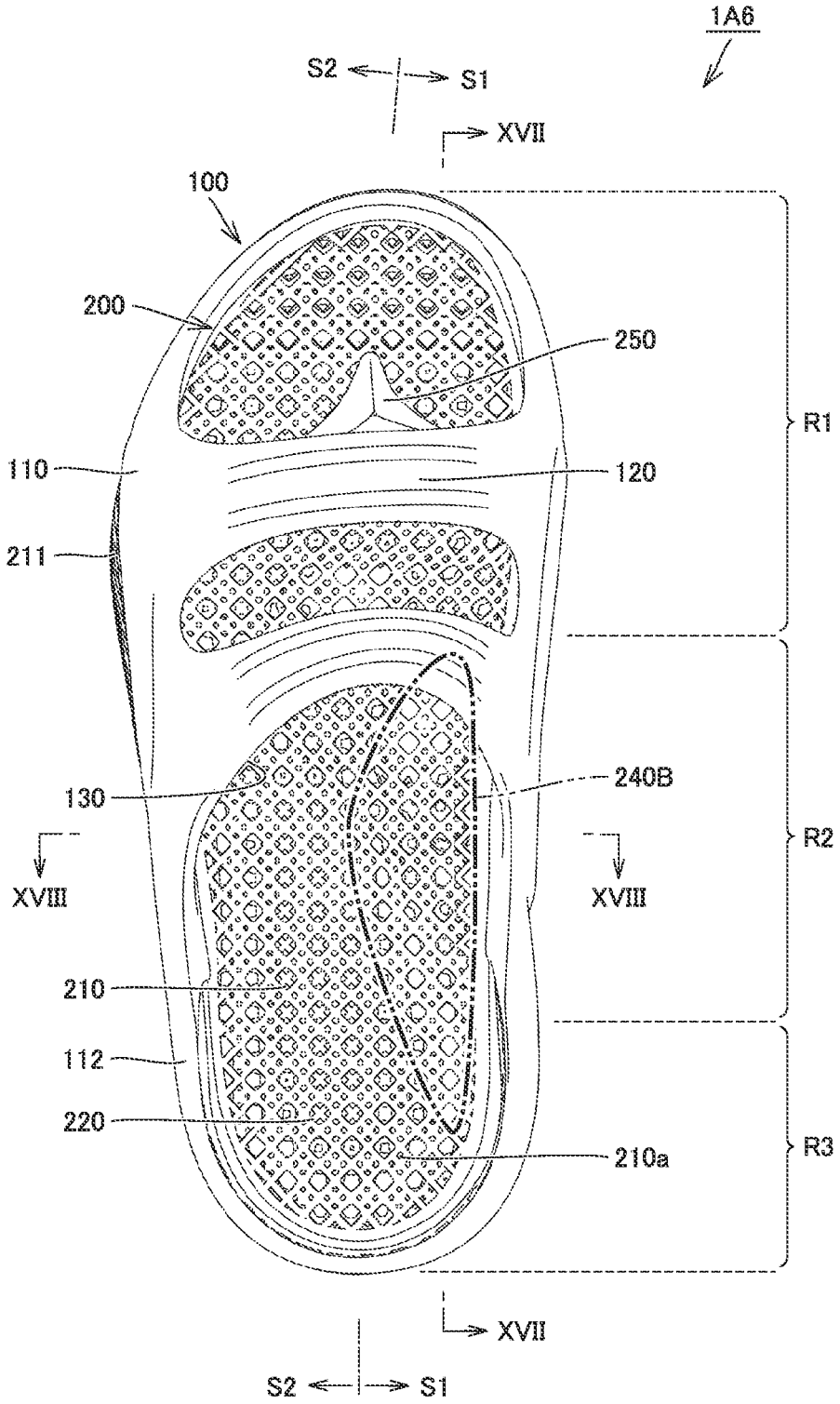
FIG. 16 is a plan view of footwear according to a sixth modification.
Figure 17:
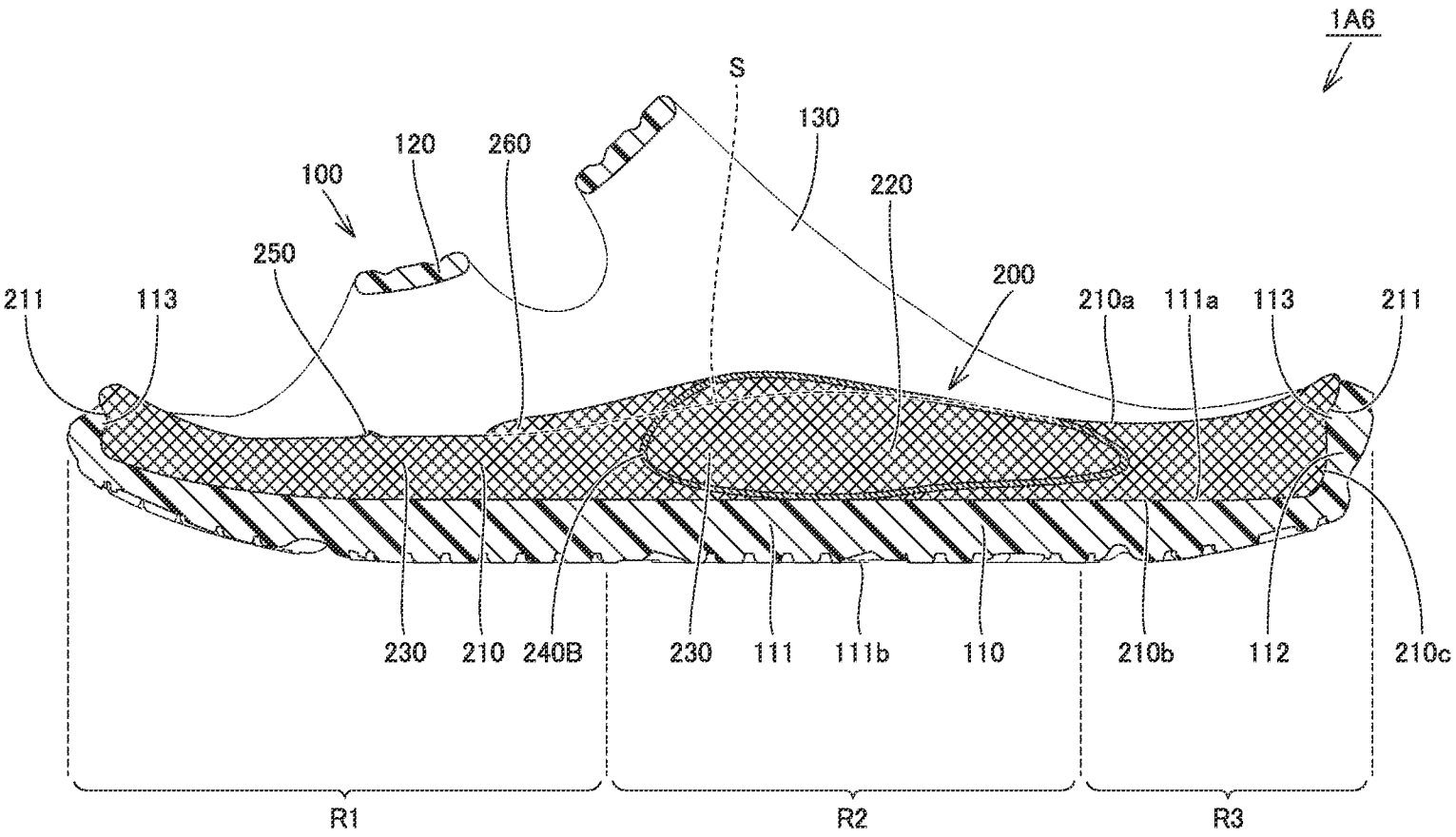
FIG. 17 is a schematic cross-sectional view taken along a line XVII-XVII shown in FIG. 16.
Figure 18:
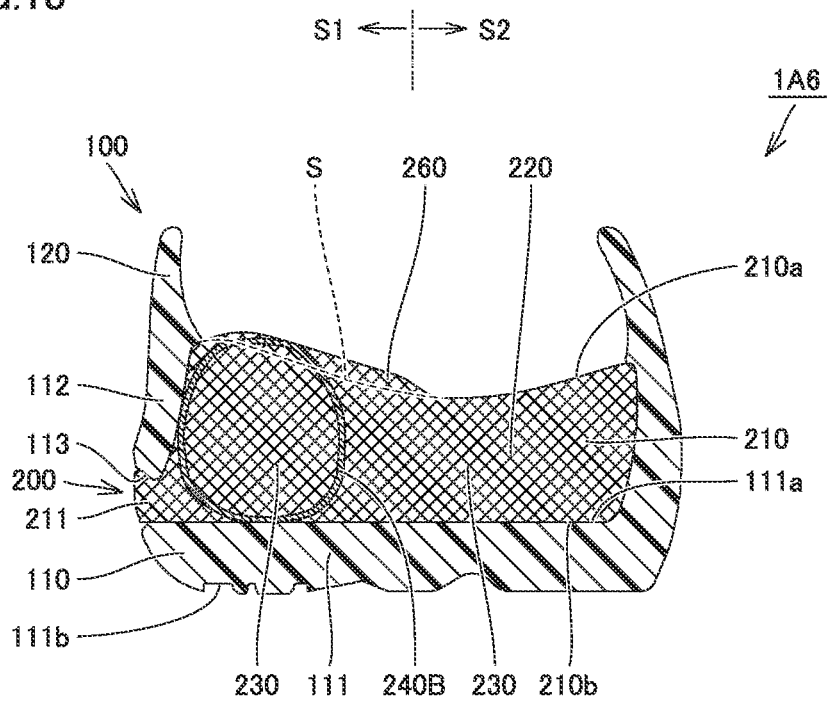
FIG. 18 is a schematic cross-sectional view taken along a line XVIII-XVIII shown in FIG. 16.

FIG. 16 is a plan view of footwear according to the sixth modification, and FIGS. 17 and 18 are schematic cross-sectional views taken along lines XVII-XVII and XVIII-XVIII, respectively, shown in FIG. 16. Referring to FIGS. 16 to 18, footwear 1A6 according to the sixth modification based on the above-described first embodiment will be described below.

As shown in FIG. 16 to FIG. 18, in the footwear 1A6 according to the sixth modification, the shock absorbing portion 220 is provided almost entirely in the foot bed portion 210 provided in the sole body 200, similarly to the footwear 1A according to the above-described first embodiment. In this case, the shock absorbing portion 220 is configured to include the three-dimensional mesh structure portion 230 and the protruding plate portion 240B, but not to include the protruding plate portion 240A (see FIG. 4 and the like).

Specifically, in the footwear 1A6, the protruding plate portion 240B is disposed in a region of the sole body 200 that supports a part of the foot sole that corresponds to the medial longitudinal arch of the wearer's foot. More specifically, the protruding plate portion 240B extends in the front-rear direction on the medial foot side in the left-right direction in a region included in the midfoot portion R2 and the rearfoot portion R3, and also embedded in the three-dimensional mesh structure portion 230. Note that a region of the sole body 200 that supports a part of the foot sole that corresponds to the medial longitudinal arch of the wearer's foot is derived based on a standard wearer having a foot size corresponding to the size of the footwear 1A6.

As shown in FIGS. 17 and 18, the protruding plate portion 240B has a substantially ellipsoidal shape having a space provided therein. In the top side portion of the protruding plate portion 240B, the peripheral portion is located closer to the ground contact surface 111*b* than the central portion, and in the bottom side portion of the protruding plate portion 240B, the central portion is located closer to the ground contact surface 111*b* than the peripheral portion. Thereby, the protruding plate portion 240B has a shape protruding upward and downward.

In this case, the three-dimensional mesh structure portion 230 is located not only in the space outside the portion provided with the protruding plate portion 240B, but also in the space provided inside the protruding plate portion 240B by providing the protruding plate portion 240B. In other words, also in the present modification, the protruding plate portion 240B is substantially completely embedded in the three-dimensional mesh structure portion 230 similarly to the footwear 1A according to the above-described first embodiment. Thus, the surface of the protruding plate portion 240B excluding its upper end (the vertex of the central portion in the top side portion) and its lower end (the vertex of the central portion in the bottom side portion) is connected to the three-dimensional mesh structure portion 230, and thereby, covered by the three-dimensional mesh structure portion 230.

In the configuration as described above, the medial longitudinal arch of the wearers foot can be held by the protruding plate portion 240B over a wider range as compared with the case of the footwear 1A according to the first embodiment. Thus, the function of supporting the medial longitudinal arch of the wearers foot can be further enhanced.

Seventh Modification

Figure 19:
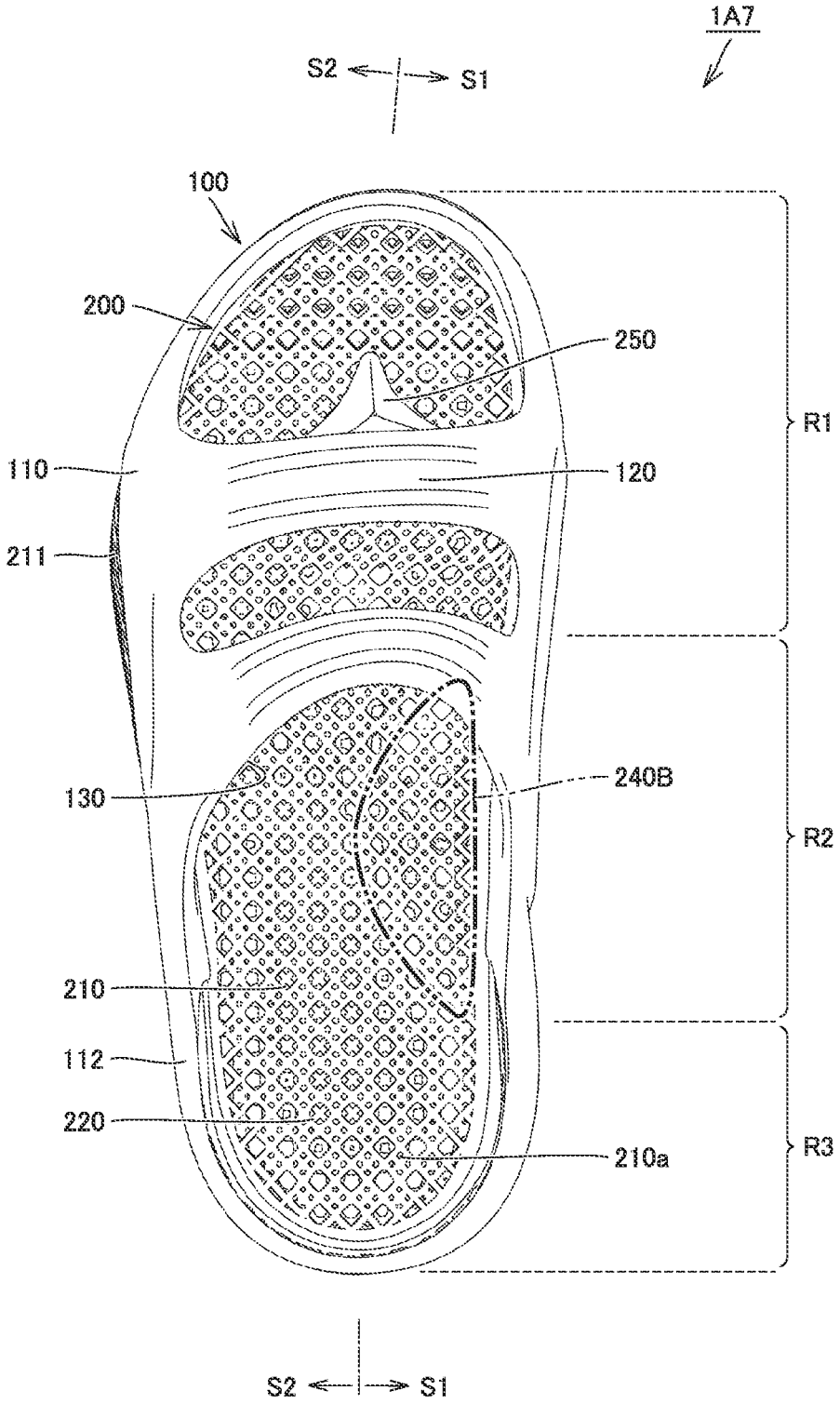
FIG. 19 is a plan view of footwear according to a seventh modification.

FIG. 19 is a plan view of footwear according to the seventh modification. Referring to FIG. 19, footwear 1A7 according to the seventh modification based on the above-described first embodiment will be described below.

As shown in FIG. 19, in the footwear 1A7 according to the seventh modification, the protruding plate portion 240B is shorter in length in the front-rear direction than that in the case of the footwear 1A6 according to the above-described sixth modification, and more specifically, does not include the rear end side portion disposed in the protruding plate portion 240B of the footwear 1A6. In other words, the protruding plate portion 240B is located in a region included in the midfoot portion R2 on the medial foot side in the left-right direction so as to extend in the front-rear direction, and does not extend to the rearfoot portion R3.

Also in the configuration as described above, similarly to the above-described sixth modification, the medial longitudinal arch of the wearers foot can be held by the protruding plate portion 240B over a wider range as compared with the case of the footwear 1A according to the first embodiment. Thus, the function of supporting the medial longitudinal arch of the wearers foot can be further enhanced.

Second Embodiment

Figure 20:
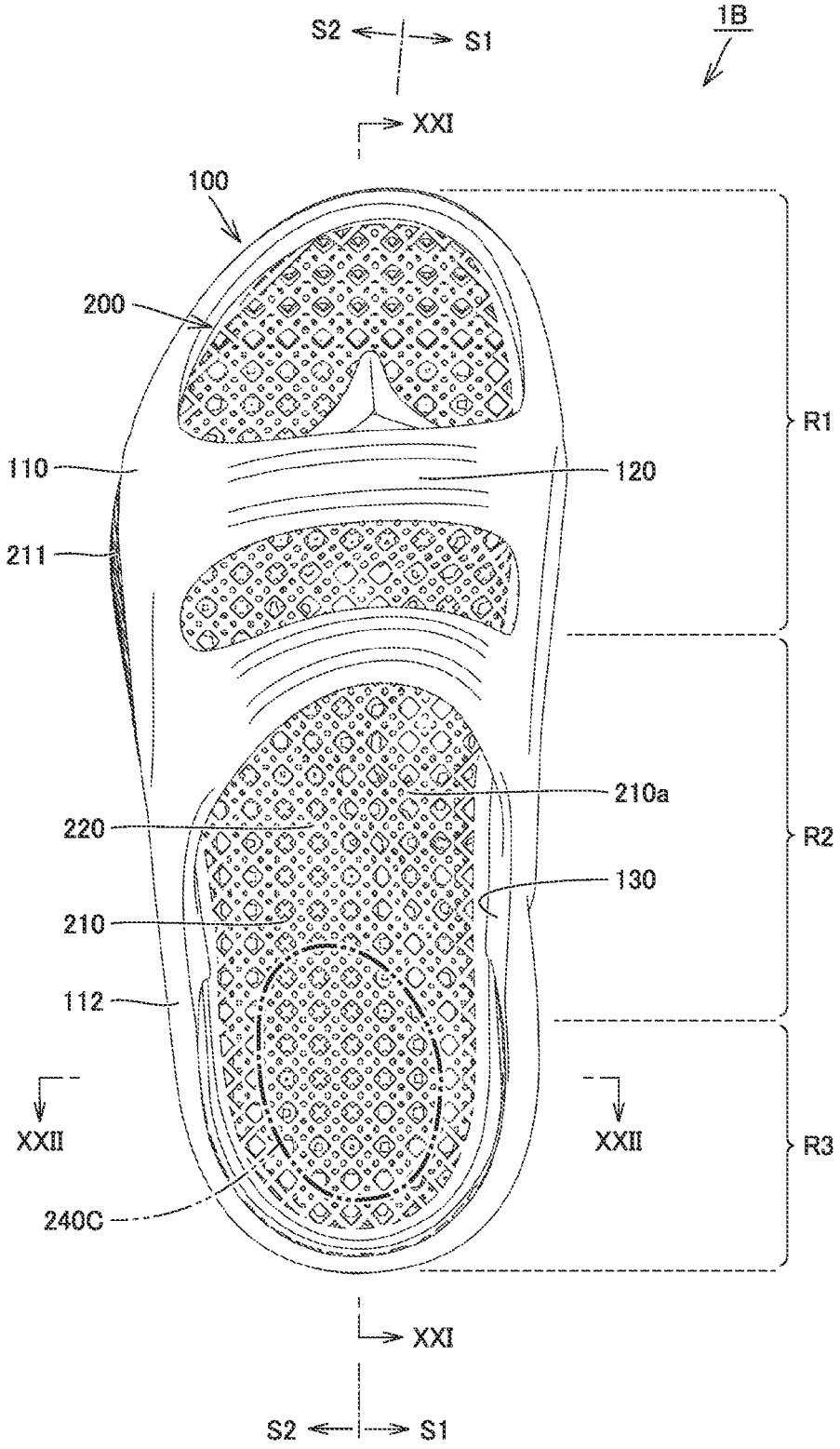
FIG. 20 is a plan view of footwear according to a second embodiment.
Figure 21:
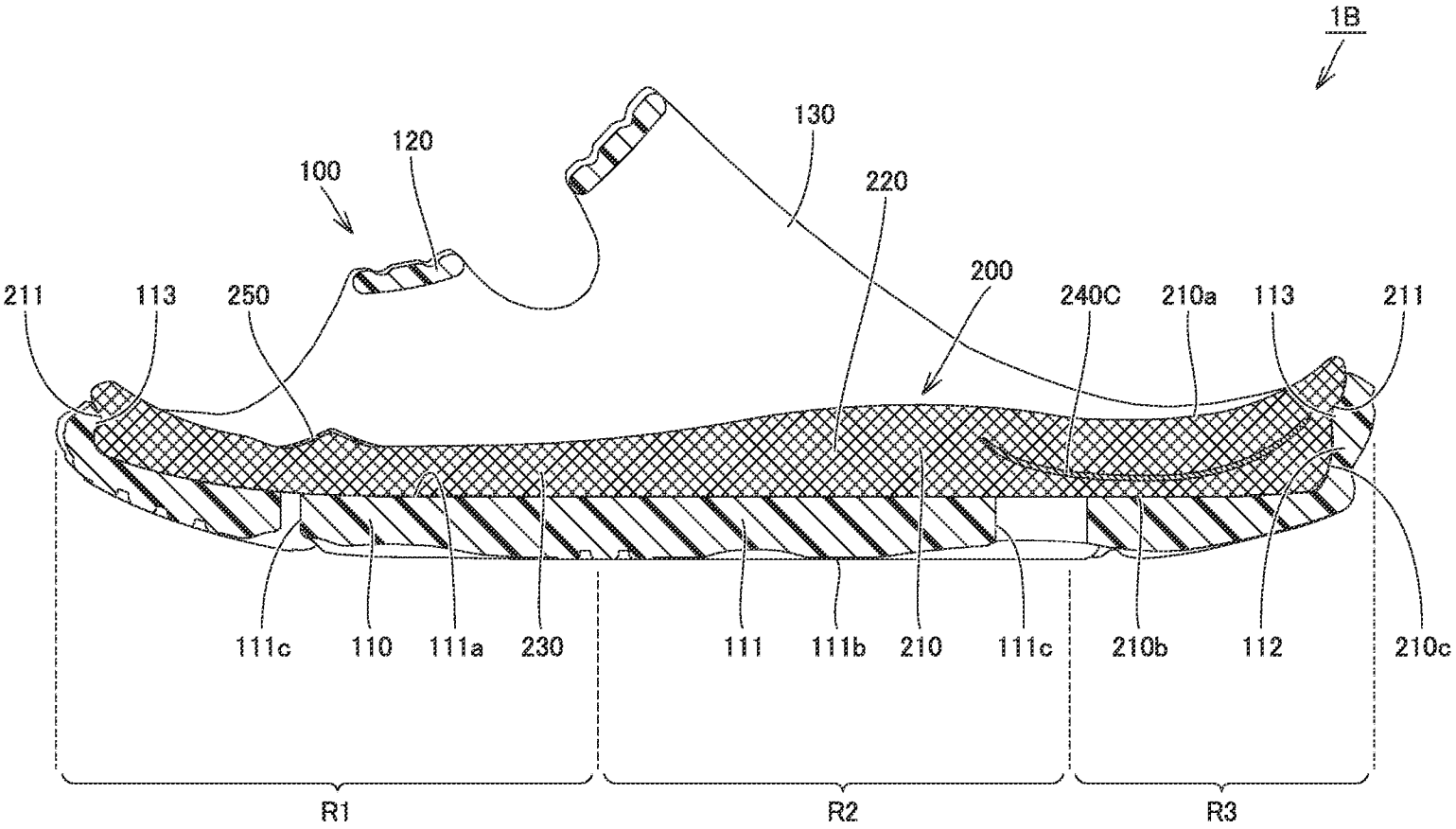
FIG. 21 is a schematic cross-sectional view taken along a line XXI-XXI shown in FIG. 20.
Figure 22:
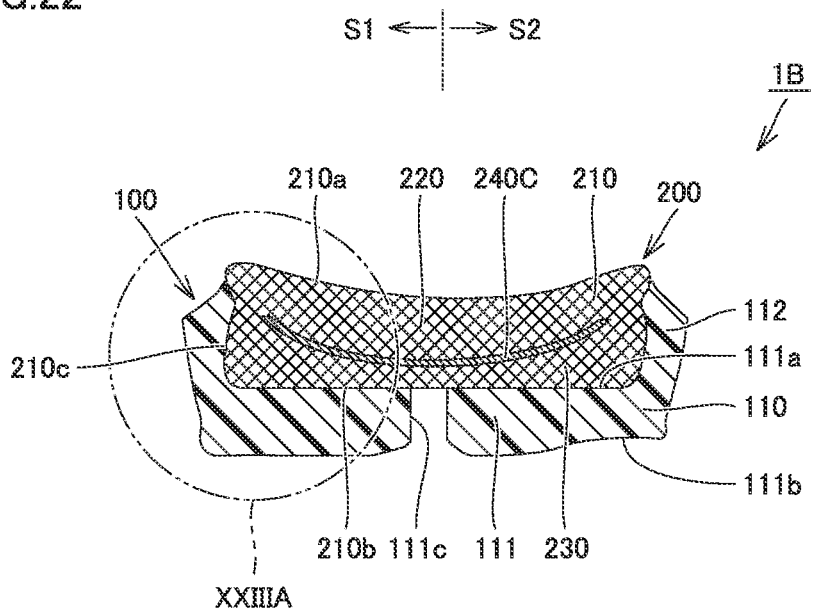
FIG. 22 is a schematic cross-sectional view taken along a line XXII-XXII shown in FIG. 20.
Figure 23A:
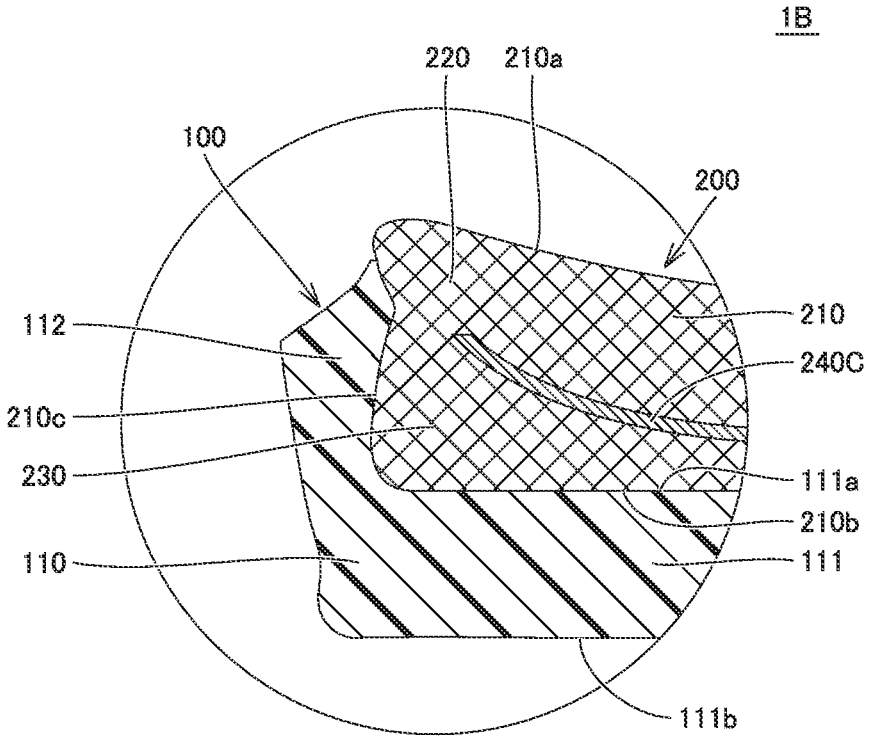
FIG. 23A is an enlarged view of a region XXIIIA shown in FIG. 22.
Figure 23B:
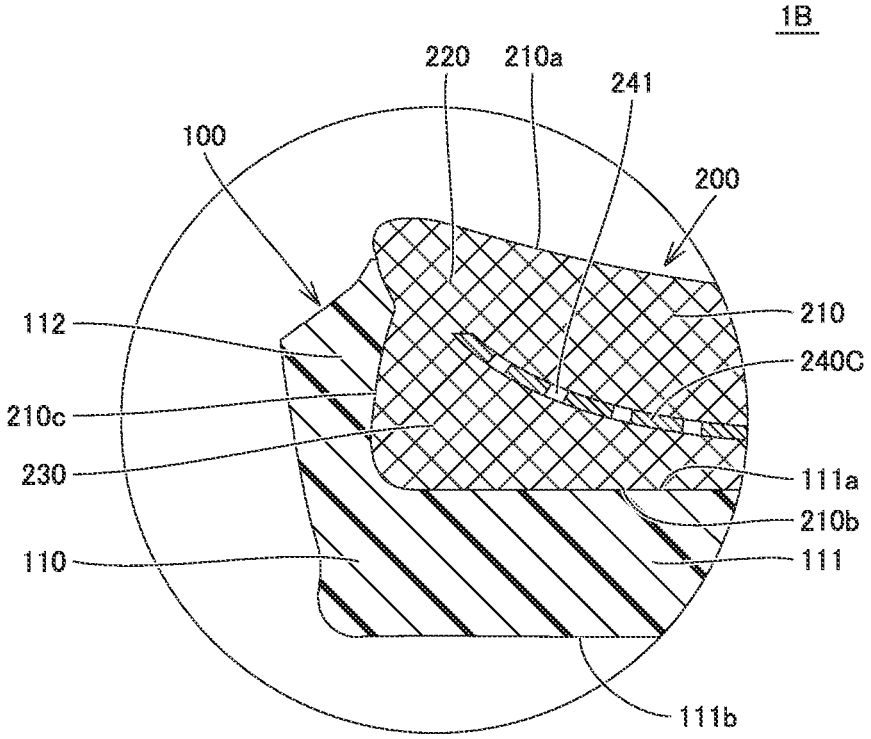
FIG. 23B is a schematic view illustrating a protruding plate portion having a configuration similar to the configuration shown in FIG. 23A.

FIG. 20 is a plan view of footwear according to the second embodiment. FIGS. 21 and 22 are schematic cross-sectional views taken along lines XXI-XXI and XXII-XXII, respectively, shown in FIG. 20. FIG. 23A is an enlarged view of a region XXIIIA shown in FIG. 22, and FIG. 23B is a schematic view illustrating a protruding plate portion having a configuration similar to the configuration shown in FIG. 23A. Referring to FIGS. 20 to 23B, footwear 1B according to the present embodiment will be described below.

As shown in FIGS. 20 to 23B, the footwear 1B according to the present embodiment includes the shell 100 and the sole body 200 similarly to the footwear 1A according to the above-described first embodiment, but the configuration of the sole body 200 is different from that of the footwear 1A according to the first embodiment.

Specifically, the shock absorbing portion 220 of the sole body 200 of the footwear 1B includes the three-dimensional mesh structure portion 230 and a protruding plate portion 240C as an irregularly shaped portion. Among them, the protruding plate portion 240C is located inside the shock absorbing portion 220 while being completely embedded in the three-dimensional mesh structure portion 230.

The protruding plate portion 240C is disposed in a region of the sole body 200 that supports a part of the foot sole that corresponds to a heel portion of the wearer's foot. More specifically, the protruding plate portion 240C is located in a region including the rear end of the midfoot portion R2 and the substantially entire rearfoot portion R3 substantially in a central portion in the left-right direction so as to extend over the boundary between the midfoot portion R2 and the rearfoot portion R3, and is embedded in the three-dimensional mesh structure portion 230 as described above. Note that a region of the sole body 200 that supports a part of the foot sole that corresponds to the heel portion of the wearer's foot is derived based on a standard wearer having a foot size corresponding to the size of the footwear 1B.

The protruding plate portion 240C has a shape different from that of the unit structure of the three-dimensional mesh structure portion 230, and specifically, has a curved plate shape in which its peripheral portion protrudes relative to its central portion in a direction orthogonal to the ground contact surface 111*b*. In particular, in the footwear 1B according to the present embodiment, the protruding plate portion 240C has a substantially hemispherical shape having a space provided therein.

The protruding plate portion 240C is disposed such that its central portion is located closer to the ground contact surface 111*b* than its peripheral portion. Thereby, the protruding plate portion 240C has a downward protruding shape and is configured such that its upper end (the end portion of the peripheral edge portion) does not extend to the supporting surface 210*a* of the foot bed portion 210 and its lower end (the vertex of the central portion) also does not extend to the supported surface 210*b* of the foot bed portion 210.

In this case, the three-dimensional mesh structure portion 230 is located not only in the space outside the portion provided with the protruding plate portion 240C, but also in the space provided inside the protruding plate portion 240C by providing the protruding plate portion 240C. Thus, the upper surface and the lower surface of the protruding plate portion 240C are completely covered by the three-dimensional mesh structure portion 230.

In this way, by providing the protruding plate portion 240C with a downward protruding shape in a region of the sole body 200 that supports the part of the foot sole that corresponds to the heel portion of the wearer's foot, the compression rigidity of the shock absorbing portion 220 in this portion including the protruding plate portion 240C is significantly higher than the compression rigidity of the portion formed only of the three-dimensional mesh structure portion 230 where the protruding plate portion 240C is not provided. Thus, by the configuration as described above, in the state in which the increase in weight is kept minimized, the compression rigidity of the region of the sole body 200 that supports the part of the foot sole that corresponds to the heel portion of the wearer's foot can be locally increased while maintaining the deformability around this region.

In the configuration as described above, the three-dimensional mesh structure portion 230 having a prescribed thickness and excellent deformability is located above the protruding plate portion 240C having relatively high compression rigidity. Thus, at the early stage of the foot landing action, the portion of the three-dimensional mesh structure portion 230 that is located above the protruding plate portion 240C is easily deformed to thereby allow an improved feel of contact for the wearer's foot. Also, at the end stage of the foot landing action, the heel portion of the wearer's foot can be held with stability. This makes it possible to implement footwear by which both the wearing comfort and the holding stability for wearer's foot can be achieved.

The protruding plate portion 240C shown in FIG. 23A does not include a hole portion, but can include a hole portion 241 penetrating therethrough in its thickness direction as shown in FIG. 23B. In the case where the protruding plate portion 240C includes the hole portion 241 in this way, the unhardened liquid resin or the like is easily discharged to the outside through the hole portion 241 in the washing step during additive manufacturing of the sole body 200 by the vat polymerization-type three-dimensional additive manufacturing method.

This makes it possible to reduce the possibility that the unhardened liquid resin can remain inside the sole body 200 during the subsequent heat treatment, which consequently contributes to improvement in accuracy of additive manufacturing. Note that a plurality of the hole portions 241 can be provided as shown in the figure, or only one hole portion 241 can be provided.

Eighth Modification

Figure 24:
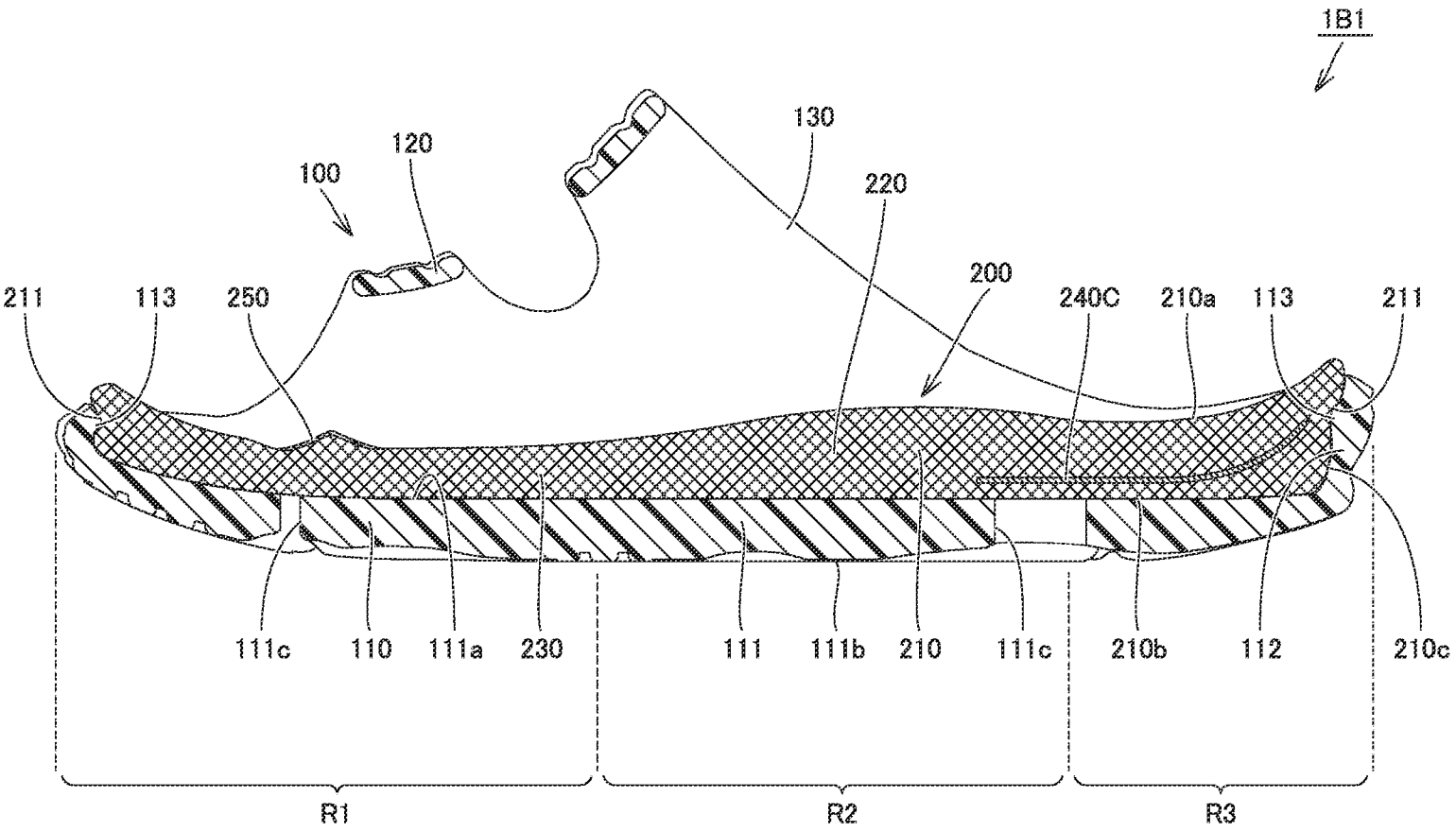
FIG. 24 is a schematic cross-sectional view of footwear according to an eighth modification.

FIG. 24 is a schematic cross-sectional view of footwear according to the eighth modification. Referring to FIG. 24, footwear 1B1 according to the eighth modification based on the above-described second embodiment will be described below.

As shown in FIG. 24, in the footwear 1B1 according to the eighth modification, the shock absorbing portion 220 is provided almost entirely in the foot bed portion 210 in the sole body 200 similarly to the footwear 1B according to the above-described second embodiment, and also, the shock absorbing portion 220 includes the three-dimensional mesh structure portion 230 and the protruding plate portion 240C. In this case, the footwear 1B1 according to the eighth modification is different from the footwear 1B according to the above-described second embodiment only in that the shape of the front end side portion of the protruding plate portion 240C is configured to have a shape not curved in the front-rear direction.

In other words, the protruding plate portion 240C embedded in the shock absorbing portion 220 of the sole body 200 included in the footwear 1B1 has a downward protruding shape in the left-right direction (see FIG. 22), similar to the footwear 1B according to the above-described second embodiment. Unlike the footwear 1B according to the above-described second embodiment, however, the protruding plate portion 240C is configured such that, in the front-rear direction, a portion closer to the front end extends substantially horizontally and a portion closer to the rear end is warped upward toward the rear side.

Also in the configuration as described above, the three-dimensional mesh structure portion 230 having a prescribed thickness and excellent deformability is located above the protruding plate portion 240C having relatively high compression rigidity, similarly to the above-described second embodiment. This makes it possible to implement footwear by which both the wearing comfort and the holding stability for wearer's foot can be achieved.

Ninth Modification

Figure 25A:
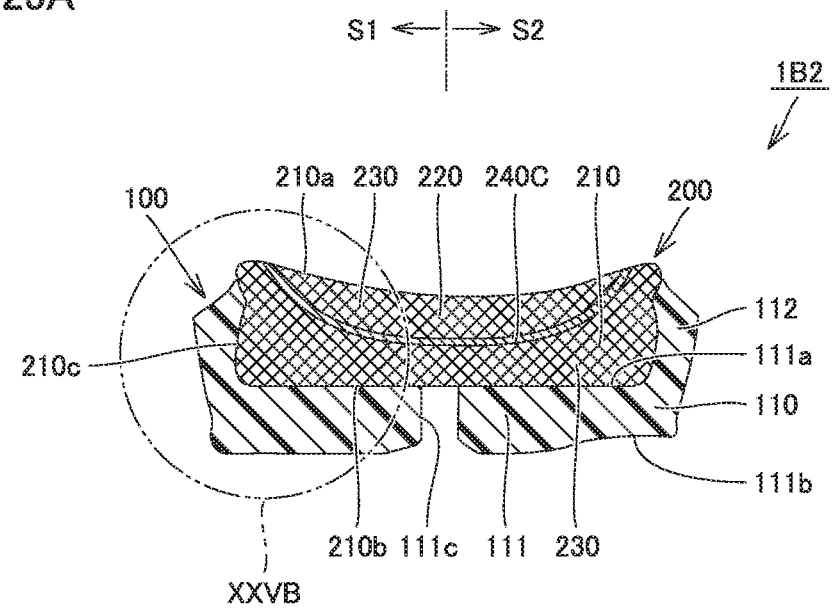
FIG. 25A is a schematic cross-sectional view of footwear according to a ninth modification.
Figure 25B:
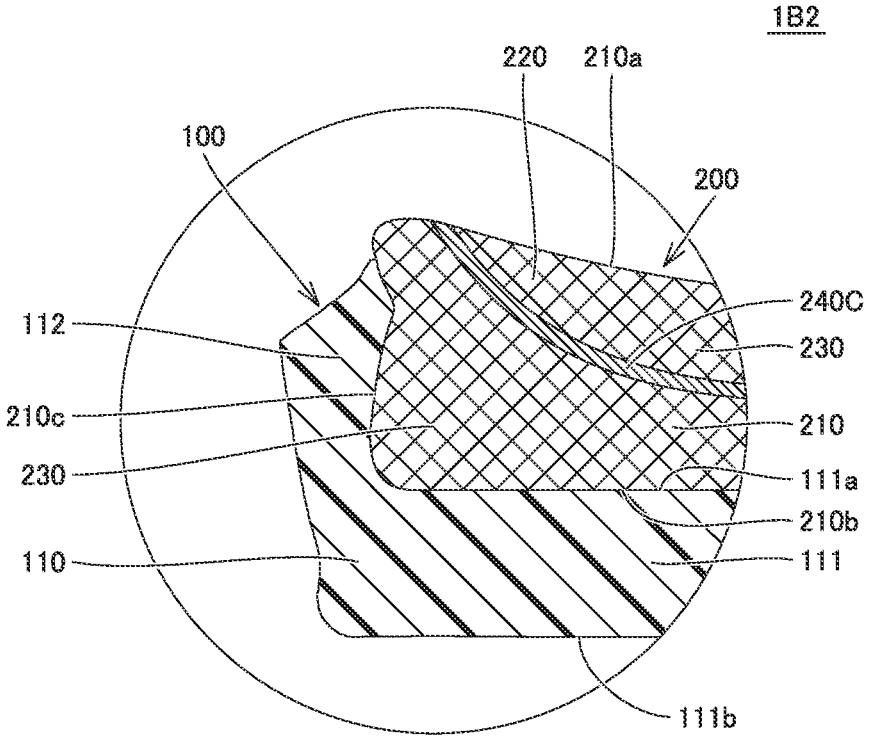
FIG. 25B is an enlarged view of a region XXVB shown in FIG. 25A.

FIG. 25A is a schematic cross-sectional view of footwear according to the ninth modification, and FIG. 25B is an enlarged view of a region XXVB shown in FIG. 25A. Referring to FIGS. 25A and 25B, footwear 1B2 according to the ninth modification based on the above-described second embodiment will be described below.

As shown in FIGS. 25A and 25B, in the footwear 1B2 according to the ninth modification, similarly to the footwear 1B according to the above-described second embodiment, the shock absorbing portion 220 is provided almost entirely in the foot bed portion 210 provided in the sole body 200, and the shock absorbing portion 220 includes the three-dimensional mesh structure portion 230 and the protruding plate portion 240C. In this case, however, the footwear 1B2 according to the ninth modification is different from the footwear 1B according to the above-described second embodiment only in that the upper end (the end portion of the peripheral edge portion) of the protruding plate portion 240C extends to the supporting surface 210*a* of the foot bed portion 210.

Also in the configuration as described above, similarly to the above-described second embodiment, the three-dimensional mesh structure portion 230 having a prescribed thickness and excellent deformability is located above the protruding plate portion 240C having relatively high compression rigidity. This makes it possible to implement footwear by which both the wearing comfort and the holding stability for wearer's foot can be achieved.

Tenth Modification

Figure 26:
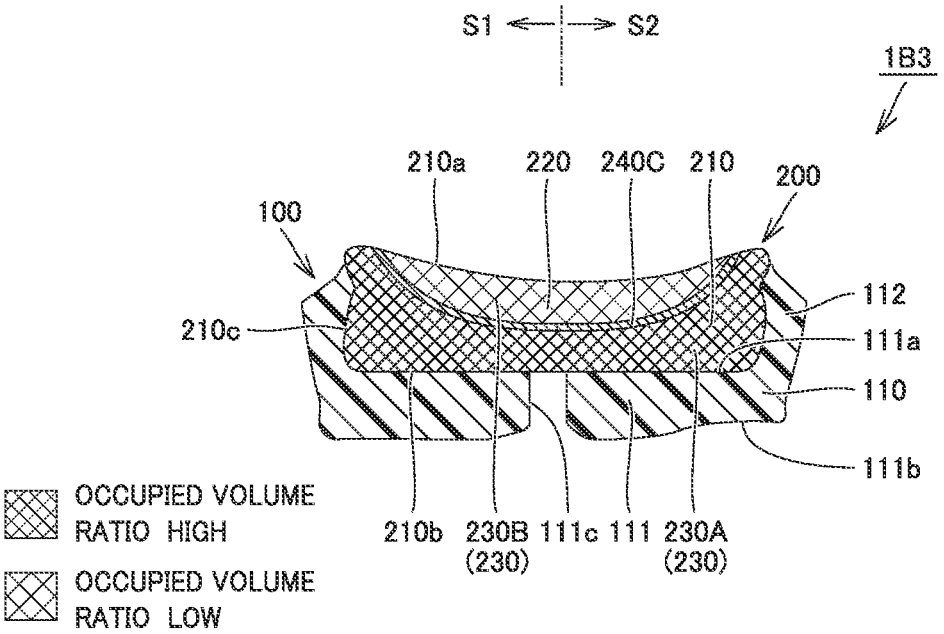
FIG. 26 is a schematic cross-sectional view of footwear according to a tenth modification.

FIG. 26 is a schematic cross-sectional view of footwear according to the tenth modification. Referring to FIG. 26, footwear 1B3 according to the tenth modification based on the above-described second embodiment will be described below.

As shown in FIG. 26, in the footwear 1B3 according to the tenth modification, similarly to the footwear 1B2 according to the above-described ninth modification, the upper end (the end portion of the peripheral edge portion) of the protruding plate portion 240C extends to the supporting surface 210*a* of the foot bed portion 210, but the occupied volume ratio of the three-dimensional mesh structure portion 230 is different in each part.

Specifically, in the footwear 1B3, the occupied volume ratio of the three-dimensional mesh structure portion 230 disposed in the space outside the portion including the protruding plate portion 240C is relatively high, and the occupied volume ratio of the three-dimensional mesh structure portion 230 disposed in the space inside the portion provided with the protruding plate portion 240C is relatively low. In other words, the occupied volume ratio of the three-dimensional mesh structure portion 230 is different between the inside and the outside of the protruding plate portion 240C, and the deformability of the three-dimensional mesh structure portion 230 disposed in the space inside the protruding plate portion 240C is further enhanced.

In the configuration as described above, when a load is applied to the foot bed portion 210, an excessive increase in compression rigidity caused by providing the protruding plate portion 240C can be suppressed, and the above-mentioned downward protruding shape of the protruding plate portion 240C can be maintained, which makes it possible to prevent the wearer from feeling significantly uncomfortable while still enabling the heel portion of the wearer's foot to be stably held when the foot lands on the ground.

Eleventh Modification

Figure 27A:
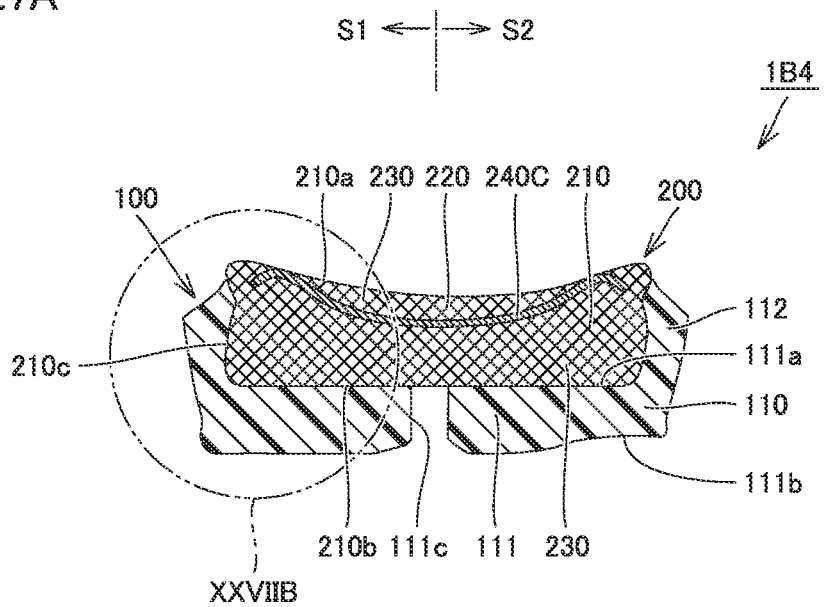
FIG. 27A is a schematic cross-sectional view of footwear according to an eleventh modification.
Figure 27B:
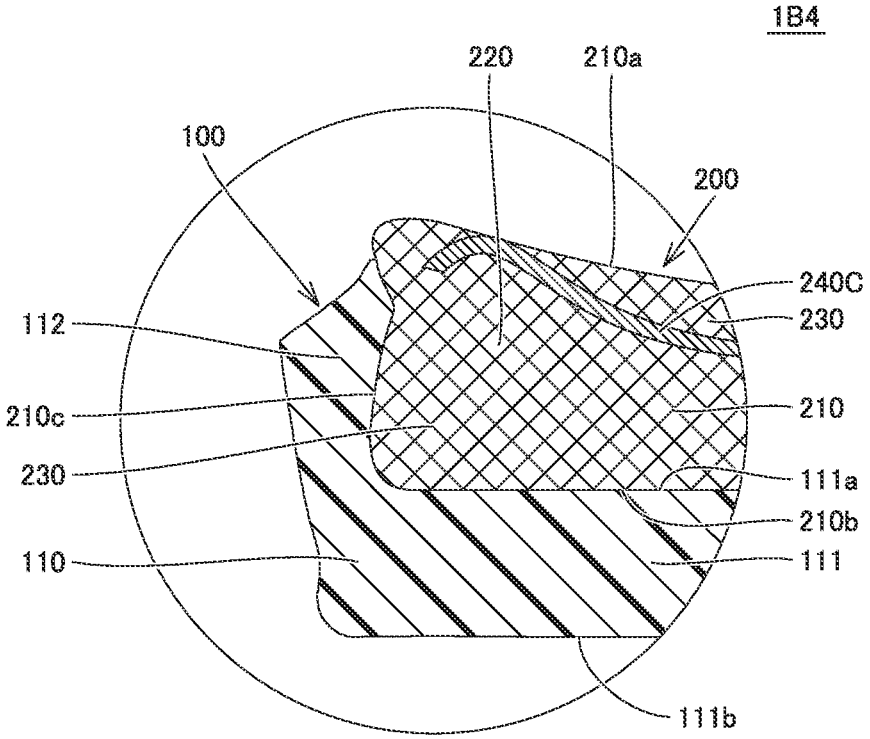
FIG. 27B is an enlarged view of a region XXVIIB shown in FIG. 27A.

FIG. 27A is a schematic cross-sectional view of footwear according to the eleventh modification, and FIG. 27B is an enlarged view of a region XXVIIB shown in FIG. 27A. Referring to FIGS. 27A and 27B, footwear 1B4 according to the eleventh modification based on the above-described second embodiment will be described below.

As shown in FIGS. 27A and 27B, in the footwear 1B4 according to the eleventh modification, similarly to the footwear 1B3 according to the above-described tenth modification, the upper end of the protruding plate portion 240C extends to the supporting surface 210*a* of the foot bed portion 210. In this case, the end portion of the peripheral edge portion of the protruding plate portion 240C extends further outward from the upper end, and this extended portion of the protruding plate portion 240C is folded back so as to be smoothly curved toward the ground contact surface 111*b*.

In the configuration as described above, the surface shape of the portion of the protruding plate portion 240C that extends to the supporting surface 210*a* of the foot bed portion 210 can be formed as a gently curved surface. This makes it possible to prevent the wearer from feeling significantly uncomfortable while still enabling the heel portion of the wearers foot to be stably held when the foot lands on the ground.

Third Embodiment

Figure 28:
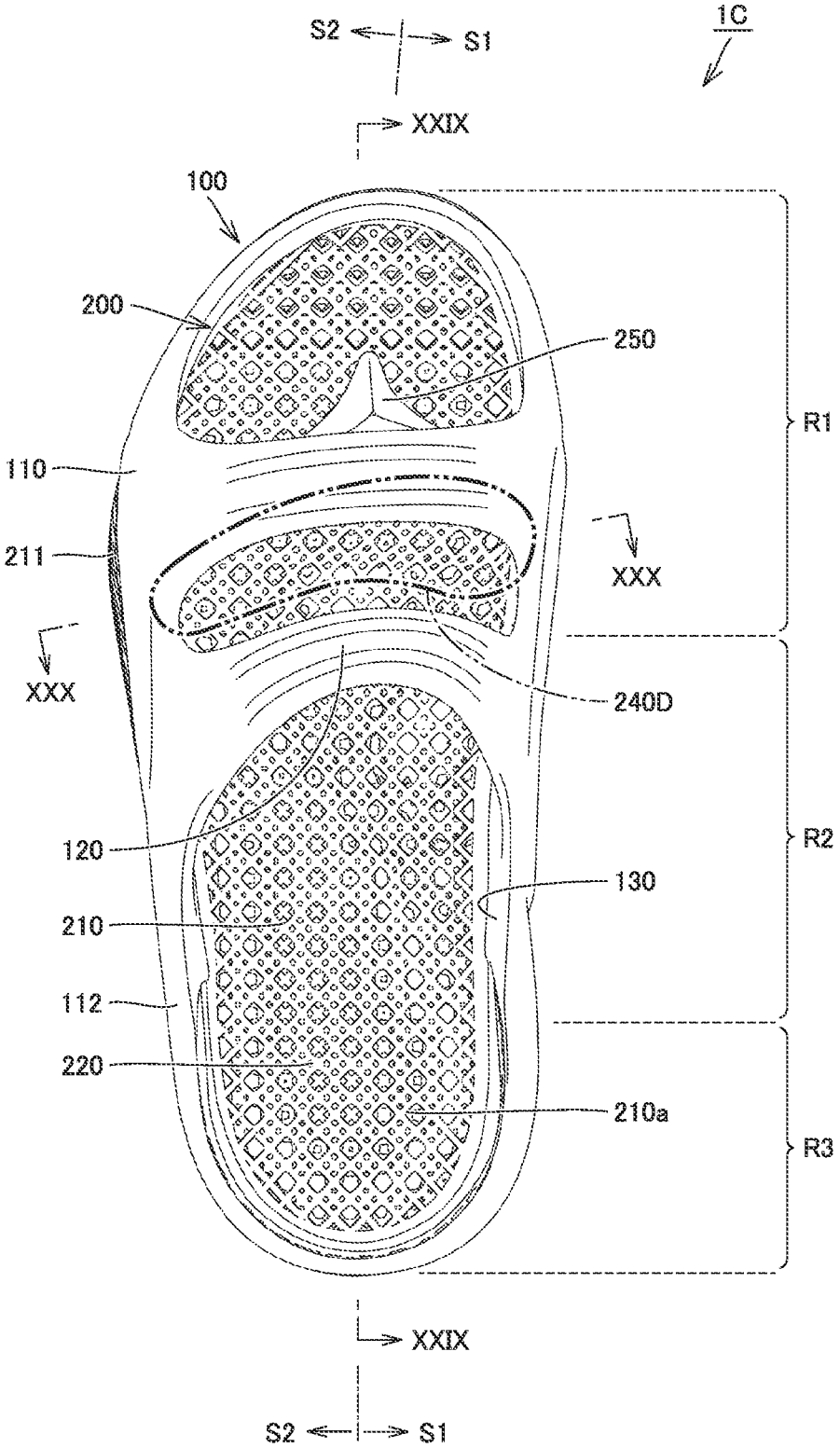
FIG. 28 is a plan view of footwear according to a third embodiment.
Figure 29:
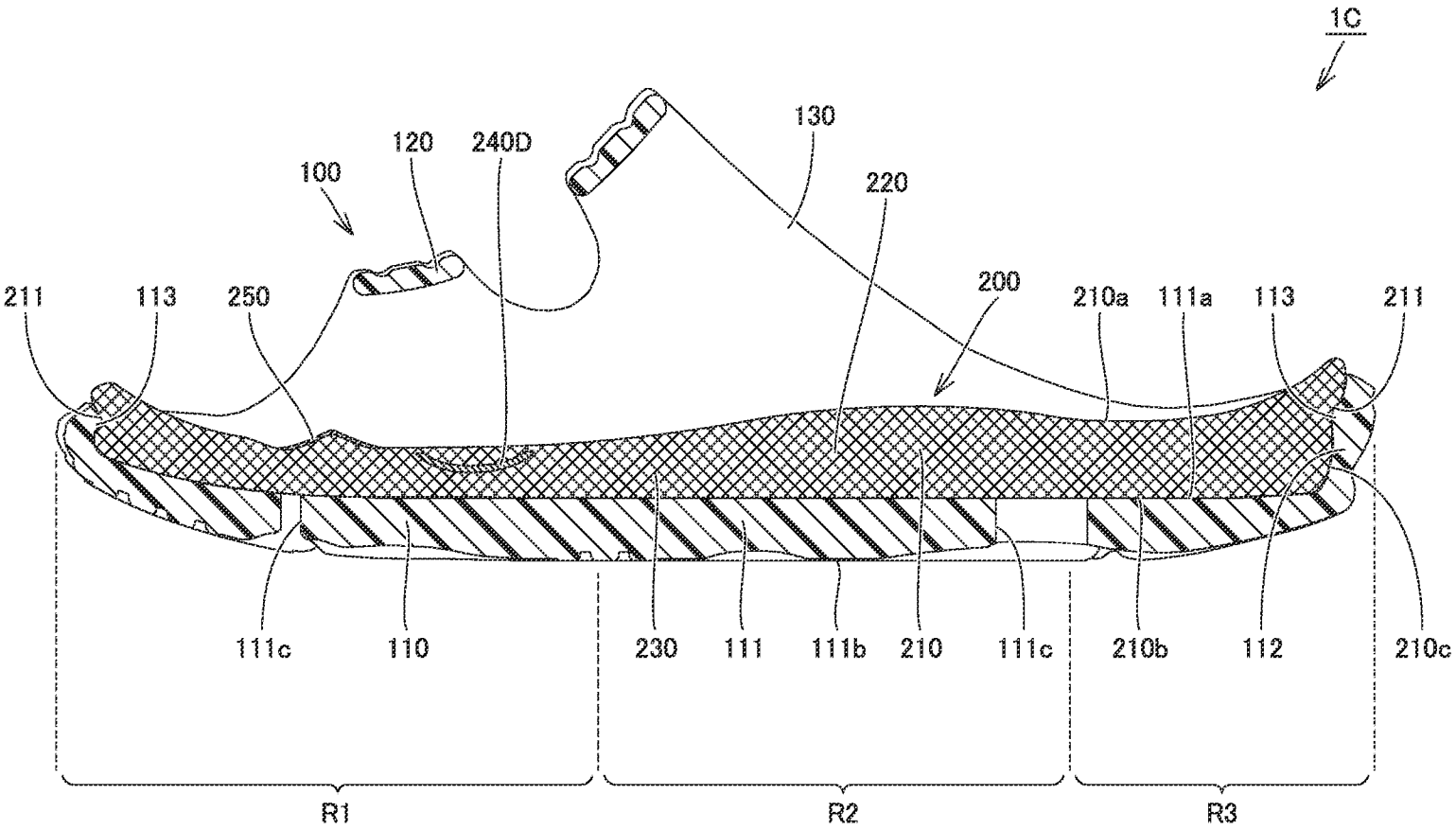
FIG. 29 is a schematic cross-sectional view taken along a line XXIX-XXIX shown in FIG. 28.
Figure 30:
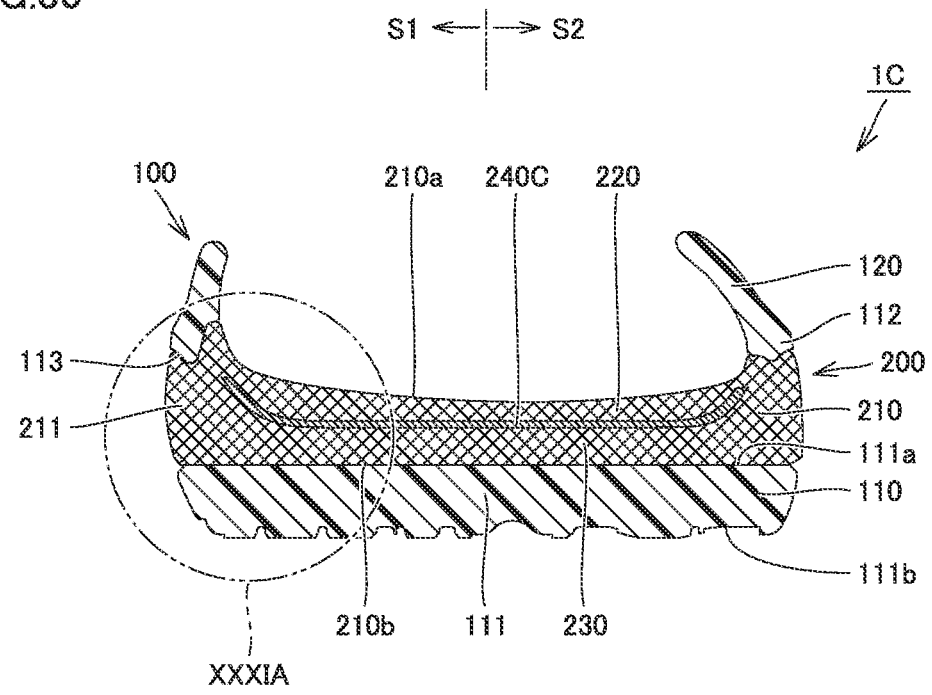
FIG. 30 is a schematic cross-sectional view taken along a line XXX-XXX shown in FIG. 28.
Figure 31A:
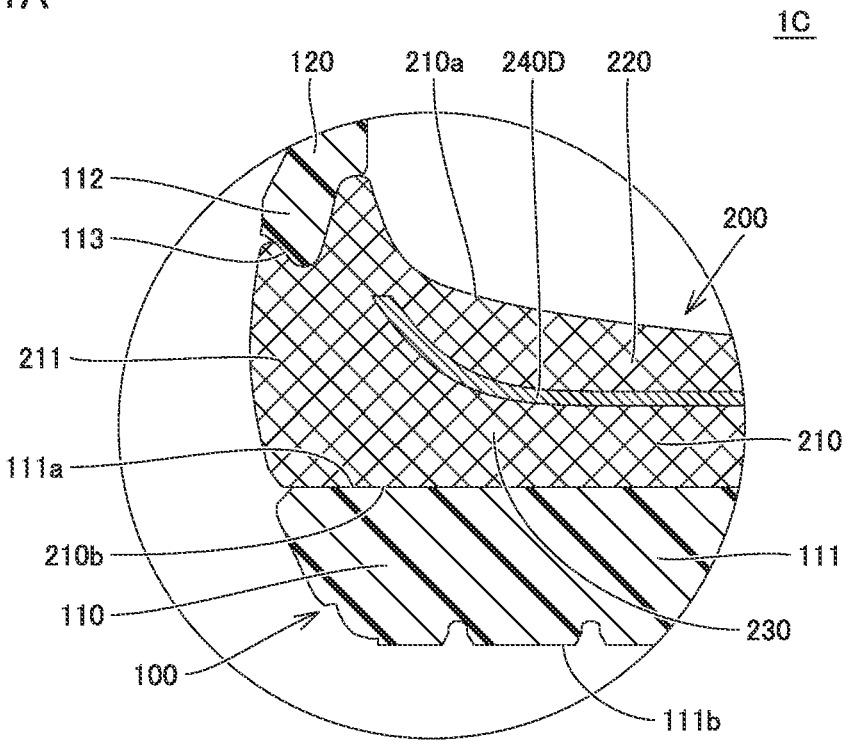
FIG. 31A is an enlarged view of a region XXXIA shown in FIG. 30.
Figure 31B:
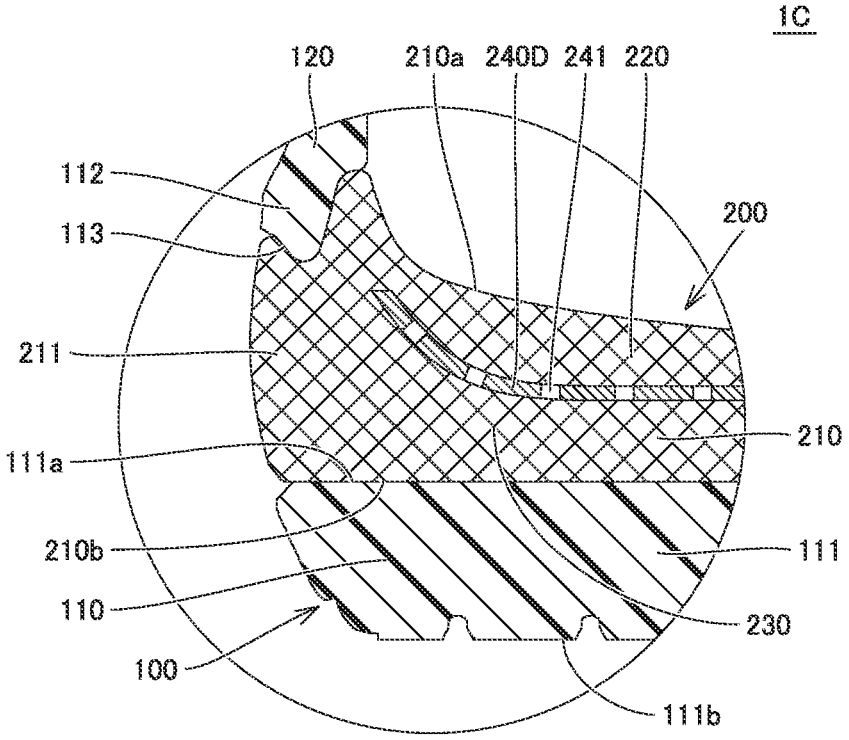
FIG. 31B is a schematic view illustrating a protruding plate portion having a configuration similar to the configuration shown in FIG. 31A.

FIG. 28 is a plan view of footwear according to the third embodiment. FIGS. 29 and 30 are schematic cross-sectional views taken along lines XXIX-XXIX and XXX-XXX, respectively, shown in FIG. 28. FIG. 31A is an enlarged view of a region XXXIA shown in FIG. 30, and FIG. 31B is a schematic view illustrating a protruding plate portion having a configuration similar to the configuration shown in FIG. 31A. Referring to FIGS. 28 to 31B, footwear 1C according to the present embodiment will be described below.

As shown in FIGS. 28 to 31B, the footwear 1C according to the present embodiment includes the shell 100 and the sole body 200 similarly to the footwear 1A according to the above-described first embodiment, but the configuration of the sole body 200 is different from that of the footwear 1A according to the first embodiment.

Specifically, the shock absorbing portion 220 of the sole body 200 in the footwear 1C includes the three-dimensional mesh structure portion 230 and a protruding plate portion 240D as an irregularly shaped portion. Among them, the protruding plate portion 240D is located inside the shock absorbing portion 220 while being completely embedded in the three-dimensional mesh structure portion 230.

The protruding plate portion 240D is disposed in a region of the sole body 200 that supports a part of the foot sole that corresponds to a metatarsophalangeal joint of the wearer's foot (in which the portion corresponding to the metatarsophalangeal joint of the wearer's foot substantially coincides with the portion corresponding to the ball portion of the wearer's foot). More specifically, the protruding plate portion 240D is located in a portion closer to the rear end of the forefoot portion R1 so as to extend in the left-right direction, and is embedded in the three-dimensional mesh structure portion 230 as described above. Note that a region of the sole body 200 that supports a part of the foot sole that corresponds to the metatarsophalangeal joint of the wearer's foot is derived based on a standard wearer having a foot size corresponding to the size of the footwear 1C.

The protruding plate portion 240D has a shape different from that of the unit structure of the three-dimensional mesh structure portion 230, and specifically, has a curved plate shape in which its peripheral portion protrudes relative to its central portion in a direction orthogonal to the ground contact surface 111*b*. In particular, in the footwear 1C according to the present embodiment, the protruding plate portion 240D has a horizontally long and substantially hemispherical shape having a space provided therein.

The protruding plate portion 240D is provided such that its central portion is located closer to the ground contact surface 111*b* than its peripheral portion. Thus, the protruding plate portion 240D has a downward protruding shape and is configured such that its upper end (the end portion of the peripheral edge portion) does not extend to the supporting surface 210*a* of the foot bed portion 210 and its lower end (the vertex of the central portion) also does not extend to the supported surface 210*b* of the foot bed portion 210.

In this case, the three-dimensional mesh structure portion 230 is located not only in the space outside the portion including the protruding plate portion 240D, but also in the space inside the protruding plate portion 240D by providing the protruding plate portion 240D. Thus, the upper surface and the lower surface of the protruding plate portion 240D are completely covered by the three-dimensional mesh structure portion 230.

Thus, by providing the protruding plate portion 240D with a downward protruding shape in the region of the sole body 200 that supports the part of the foot sole that corresponds to the metatarsophalangeal joint of the wearer's foot, the compression rigidity of the shock absorbing portion 220 in the portion provided with the protruding plate portion 240D is significantly higher than the compression rigidity of the portion formed only of the three-dimensional mesh structure portion 230 where the protruding plate portion 240D is not provided. Therefore, by the configuration as described above, in the state in which the increase in weight is kept minimized, the compression rigidity of the region of the sole body 200 that supports the part of the foot sole that corresponds to the metatarsophalangeal joint of the wearer's foot can be locally increased while maintaining the deformability around this region.

In this case, in the configuration as described above, the three-dimensional mesh structure portion 230 having a prescribed thickness and excellent deformability is located above the protruding plate portion 240D having relatively high compression rigidity. Thus, at the early stage of the foot landing action, the portion of the three-dimensional mesh structure portion 230 that is located above the protruding plate portion 240D is easily deformed to thereby enable an improved feel of contact for the wearer's foot. Also, at the end stage of the foot landing action, the ball portion of the wearer's foot can be held with stability. This makes it possible to implement footwear by which both wearing comfort and the holding stability for a wearer's foot can be achieved.

In addition, in the configuration as described above, the ball portion of the wearer's foot is disposed above the protruding plate portion 240D when wearing the footwear. Thus, when the wearer's foot lands on the ground, the portion of the three-dimensional mesh structure portion 230 that is located above the protruding plate portion 240D is deformed, and the ball portion of the wearer's foot is inserted into the space provided inside the protruding plate portion 240D. Thereby, when the wearer is walking, the protruding plate portion 240D is fitted and caught in the protrusions and recesses of the wearer's foot, which makes it possible for the wearer to smoothly walk.

Note that the protruding plate portion 240D shown in FIG. 31A does not include a hole portion, but the protruding plate portion 240D can include the hole portion 241 penetrating therethrough in its thickness direction as shown in FIG. 31B. In the case where the protruding plate portion 240D includes the hole portion 241 in this way, the unhardened liquid resin or the like is easily discharged to the outside through the hole portion 241 in the washing step during additive manufacturing of the sole body 200 by the vat polymerization-type three-dimensional additive manufacturing method. This makes it possible to reduce the possibility that the unhardened liquid resin can remain inside the sole body 200 during the subsequent heat treatment, which consequently contributes to improvement in accuracy of additive manufacturing. Note that a plurality of the hole portions 241 can be provided as shown in the figure, or only one hole portion 241 can be provided.

Twelfth Modification

Figure 32A:
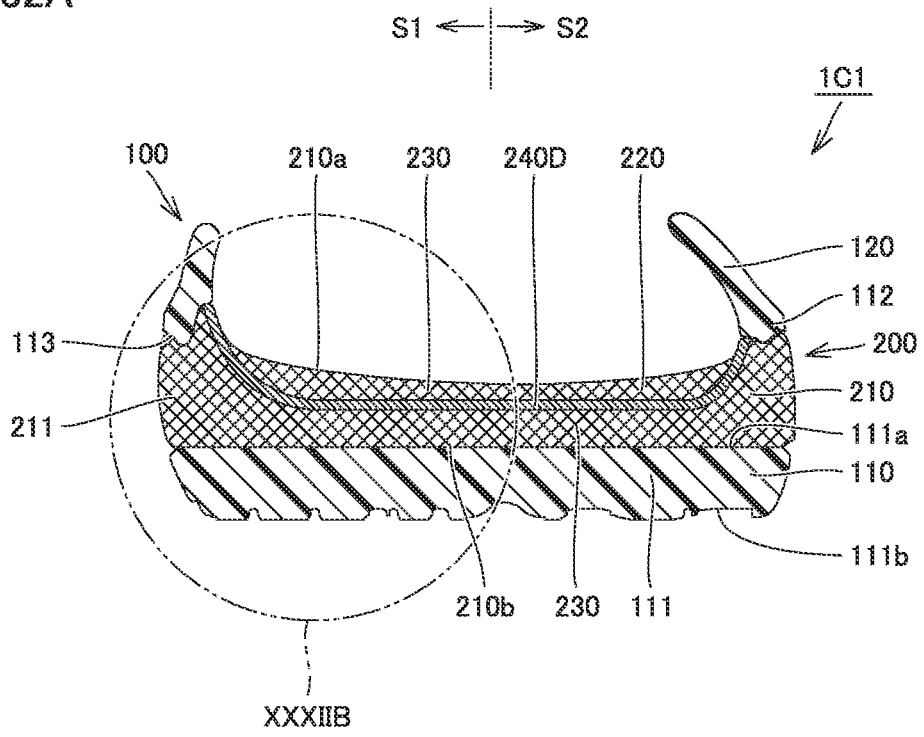
FIG. 32A is a schematic cross-sectional view of footwear according to a twelfth modification.
Figure 32B:
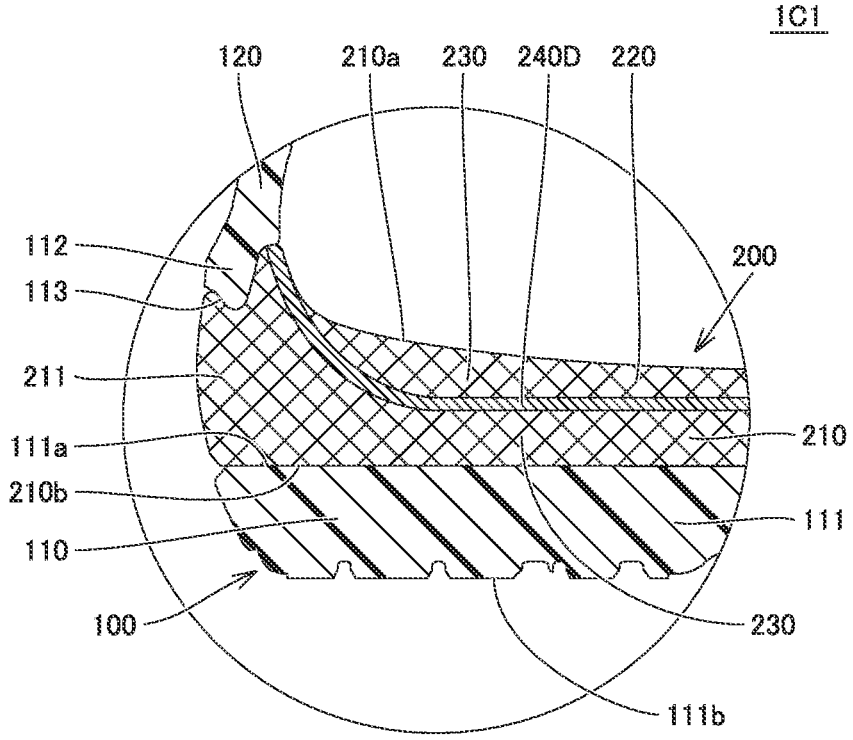
FIG. 32B is an enlarged view of a region XXXIIB shown in FIG. 32A.

FIG. 32A is a schematic cross-sectional view of footwear according to the twelfth modification, and FIG. 32B is an enlarged view of a region XXXIIB shown in FIG. 32A. Referring to FIGS. 32A and 32B, footwear 1C1 according to the twelfth modification based on the above-described third embodiment will be described below.

As shown in FIGS. 32A and 32B, in the footwear 1C1 according to the twelfth modification, similarly to the footwear 1C according to the above-described third embodiment, the shock absorbing portion 220 is provided almost entirely in the foot bed portion 210 in the sole body 200, and the shock absorbing portion 220 includes the three-dimensional mesh structure portion 230 and the protruding plate portion 240D. In this case, the footwear 1C1 according to the twelfth modification is different from the footwear 1C according to the above-described third embodiment only in that the upper end (the end portion of the peripheral edge portion) of the protruding plate portion 240D extends to the supporting surface 210*a* of the foot bed portion 210.

Also in the configuration as described above, similarly to the above-described third embodiment, the three-dimensional mesh structure portion 230 having a prescribed thickness and excellent deformability is located above the protruding plate portion 240D having relatively high compression rigidity. This makes it possible to implement footwear by which both the wearing comfort and the holding stability for wearer's foot can be achieved.

In addition, in the footwear 1C1 according to the present modification, the upper end of the protruding plate portion 240D that extends to the supporting surface 210*a* of the foot bed portion 210 further extends to the engaging portion 211 formed as a protruding portion having a protruding shape and extending in the peripheral direction of the peripheral surface 210*c* of the foot bed portion 210.

In the configuration as described above, the occupied volume ratio of the engaging portion 211 is locally increased, and thereby, the rigidity of the engaging portion 211 can be further enhanced, so that the sole body 200 can be more firmly engaged the shell 100. Therefore, the configuration as described above makes it possible to achieve a secondary effect by which the shell 100 can be prevented from unintentionally falling off from the sole body 200.

Thirteenth Modification

Figure 33:
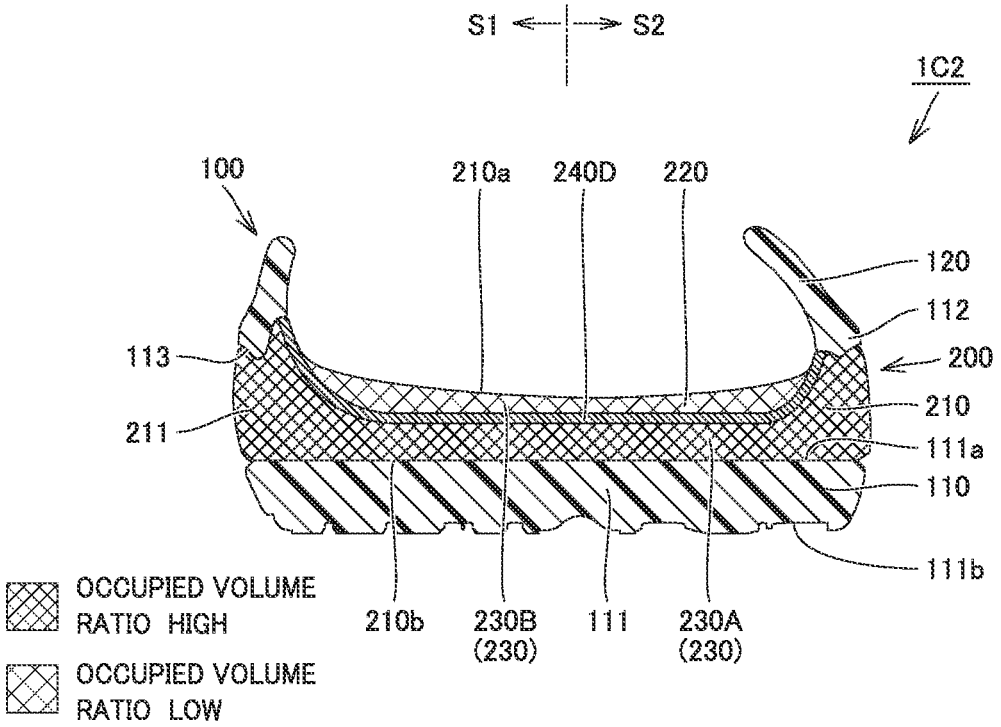
FIG. 33 is a schematic cross-sectional view of footwear according to a thirteenth modification.

FIG. 33 is a schematic cross-sectional view of footwear according to the thirteenth modification. Referring to FIG. 33, footwear 1C2 according to the thirteenth modification based on the above-described third embodiment will be described below.

As shown in FIG. 33, in the footwear 1C2 according to the thirteenth modification, similarly to the footwear 1C1 according to the above-described twelfth modification, the upper end (the end portion of the peripheral edge portion) of the protruding plate portion 240D extends to the supporting surface 210*a* of the foot bed portion 210, but the occupied volume ratio of the three-dimensional mesh structure portion 230 is different in each part.

Specifically, in the footwear 1C2, the occupied volume ratio of the three-dimensional mesh structure portion 230 disposed in the space outside the portion provided with the protruding plate portion 240D is relatively high, while the occupied volume ratio of the three-dimensional mesh structure portion 230 disposed in the space inside the portion including the protruding plate portion 240D is relatively low. In other words, the occupied volume ratio of the three-dimensional mesh structure portion 230 is different between the inside and the outside of the protruding plate portion 240D, and the deformability of the three-dimensional mesh structure portion 230 disposed in the space inside the protruding plate portion 240D is further enhanced.

In the configuration as described above, when a load is applied to the foot bed portion 210, an excessive increase in compression rigidity caused by providing the protruding plate portion 240D can be suppressed, and the above-described downward protruding shape of the protruding plate portion 240D can be maintained, which makes it possible to prevent the wearer from feeling significantly uncomfortable while still enabling the ball portion of the wearer's foot to be stably held when the foot lands on the ground.

Fourteenth Modification

Figure 34A:
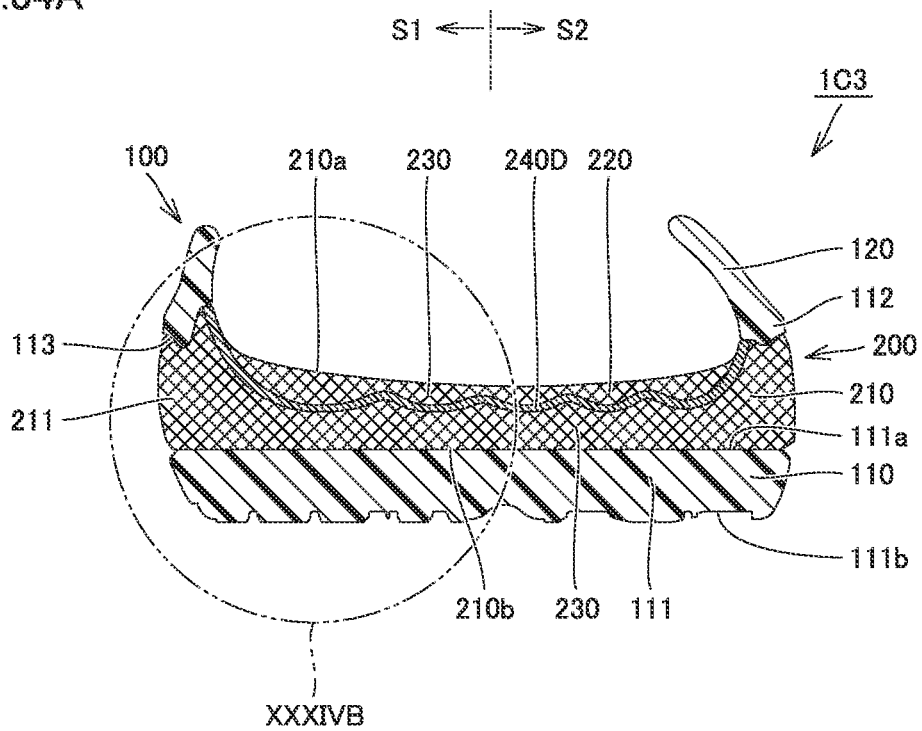
FIG. 34A is a schematic cross-sectional view of footwear according to a fourteenth modification.
Figure 34B:
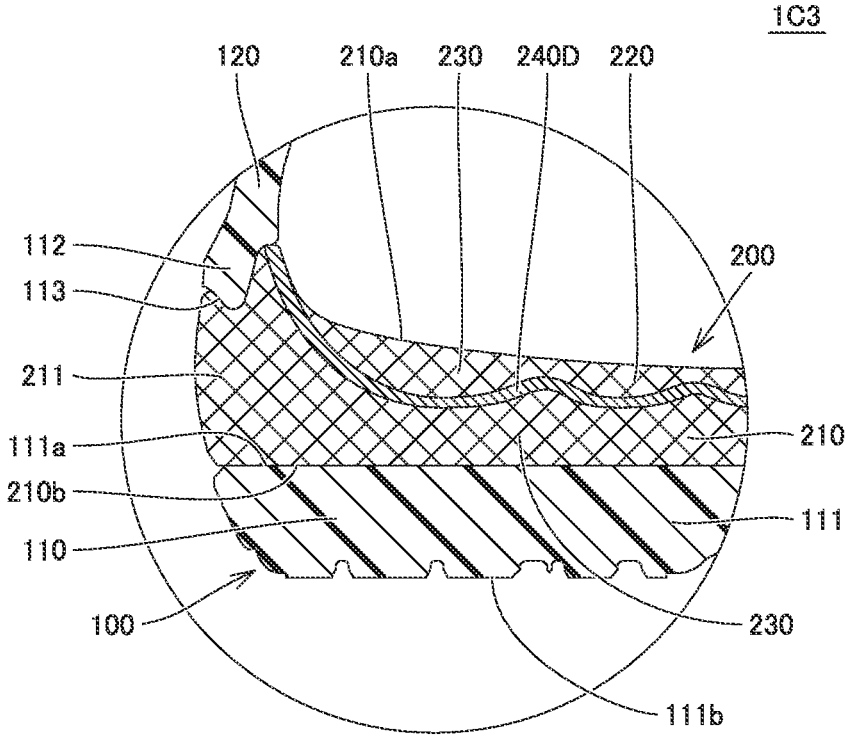
FIG. 34B is an enlarged view of a region XXXIVB shown in FIG. 34A.

FIG. 34A is a schematic cross-sectional view of footwear according to the fourteenth modification, and FIG. 34B is an enlarged view of a region XXXIVB shown in FIG. 34A. Referring to FIGS. 34A and 34B, footwear 1C3 according to the fourteenth modification based on the above-described third embodiment will be described below.

As shown in FIGS. 34A and 34B, in the footwear 1C3 according to the fourteenth modification, similarly to the footwear 1C according to the above-described third embodiment, the shock absorbing portion 220 is provided almost entirely in the foot bed portion 210 in the sole body 200, and the shock absorbing portion 220 includes the three-dimensional mesh structure portion 230 and the protruding plate portion 240D. In this case, the protruding plate portion 240D has a plurality of downward protruding portions.

Specifically, the protruding plate portion 240D includes the downward protruding portions in a region that supports a part of the foot sole that corresponds to a head of a metatarsal bone of each toe of the wearer's foot, and the number of the downward protruding portions is five according to the number of toes. These five downward protruding portions are connected continuously to each other substantially in the left-right direction.

Further, the upper end of the protruding plate portion 240D that is located at the outermost portion in the left-right direction extends to the supporting surface 210*a* of the foot bed portion 210, and further extends to the engaging portion 211 provided as a protruding portion having a protruding shape and extending in the peripheral direction of the peripheral surface 210*c* of the foot bed portion 210. However, the upper ends of the protruding plate portion 240D except for the above-mentioned upper end located at the outermost portion in the left-right direction do not extend to the supporting surface 210*a* of the foot bed portion 210, and are embedded in the three-dimensional mesh structure portion 230.

In the configuration as described above, when the wearer's foot lands on the ground, the part of the foot sole that corresponds to the head of the metatarsal bone of each toe of the wearer's foot is inserted into a corresponding one of the downward protruding portions. Thus, while the wearer is walking, the protruding plate portion 240D is further fitted and caught in the protrusions and recesses of the wearer's foot, which makes it possible for the wearer to walk more smoothly.

Further, similarly to the thirteenth modification, the occupied volume ratio of the engaging portion 211 is locally increased by the upper end located at the outermost portion of the protruding plate portion 240D, which makes it possible to achieve a secondary effect by which the shell 100 can be prevented from unintentionally falling off from the sole body 200.

Fifteenth Modification

Figure 35A:
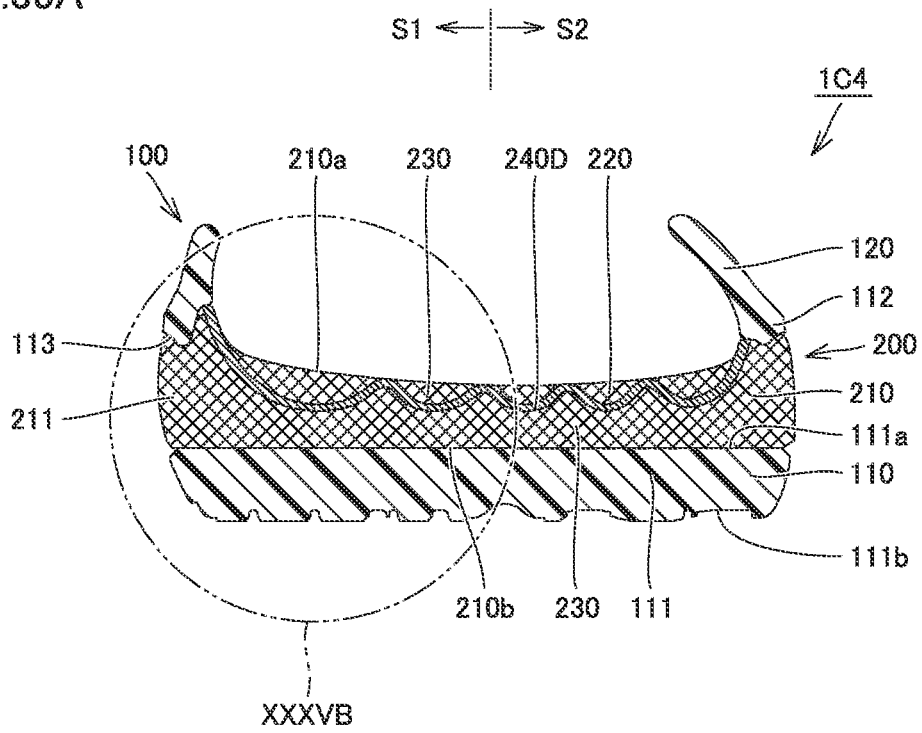
FIG. 35A is a schematic cross-sectional view of footwear according to a fifteenth modification.
Figure 35B:
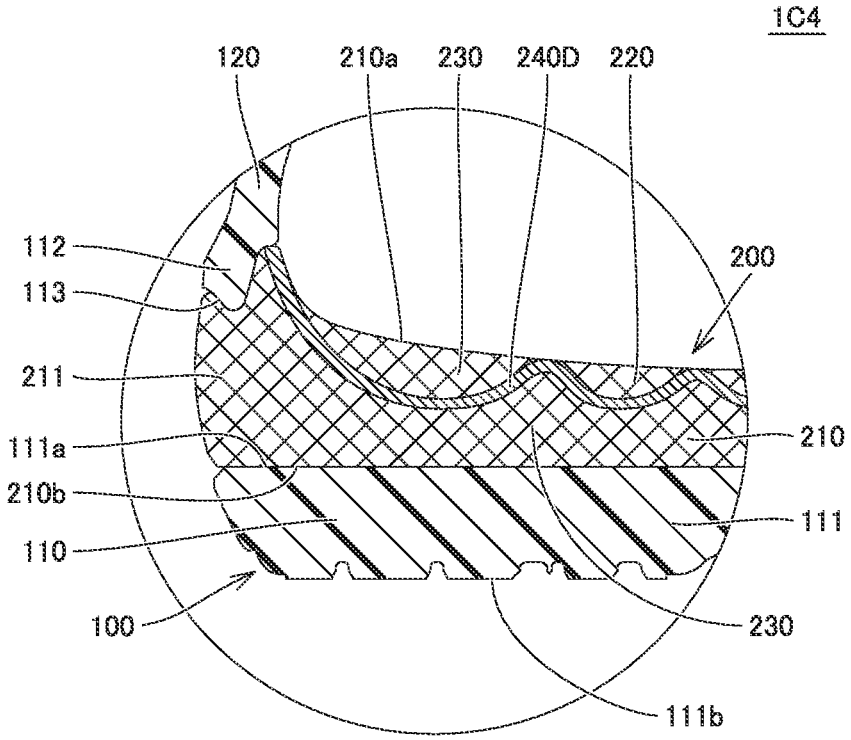
FIG. 35B is an enlarged view of a region XXXVB shown in FIG. 35A.

FIG. 35A is a schematic cross-sectional view of footwear according to the fifteenth modification, and FIG. 35B is an enlarged view of a region XXXVB shown in FIG. 35A. Referring to FIGS. 35A and 35B, footwear 1C4 according to the fifteenth modification based on the above-described third embodiment will be described below.

As shown in FIGS. 35A and 35B, in the footwear 1C4 according to the fifteenth modification, similarly to the footwear 1C3 according to the above-described fourteenth modification, the protruding plate portion 240D includes a downward protruding portion in a region that supports the part of the foot sole that corresponds to the head of the metatarsal bone of each toe of the wearer's foot. In this case, the protruding plate portion 240D is configured such that not only its upper end located at the outermost portion in the left-right direction but also its upper end located at the end portion of the peripheral edge portion provided in each of the downward protruding portions extends to the supporting surface 210*a* of the foot bed portion 210.

Also in the configuration as described above, similarly to the above-described fourteenth modification, when the wearer's foot lands on the ground, the part of the foot sole that corresponds to the head of the metatarsal bone of each toe of the wearer's foot is inserted into a corresponding one of the downward protruding portions. This makes it possible for the wearer to walk smoothly.

Fourth Embodiment

Figure 36:
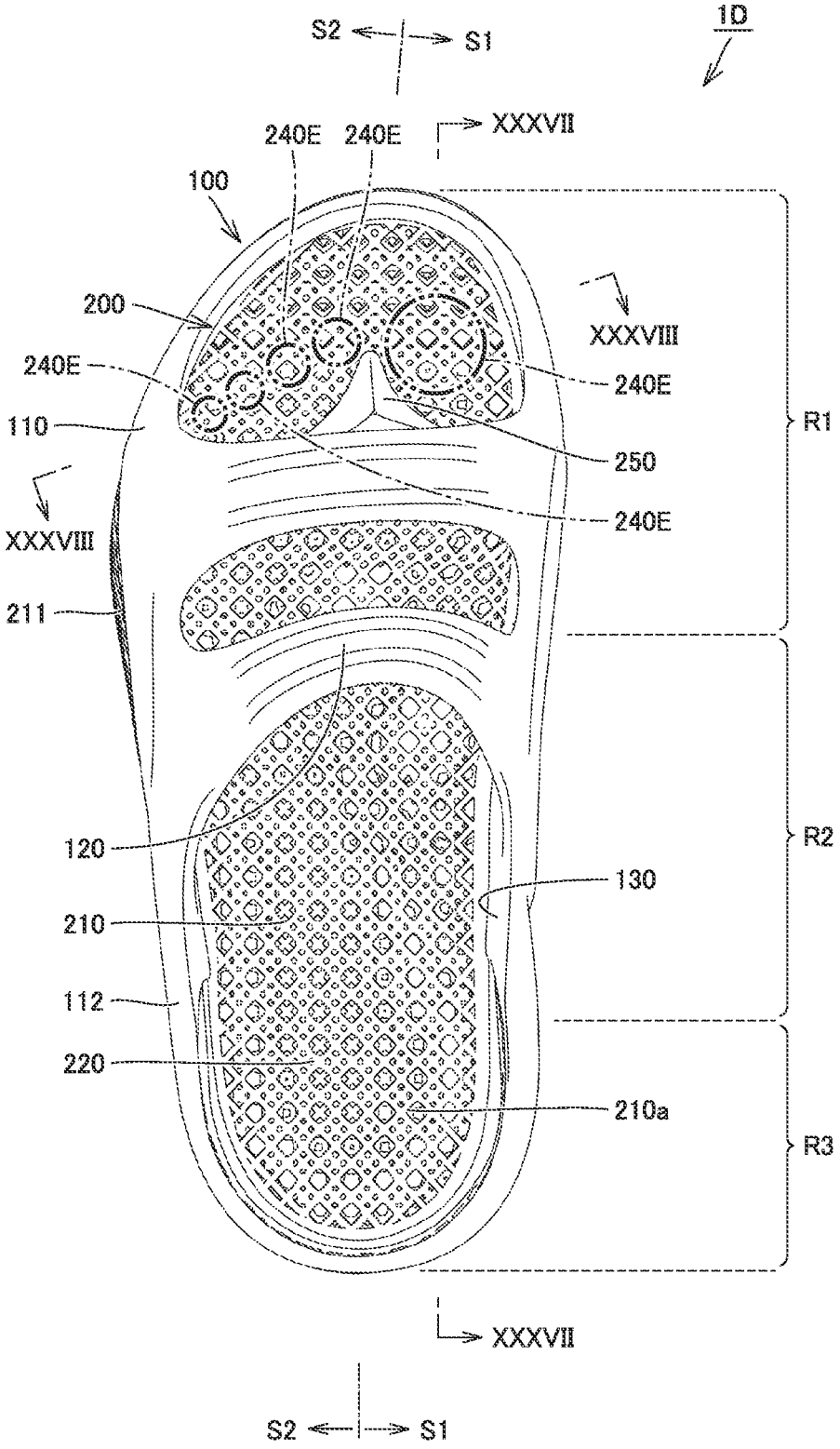
FIG. 36 is a plan view of footwear according to a fourth embodiment.
Figure 37:
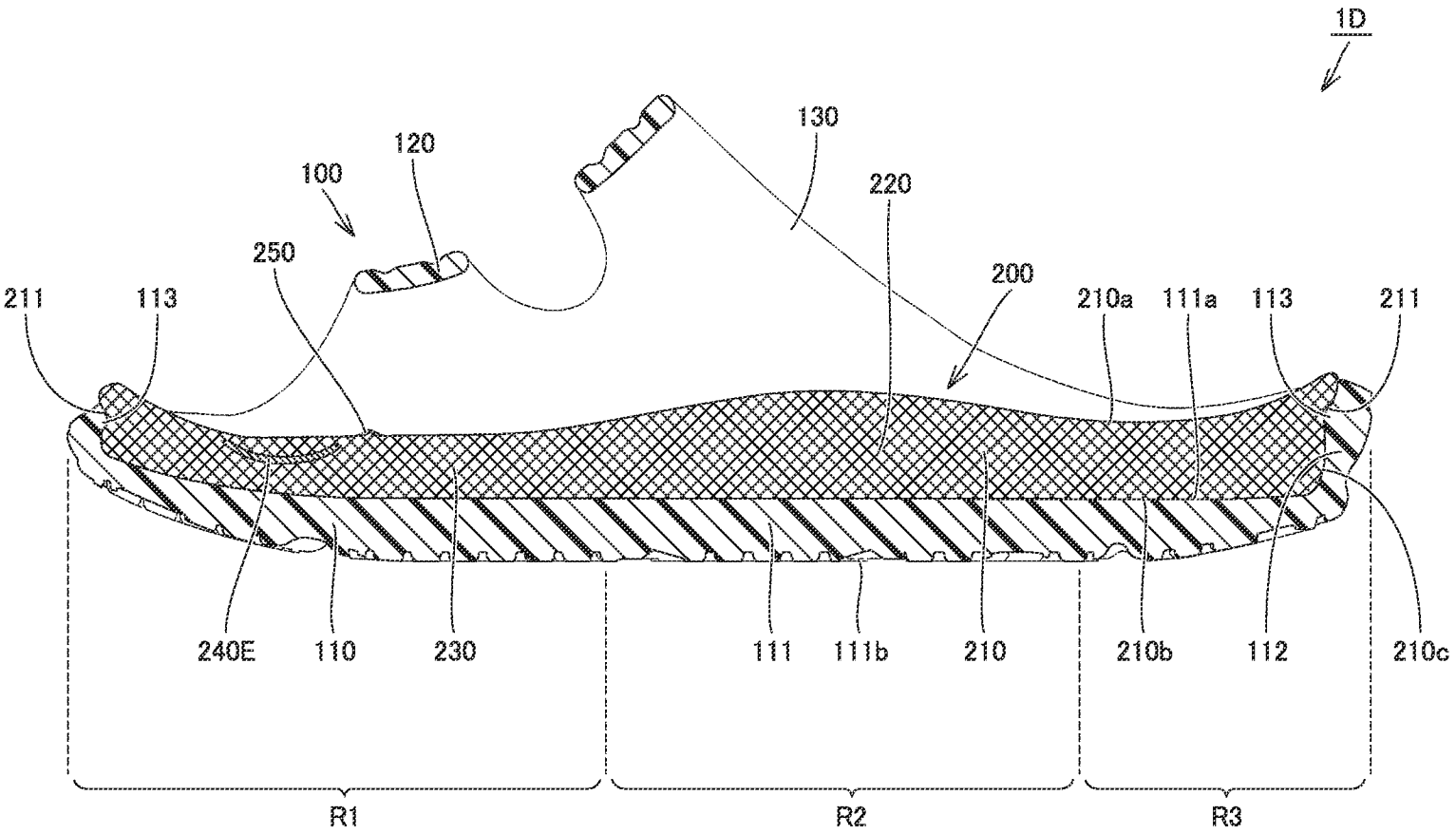
FIG. 37 is a schematic cross-sectional view taken along a line XXXVII-XXXVII shown in FIG. 36.
Figure 38:
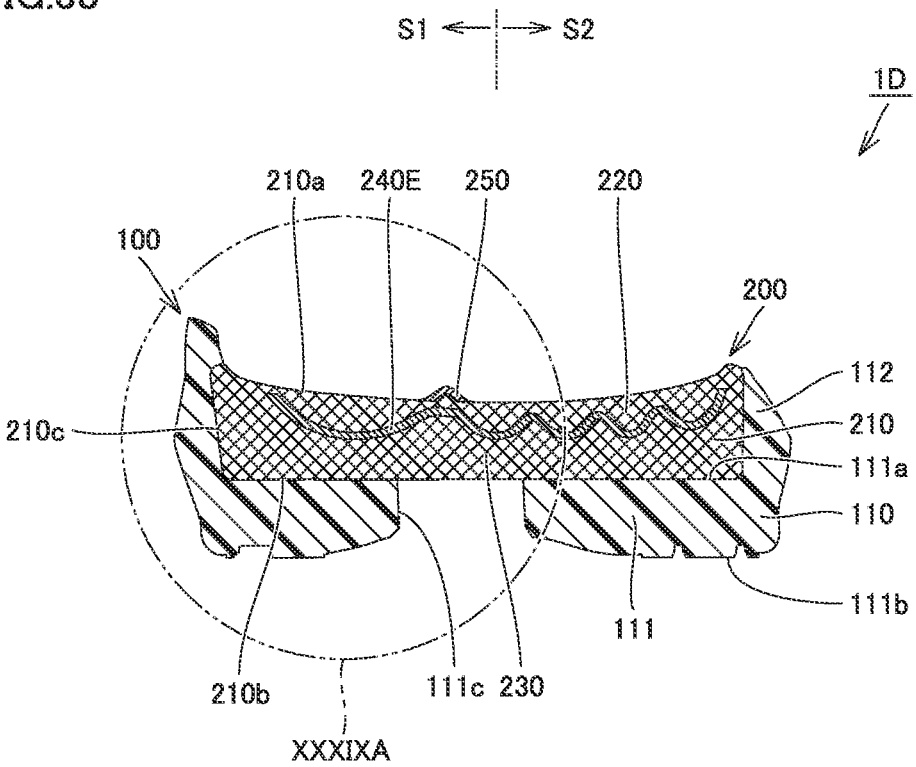
FIG. 38 is a schematic cross-sectional view taken along a line XXXVIII-XXXVIII shown in FIG. 36.
Figure 39A:
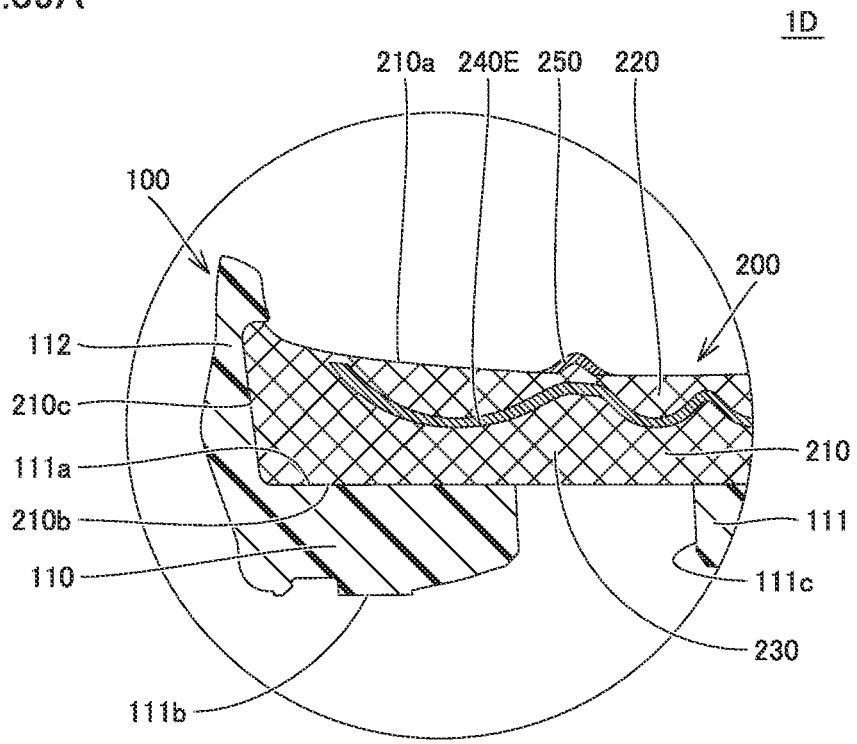
FIG. 39A is an enlarged view of a region XXXIXA shown in FIG. 38.
Figure 39B:
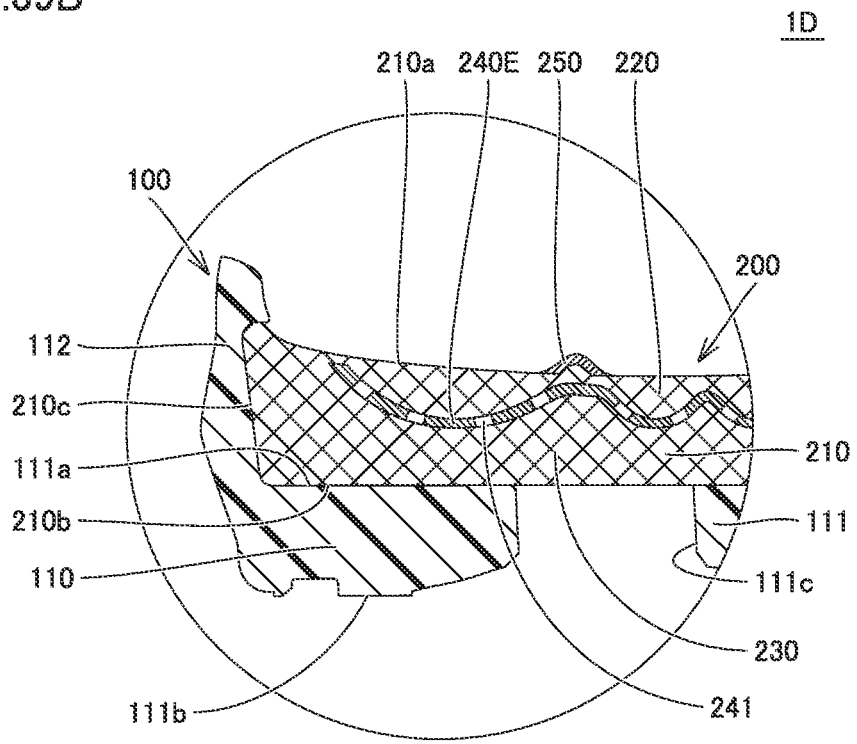
FIG. 39B is a schematic view illustrating a protruding plate portion having a configuration similar to the configuration shown in FIG. 39A.

FIG. 36 is a plan view of footwear according to the fourth embodiment. FIGS. 37 and 38 are schematic cross-sectional views taken along lines XXXVII-XXXVII and XXXVIII-XXXVIII, respectively, shown in FIG. 36. FIG. 39A is an enlarged view of a region XXXIXA shown in FIG. 38, and FIG. 39B is a schematic view illustrating a protruding plate portion having a configuration similar to the configuration shown in FIG. 39A. Referring to FIGS. 36 to 39B, footwear 1D according to the present embodiment will be described below.

As shown in FIGS. 36 to 39B, the footwear 1D according to the present embodiment includes the shell 100 and the sole body 200 similarly to the footwear 1A according to the above-described first embodiment, but the configuration of the sole body 200 is different from that of the footwear 1A according to the first embodiment.

Specifically, the shock absorbing portion 220 of the sole body 200 of the footwear 1D includes the three-dimensional mesh structure portion 230 and a protruding plate portion 240E as an irregularly shaped portion. Among them, the protruding plate portion 240E is located inside the shock absorbing portion 220 while being completely embedded in the three-dimensional mesh structure portion 230.

The protruding plate portion 240E is disposed in a region of the sole body 200 that supports a part of the foot sole that corresponds to the toe portion of the wearer's foot. More specifically, the protruding plate portion 240E is located substantially in a central portion of the forefoot portion R1 in the front-rear direction so as to extend in the left-right direction, and is embedded in the three-dimensional mesh structure portion 230 as described above. Note that a region of the sole body 200 that supports a part of the foot sole that corresponds to the toe portion of the wearer's foot is derived based on a standard wearer having a foot size corresponding to the size of the footwear 1D.

The protruding plate portion 240E has a shape different from that of the unit structure of the three-dimensional mesh structure portion 230, and specifically, has a curved plate shape in which its peripheral portion protrudes relative to its central portion in a direction orthogonal to the ground contact surface 111*b*. In particular, in the footwear 1D according to the present embodiment, the protruding plate portion 240E is configured to include a plurality of downward protruding portions each having a space provided therein.

The protruding plate portion 240E includes a downward protruding portion in a region that supports a part of the foot sole that corresponds to each toe of the wearer's foot, and the number of the downward protruding portions is five according to the number of toes. These five downward protruding portions are connected continuously to each other substantially in the left-right direction.

In each of the downward protruding portions included in the protruding plate portion 240E, its upper end (the end portion of the peripheral edge portion) does not extend to the supporting surface 210*a* of the foot bed portion 210 and its lower end (the vertex of the central portion) also does not extend to the supported surface 210*b* of the foot bed portion 210.

In this case, the three-dimensional mesh structure portion 230 is located not only in the space outside the portion including the protruding plate portion 240E, but also in the space provided inside the protruding plate portion 240E by providing the protruding plate portion 240E. Thus, the upper surface and the lower surface of the protruding plate portion 240E are completely covered by the three-dimensional mesh structure portion 230.

Thus, by providing the protruding plate portion 240E with a downward protruding portion in the region of the sole body 200 that supports the part of the foot sole that corresponds to the toe portion of the wearer's foot, the compression rigidity of the shock absorbing portion 220 in the portion including the protruding plate portion 240E is significantly higher than the compression rigidity of the portion formed only of the three-dimensional mesh structure portion 230 where the protruding plate portion 240E is not provided. Therefore, by the configuration as described above, in the state in which the increase in weight is minimized, the compression rigidity of the region of the sole body 200 that supports the part of the foot sole that corresponds to the toe portion of the wearer's foot can be locally increased while maintaining the deformability around this region.

In the configuration described above, the three-dimensional mesh structure portion 230 having a prescribed thickness and excellent deformability is located above the protruding plate portion 240E having relatively high compression rigidity. Thus, at the early stage of the foot landing action, the portion of the three-dimensional mesh structure portion 230 that is located above the protruding plate portion 240E is easily deformed to thereby enable an improved feel of contact for the wearer's foot. Also, at the end stage of the foot landing action, the toe portion of the wearer's foot can be held with stability. This makes it possible to implement footwear by which both the wearing comfort and the holding stability for wearer's foot can be achieved.

In addition, in the configuration as described above, the toe portion of the wearer's foot is disposed above the protruding plate portion 240E during wearing of the footwear. Thus, when the wearer's foot lands on the ground, the portion of the three-dimensional mesh structure portion 230 that is located above the protruding plate portion 240E is deformed, and the toe portion of the wearer's foot is inserted into the space provided inside the protruding plate portion 240E. Thereby, while the wearer is walking, the protruding plate portion 240E is fitted and caught in the protrusions and recesses of the wearer's foot, which makes it possible for the wearer to walk more smoothly. Particularly when the foot pushes off the ground, the toe portion of the wearer's foot is stably held as described above, so that the wearer can feel as if the wearer is walking barefoot.

The protruding plate portion 240E shown in FIG. 39A does not include a hole portion, but the protruding plate portion 240E can include a hole portion 241 penetrating therethrough in its thickness direction as shown in FIG. 39B. In the case where the protruding plate portion 240E includes the hole portion 241 in this way, the unhardened liquid resin or the like is easily discharged to the outside through the hole portion 241 in the washing step during additive manufacturing of the sole body 200 by the vat polymerization-type three-dimensional additive manufacturing method. This makes it possible to reduce the possibility that the unhardened liquid resin can remain inside the sole body 200 during the subsequent heat treatment, which consequently contributes to improvement in accuracy of additive manufacturing. Note that a plurality of the hole portions 241 can be provided as shown in the figure, or only one hole portion 241 can be provided.

Sixteenth Modification

Figure 40A:
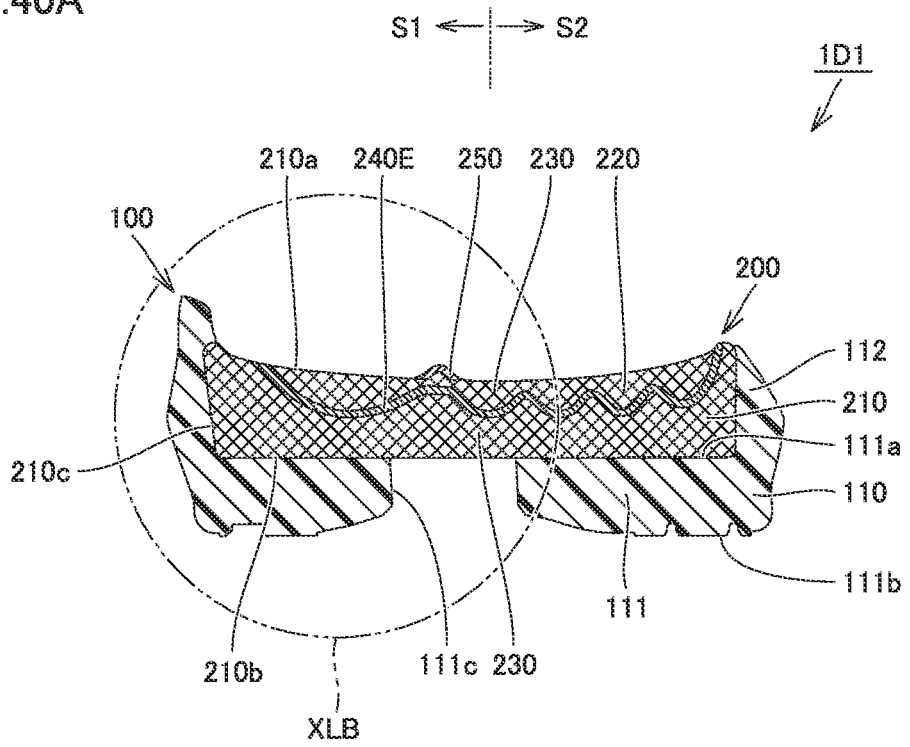
FIG. 40A is a schematic cross-sectional view of footwear according to a sixteenth modification.
Figure 40B:
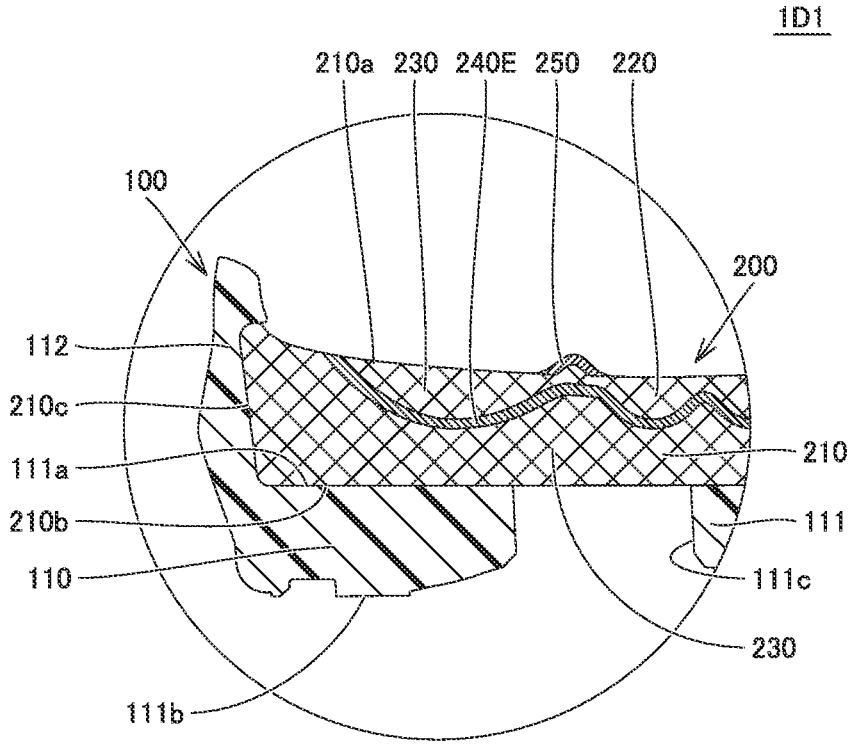
FIG. 40B is an enlarged view of a region XLB shown in FIG. 40A.

FIG. 40A is a schematic cross-sectional view of footwear according to the sixteenth modification, and FIG. 40B is an enlarged view of a region XLB shown in FIG. 40A. Referring to FIGS. 40A and 40B, footwear 1D1 according to the sixteenth modification based on the above-described fourth embodiment will be described below.

As shown in FIGS. 40A and 40B, in the footwear 1D1 according to the sixteenth modification, similarly to the footwear 1D according to the above-described fourth embodiment, the protruding plate portion 240E includes a plurality of downward protruding portions in a region that supports a part of the foot sole that corresponds to each toe of the wearer's foot. In this case, only an upper end of the protruding plate portion 240E that is located at the outermost portion in the left-right direction extends to the supporting surface 210*a* of the foot bed portion 210.

Also in the configuration as described above, similarly to the above-described fourth embodiment, when the wearer's foot lands on the ground, the part of the foot sole that corresponds to each toe of the wearer's foot is inserted into a corresponding one of the downward protruding portions. Thus, while the wearer is walking, the protruding plate portion 240E is further fitted and caught in the protrusions and recesses of the wearer's foot, which makes it possible for the wearer to walk more smoothly.

Seventeenth Modification

Figure 41:
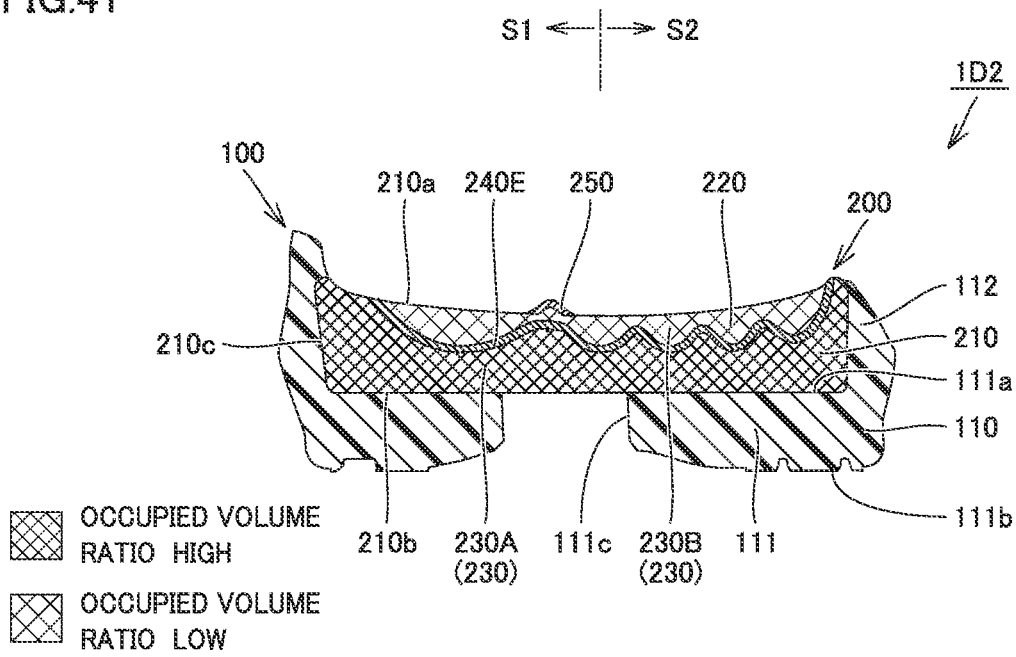
FIG. 41 is a schematic cross-sectional view of footwear according to a seventeenth modification.

FIG. 41 is a schematic cross-sectional view of footwear according to the seventeenth modification. Referring to FIG. 41, footwear 1D2 according to the seventeenth modification based on the above-described fourth embodiment will be described below.

As shown in FIG. 41, in the footwear 1D2 according to the seventeenth modification, similarly to the footwear 1D1 according to the above-described sixteenth modification, the protruding plate portion 240E includes a downward protruding portion in a region that supports a part of the foot sole that corresponds to each toe of the wearer's foot, and only an upper end of the protruding plate portion 240E that is located at the outermost portion in the left-right direction extends to the supporting surface 210*a* of the foot bed portion 210. In this case, the occupied volume ratio of the three-dimensional mesh structure portion 230 is different in each part.

Specifically, in the footwear 1D2, the occupied volume ratio of the three-dimensional mesh structure portion 230 disposed in the space outside the portion including the protruding plate portion 240E is relatively high, and the occupied volume ratio of the three-dimensional mesh structure portion 230 disposed in the space inside the portion provided with the protruding plate portion 240E is relatively low. In other words, the occupied volume ratio of the three-dimensional mesh structure portion 230 is different between the inside and the outside of the protruding plate portion 240E, and the deformability of the three-dimensional mesh structure portion 230 disposed in the space inside the protruding plate portion 240E is further enhanced.

In the configuration as described above, when a load is applied to the foot bed portion 210, an excessive increase in compression rigidity caused by providing the protruding plate portion 240E can be suppressed, and the above-described downward protruding shape of the protruding plate portion 240E can be maintained, which makes it possible to prevent the wearer from feeling significantly uncomfortable while still allowing the toe portion of the wearer's foot to be stably held when the foot lands on the ground.

SUMMARY OF THE DISCLOSURE IN EMBODIMENTS

The following summarizes the characteristic points disclosed in the above-described first to fourth embodiments and their modifications.

Supplementary Note 1

Footwear comprising a sole portion that supports a foot sole of a foot of a wearer, the sole portion including a ground contact surface, wherein the sole portion includes a shock absorbing portion formed of an elastic body, the shock absorbing portion includes a three-dimensional mesh structure portion in which a plurality of unit structures are repeatedly arranged so as to be adjacent to each other, and an irregularly shaped portion that is different in shape from each of the unit structures, the irregularly shaped portion being at least partially embedded in the three-dimensional mesh structure portion, and the irregularly shaped portion includes a protruding plate portion in which a central portion protrudes relative to a peripheral edge portion in a direction orthogonal to the ground contact surface.

Supplementary Note 2

The footwear according to Supplementary Note 1, wherein the protruding plate portion is provided such that the peripheral edge portion is located closer to the ground contact surface than the central portion.

Supplementary Note 3

The footwear according to Supplementary Note 2, wherein, in a region of the three-dimensional mesh structure portion that is located outside the protruding plate portion in a direction parallel to the ground contact surface, an occupied volume ratio of a portion of the three-dimensional mesh structure portion that is located adjacent to the protruding plate portion is locally low.

Supplementary Note 4

The footwear according to Supplementary Note 2 or 3, wherein, in a region of the three-dimensional mesh structure portion that is located outside the protruding plate portion in a direction parallel to the ground contact surface, an occupied volume ratio of the three-dimensional mesh structure portion increases gradually away from the protruding plate portion.

Supplementary Note 5

The footwear according to any one of Supplementary Notes 2 to 4, wherein, assuming that an upper surface of the shock absorbing portion in each of a portion provided with the protruding plate portion and an adjacent portion is defined as a first region and an upper surface of the shock absorbing portion in a portion located around the first region is defined as a second region, the first region protrudes more than the second region, the adjacent portion being adjacent to the portion provided with the protruding plate portion.

Supplementary Note 6

The footwear according to any one of Supplementary Notes 2 to 5, wherein the protruding plate portion is disposed in a region of the sole portion that supports a part of the foot sole that corresponds to a transverse arch of the foot of the wearer.

Supplementary Note 7

The footwear according to any one of Supplementary Notes 2 to 5, wherein the protruding plate portion is disposed in a region of the sole portion that supports a part of the foot sole that corresponds to a medial longitudinal arch of the foot of the wearer.

Supplementary Note 8

The footwear according to any one of Supplementary Notes 2 to 7, wherein the protruding plate portion is substantially completely embedded in the three-dimensional mesh structure portion.

Supplementary Note 9

The footwear according to any one of Supplementary Notes 2 to 7, wherein a lower end side portion of the protruding plate portion is embedded in the three-dimensional mesh structure portion, and an upper end side portion of the protruding plate portion protrudes upward from the three-dimensional mesh structure portion.

Supplementary Note 10

The footwear according to Supplementary Note 1, wherein the protruding plate portion is provided such that the central portion is located closer to the ground contact surface than the peripheral edge portion.

Supplementary Note 11

The footwear according to Supplementary Note 10, wherein the protruding plate portion is disposed in a region of the sole portion that supports a part of the foot sole that corresponds to a heel portion of the foot of the wearer.

Supplementary Note 12

The footwear according to Supplementary Note 10, wherein the protruding plate portion is disposed in a region of the sole portion that supports a part of the foot sole that corresponds to a metatarsophalangeal joint of the foot of the wearer.

Supplementary Note 13

The footwear according to Supplementary Note 10, wherein the protruding plate portion is disposed in a region of the sole portion that supports a part of the foot sole that corresponds to a toe portion of the foot of the wearer.

Supplementary Note 14

The footwear according to any one of Supplementary Notes 10 to 13, wherein the protruding plate portion is substantially completely embedded in the three-dimensional mesh structure portion.

Supplementary Note 15

The footwear according to any one of Supplementary Notes 10 to 13, wherein an upper end side portion of the protruding plate portion is embedded in the three-dimensional mesh structure portion, and a lower end side portion of the protruding plate portion protrudes downward from the three-dimensional mesh structure portion.

Supplementary Note 16

The footwear according to any one of Supplementary Notes 1 to 15, wherein a connection portion of the three-dimensional mesh structure portion at which the three-dimensional mesh structure portion is connected to the protruding plate portion is formed to be thicker than a portion other than the connection portion in the three-dimensional mesh structure portion such that the three-dimensional mesh structure portion is reinforced more in the connection portion than in the portion other than the connection portion.

Supplementary Note 17

The footwear according to any one of Supplementary Notes 1 to 16, wherein the protruding plate portion includes a hole portion penetrating through the protruding plate portion in a thickness direction of the protruding plate portion.

Supplementary Note 18

The footwear according to any one of Supplementary Notes 1 to 17, wherein an occupied volume ratio of the three-dimensional mesh structure portion is different between a portion located outside the protruding plate portion in a direction parallel to the ground contact surface and a portion located inside the protruding plate portion in the direction parallel to the ground contact surface.

Supplementary Note 19

The footwear according to any one of Supplementary Notes 1 to 18, wherein a unit structure of the three-dimensional mesh structure portion is different between a portion located outside the protruding plate portion in a direction parallel to the ground contact surface and a portion located inside the protruding plate portion in the direction parallel to the ground contact surface.

Supplementary Note 20

The footwear according to any one of Supplementary Notes 1 to 19, wherein the shock absorbing portion is formed of a single additively manufactured product produced by a vat polymerization-type three-dimensional additive manufacturing method.

Supplementary Note 21

The footwear according to any one of Supplementary Notes 1 to 20, wherein a protrusion is provided in a region of an upper surface of the shock absorbing portion, the region serving to support a part of the foot sole that corresponds to a portion between a toe portion and a ball portion of the foot of the wearer.

Supplementary Note 22

The footwear according to any one of Supplementary Notes 1 to 21, wherein the footwear is a sandal.

Other Embodiments

In the above illustrative description about the first to fourth embodiments and their modifications, the protruding plate portion formed as an irregularly shaped portion is configured to have a curved plate shape, but the shape of the protruding plate portion can be modified as appropriate. For example, the protruding plate portion can be configured to have a bent plate shape, or can be configured to have a composite shape including a curved plate portion and a bent plate portion. Further, the arrangement position, the size, the number and the like of the protruding plate portion(s) can also be changed as appropriate.

Further, in the above illustrative description about the first to fourth embodiments and their modifications, only the protruding plate portion having an upward protruding shape is configured such that its upper end and its lower end extend to the supporting surface and the supported surface, respectively, of the foot bed portion, or the protruding plate portion having an upward protruding shape is configured to protrude from the supporting surface of the foot bed portion, but the protruding plate portion having a downward protruding shape can also be configured such that its upper end and its lower end extend to the supporting surface and the supported surface, respectively, of the foot bed portion, or can be configured to protrude from the supported surface of the foot bed portion (i.e., to protrude downward from the three-dimensional mesh structure portion).

Further, in the above illustrative description about the first embodiment and its modifications, the protruding plate portions are independently disposed in the region of the sole body that supports a part of the foot sole that corresponds to the transverse arch of the wearer's foot and the region of the sole body that supports a part of the foot sole that corresponds to the medial longitudinal arch of the wearer's foot, and the protruding plate portion is provided only in the region of the sole body that supports a part of the foot sole that corresponds to the medial longitudinal arch of the wearer's foot, but various modifications can also be made in this regard. For example, the protruding plate portion can be disposed only in a region of the sole body that supports a part of the foot sole that corresponds to the transverse arch of the wearer's foot, or one protruding plate portion can be provided so as to extend over a region of the sole body that supports a part of the foot sole that corresponds to the transverse arch of the wearer's foot and a region of the sole body that supports a part of the foot sole that corresponds to the medial longitudinal arch of the wearer's foot. Further, the protruding plate portion can be provided in a region of the sole body that supports a part of the foot sole that corresponds to the lateral longitudinal arch of the wearer's foot.

Further, in the above illustrative description about the first to fourth embodiments and their modifications, the foot bed portion of the sole body is almost entirely configured as a shock absorbing portion, but instead, only a part of the foot bed portion can be configured as a shock absorbing portion, or a plurality of portions independent of each other in the foot bed portion can be configured as shock absorbing portions.

In the above illustrative description about the first to fourth embodiments and their modifications, the sole body is formed of a single member, but instead, a single sole body can be formed by combining a plurality of divided members.

Further, in the above illustrative description about the first to fourth embodiments and their modifications, a shell and a sole body are separately prepared to form footwear, but all of the parts of the footwear can be formed of a single member, or footwear can be divided to be formed of a combination other than the combination of the shell and the sole body.

Further, as described in the above first to fourth embodiments and their modifications, the sole body including the shock absorbing portion including the three-dimensional mesh structure portion and the protruding plate portion as an irregularly shaped portion can be manufactured by a three-dimensional additive manufacturing method. Thus, when the sole body is manufactured by the three-dimensional additive manufacturing method, the sole body can be manufactured by determining the shape of the sole body based on the measurement data obtained by measuring the shape of the wearer's foot. Further, by measuring and/or additionally evaluating the posture and the motion of the wearer who is walking, the shape of the sole body can be determined in consideration of the obtained measurement results and evaluation results. Further, the shape of the sole body can also be determined in consideration of the user's preference, intended use, use conditions, and the like.

Thus, various parameters (arrangement position, size, number, shape, and the like) of the three-dimensional mesh structure portion and the protruding plate portion as an irregularly shaped portion are adjusted based on the above-mentioned information, to produce design data of the sole body suitable for the wearer and then manufacture a sole body based on the produced design data by the three-dimensional additive manufacturing method, which makes it possible to provide optimal footwear for the wearer.

Further, the characteristic configurations described in the above first to fourth embodiments and their modifications can be combined with each other without departing from the gist of the present disclosure.

Further, in the above first to fourth embodiments and their modifications, sandals have been exemplified and described as footwear, but the present disclosure can also be applicable to other types of footwear such as shoes.

Although the embodiments according to the present disclosure have been described as above, it should be understood that the embodiments disclosed herein are illustrative and non-restrictive in every respect. The scope of the present disclosure is defined by the scope of the claims and is intended to include any modifications within the meaning and scope equivalent to the terms of the claims.

What is claimed is:

1. Footwear comprising:

a sole portion configured to support a foot sole of a foot of a wearer, the sole portion including a ground contact surface, and a shock absorbing portion formed from an elastic body, the shock absorbing portion including:

a three-dimensional mesh structure portion in which a plurality of unit structures are repeatedly arranged so as to be adjacent to each other, and an irregularly shaped portion that has a different shape from each of the unit structures, the irregularly shaped portion being at least partially embedded in the three-dimensional mesh structure portion, the irregularly shaped portion including a protruding plate portion in which a central portion protrudes relative to a peripheral edge portion in a direction orthogonal to the ground contact surface, and the three-dimensional mesh structure portion being disposed in at least a part on each of an inside and an outside of the protruding plate portion of the irregularly shaped portion.

2. The footwear according to claim 1, wherein the protruding plate portion is disposed such that the peripheral edge portion is located closer to the ground contact surface than the central portion.

3. The footwear according to claim 2, wherein, in a region of the three-dimensional mesh structure portion that is located outside the protruding plate portion in a direction parallel to the ground contact surface, an occupied volume ratio of a portion of the three-dimensional mesh structure portion that is located adjacent to the protruding plate portion is locally low.

4. The footwear according to claim 2, wherein, in a region of the three-dimensional mesh structure portion that is located outside the protruding plate portion in a direction parallel to the ground contact surface, an occupied volume ratio of the three-dimensional mesh structure portion increases gradually away from the protruding plate portion.

5. The footwear according to claim 2, wherein, an upper surface of the shock absorbing portion including the protruding plate portion and an adjacent portion is a first region and an upper surface of the shock absorbing portion in a portion located around the first region is a second region, the first region protrudes more than the second region, the adjacent portion being adjacent to a portion including the protruding plate portion.

6. The footwear according to claim 2, wherein the protruding plate portion is disposed in a region of the sole portion configured to support a part of the foot sole that corresponds to a transverse arch of the foot of the wearer.

7. The footwear according to claim 2, wherein the protruding plate portion is disposed in a region of the sole portion configured to support a part of the foot sole that corresponds to a medial longitudinal arch of the foot of the wearer.

8. The footwear according to claim 2, wherein the protruding plate portion is substantially completely embedded in the three-dimensional mesh structure portion.

9. The footwear according to claim 2, wherein a lower end side portion of the protruding plate portion is embedded in the three-dimensional mesh structure portion, and an upper end side portion of the protruding plate portion protrudes upward from the three-dimensional mesh structure portion.

10. The footwear according to claim 1, wherein the protruding plate portion is provided such that the central portion is located closer to the ground contact surface than the peripheral edge portion.

11. The footwear according to claim 10, wherein the protruding plate portion is disposed in a region of the sole portion configured to support a part of the foot sole that corresponds to a heel portion of the foot of the wearer.

12. The footwear according to claim 10, wherein the protruding plate portion is disposed in a region of the sole portion configured to support a part of the foot sole that corresponds to a metatarsophalangeal joint of the foot of the wearer.

13. The footwear according to claim 10, wherein the protruding plate portion is disposed in a region of the sole portion configured to supporting a part of the foot sole that corresponds to a toe portion of the foot of the wearer.

14. The footwear according to claim 10, wherein the protruding plate portion is substantially completely embedded in the three-dimensional mesh structure portion.

15. The footwear according to claim 1, wherein a connection portion of the three-dimensional mesh structure portion connects the three-dimensional mesh structure portion to the protruding plate portion is thicker than a portion other than the connection portion in the three-dimensional mesh structure portion such that the three-dimensional mesh structure portion is reinforced more in the connection portion than in the portion other than the connection portion.

16. The footwear according to claim 1, wherein the protruding plate portion includes a hole portion penetrating through the protruding plate portion in a thickness direction of the protruding plate portion.

17. The footwear according to claim 1, wherein an occupied volume ratio of the three-dimensional mesh structure portion is different between a portion located outside the protruding plate portion in a direction parallel to the ground contact surface and a portion located inside the protruding plate portion in the direction parallel to the ground contact surface.

18. The footwear according to claim 1, wherein a unit structure of the three-dimensional mesh structure portion is different between a portion located outside the protruding plate portion in a direction parallel to the ground contact surface and a portion located inside the protruding plate portion in a direction parallel to the ground contact surface.

19. The footwear according to claim 1, wherein the shock absorbing portion is a single additively manufactured product produced by a vat polymerization-type three-dimensional additive manufacturing method.

20. The footwear according to claim 1, further comprising a protrusion disposed in a region of an upper surface of the shock absorbing portion, the region configured to support a part of the foot sole corresponding to a portion between a toe portion and a ball portion of the foot of the wearer.

* * * * *